US011041426B2

(12) United States Patent
Nugteren et al.

(10) Patent No.: US 11,041,426 B2
(45) Date of Patent: Jun. 22, 2021

(54) ENGINE

(71) Applicant: Polaris Industries Inc., Medina, MN (US)

(72) Inventors: Daniel J. Nugteren, Chisago City, MN (US); Alexander W. Oppermann, Huntley, IL (US); C. Scott Walter, Amery, WI (US); G. Jay McKoskey, Forest Lake, MN (US); Jeffrey M. Maher, Hugo, MN (US)

(73) Assignee: Polaris Industries Inc., Medina, MN (US)

( * ) Notice: Subject to any disclaimer, the term of this patent is extended or adjusted under 35 U.S.C. 154(b) by 0 days.

(21) Appl. No.: 16/714,077

(22) Filed: Dec. 13, 2019

(65) Prior Publication Data

US 2020/0116069 A1 Apr. 16, 2020

Related U.S. Application Data

(63) Continuation of application No. 15/595,209, filed on May 15, 2017, now Pat. No. 10,550,754.

(51) Int. Cl.

| | |
|---|---|
| ***F01P 3/02*** | (2006.01) |
| ***F01P 5/10*** | (2006.01) |
| ***F01P 11/08*** | (2006.01) |

(52) U.S. Cl.

CPC ..... *F01P 5/10* (2013.01); *F01P 3/02* (2013.01); *F01P 11/08* (2013.01)

(58) Field of Classification Search

CPC .. F01P 3/02; F01P 2003/024; F01P 2003/021; F01P 3/14; F02F 1/40; F02F 1/243; F02F 1/36; F02F 1/14; F02F 7/007

See application file for complete search history.

(56) References Cited

U.S. PATENT DOCUMENTS 3,094,190 A 6/1963 Conover et al.
3,145,695 A 8/1964 Conover et al.
(Continued)

FOREIGN PATENT DOCUMENTS

AU 2013205955 A1 3/2014
CA 974830 A 9/1975
(Continued)

OTHER PUBLICATIONS

International Preliminary Report on Patentability issued by the International Preliminary Examining Authority, dated Aug. 12, 2019, for International Patent Application No. PCT/US2018/032628; 22 pages.

(Continued)

*Primary Examiner* — Long T Tran

(74) *Attorney, Agent, or Firm* — Faegre Drinker Biddle & Reath LLP

(57) ABSTRACT

An engine is disclosed having a water cooling system allowing efficient cooling of the exhaust valves to prevent temperature gradients from building in the engine. Water is therefore pumped through the engine though first and second water cooling cores which discharge through the head. A water manifold is positioned over the discharge opening and includes couplings for the radiator supply, radiator return, water pump supply, oil cooler supply and oil cooler return. The engine has separate chambers to isolate the pistons and cylinders, and reed valves cover the chambers and allow the blow-by gases and oil to enter the oil pan during the power stroke of the engine cycle.

13 Claims, 59 Drawing Sheets

(56) References Cited

U.S. PATENT DOCUMENTS 3,223,197 A 12/1965 Conover et al.
3,859,968 A 1/1975 Stinebaugh
4,157,013 A 6/1979 Bell
D274,995 S 8/1984 Richards et al.
4,503,679 A 3/1985 Saito et al.
4,708,107 A 11/1987 Stinebaugh
4,926,800 A 5/1990 Valev
4,984,539 A 1/1991 Shinoda et al.
5,291,866 A 3/1994 Kosa
5,332,368 A 7/1994 Macier et al.
5,503,117 A 4/1996 Saito
5,647,315 A 7/1997 Saito
5,709,185 A 1/1998 Aizawa et al.
5,715,778 A 2/1998 Hasumi et al.
5,836,272 A * 11/1998 Sakurai ..... F02F 1/40 123/41.82 R
5,868,107 A * 2/1999 Betsch ..... F02F 1/4214 123/41.82 R
5,957,105 A 9/1999 Tsunoda et al.
5,975,033 A * 11/1999 Wada ..... F02B 61/045 123/41.82 R
5,975,042 A 11/1999 Aizawa et al.
5,983,843 A * 11/1999 Suzuki ..... F02F 1/4214 123/41.82 R
5,992,554 A 11/1999 Hasumi et al.
6,029,638 A * 2/2000 Funai ..... F01M 1/12 123/572
D424,979 S 5/2000 Hanagan et al.
6,058,917 A 5/2000 Knowles
6,095,108 A * 8/2000 Tsunoda ..... F02B 61/045 123/195 P
6,109,221 A 8/2000 Higgins et al.
6,161,529 A 12/2000 Burgess
6,202,621 B1 3/2001 Inumaru et al.
6,343,584 B1 2/2002 Kudou et al.
6,412,451 B2 7/2002 Kuga et al.
6,435,264 B1 8/2002 Konno et al.
6,457,449 B1 10/2002 Troxler et al.
D485,788 S 1/2004 Guay et al.
6,705,103 B2 3/2004 Leuthner
6,884,022 B2 4/2005 Albright et al.
6,904,885 B2 6/2005 Osband
6,955,141 B2 10/2005 Santanam et al.
7,194,985 B2 3/2007 Wachigai et al.
D547,701 S 7/2007 Vey
D584,188 S 1/2009 Jenkins et al.
D589,844 S 4/2009 Aube et al.
D592,548 S 5/2009 Aube et al.
D593,908 S 6/2009 Longpre et al.
7,578,277 B2 8/2009 Inui et al.
7,886,705 B2 2/2011 Holler et al.
8,118,001 B2 2/2012 Kowada
8,225,751 B2 7/2012 Kisaichi et al.
8,347,865 B2 1/2013 Valencia et al.
D678,124 S 3/2013 Canni et al.
8,408,166 B1 4/2013 Zhou et al.
D682,158 S 5/2013 Canni et al.
D689,794 S 9/2013 Bracy et al.
8,522,744 B2 9/2013 Takiguchi et al.
8,544,587 B2 10/2013 Holroyd et al.
8,695,746 B2 4/2014 Holroyd et al.
8,807,114 B2 8/2014 Itakura
8,813,692 B2 8/2014 Bialas et al.
D714,980 S 10/2014 Kogawa
8,887,688 B1 11/2014 Neal et al.
8,893,690 B2 11/2014 Efta et al.
D719,692 S 12/2014 Yamaguchi
8,925,500 B2 1/2015 Kisaichi et al.
8,978,613 B2 3/2015 Will
9,080,497 B2 7/2015 Yamashiro et al.
9,140,153 B2 9/2015 Valencia
D740,470 S 10/2015 Tsukui et al.
9,163,552 B2 10/2015 Iida et al.
9,221,508 B1 12/2015 De Haan
9,266,421 B2 2/2016 Sugiura
9,469,374 B2 10/2016 Ziliak
D788,648 S 6/2017 Rudwal et al.
D795,139 S 8/2017 Rudwal et al.
D796,096 S 8/2017 Rudwal et al.
D796,097 S 8/2017 Rudwal et al.
9,771,116 B2 9/2017 Marko
9,938,881 B2 4/2018 Yamada
10,428,705 B2 10/2019 Bluhm et al.
10,550,754 B2 2/2020 Nugteren
10,576,817 B2 3/2020 Battaglini
10,639,985 B2 5/2020 Battaglini
2001/0039908 A1 11/2001 Bilek et al.
2002/0112680 A1 8/2002 Oki et al.
2002/0124815 A1* 9/2002 Ishiguro ..... F02F 1/38 123/41.82 R
2002/0162520 A1 11/2002 Batzill
2002/0170510 A1* 11/2002 Iizuka ..... F02B 75/20 123/41.84
2003/0070661 A1 4/2003 Yasui
2004/0187834 A1 9/2004 Hoff et al.
2004/0206314 A1 10/2004 Gunji et al.
2005/0085329 A1 4/2005 Kawakubo et al.
2005/0257972 A1 11/2005 Iwami et al.
2006/0219208 A1 10/2006 Chonan et al.
2006/0278451 A1 12/2006 Takahashi et al.
2007/0227473 A1* 10/2007 Tsubouchi ..... F02F 1/243 123/41.31
2007/0251227 A1* 11/2007 Tsubouchi ..... F01N 13/001 60/321
2007/0256882 A1 11/2007 Bedard et al.
2008/0060606 A1 3/2008 Inui et al.
2008/0257317 A1 10/2008 Cerabone et al.
2009/0133647 A1* 5/2009 Yamagata ..... F02F 1/40 123/41.82 R
2009/0301414 A1 12/2009 Netsu
2010/0187033 A1 7/2010 Hayashi et al.
2010/0307448 A1 12/2010 Chen et al.
2011/0042158 A1 2/2011 Portelance
2011/0049205 A1 3/2011 Laperle et al.
2011/0079187 A1 4/2011 Steiner et al.
2011/0114286 A1 5/2011 Komatsu et al.
2011/0232477 A1 9/2011 Taki et al.
2011/0304176 A1 12/2011 Kihara et al.
2012/0085299 A1* 4/2012 Kuhlbach ..... F02F 1/40 123/41.72
2013/0092108 A1 4/2013 Mehring et al.
2013/0213370 A1 8/2013 Shirabe et al.
2013/0256044 A1 10/2013 Sugiura
2013/0276767 A1 10/2013 Polichetti et al.
2014/0026832 A1 1/2014 Yamashiro et al.
2014/0034008 A1 2/2014 Mehring et al.
2014/0123931 A1 5/2014 Mavinahally
2014/0124279 A1 5/2014 Schlangen et al.
2014/0131129 A1 5/2014 Galsworthy et al.
2015/0068830 A1 3/2015 Nakata et al.
2015/0122205 A1 5/2015 Tada et al.
2015/0122567 A1 5/2015 Marois et al.
2015/0343900 A1 12/2015 Schlangen et al.
2016/0084147 A1 3/2016 Sotani et al.
2016/0091077 A1 3/2016 Sotani et al.
2016/0138530 A1 5/2016 Lee
2016/0186641 A1* 6/2016 Ogino ..... F02F 1/38 123/41.74
2016/0221636 A1 8/2016 Laroche et al.
2016/0230640 A1 8/2016 Kamimura
2016/0341153 A1 11/2016 Huegel
2017/0022876 A1 1/2017 Hoshi et al.
2017/0166043 A1 6/2017 Yun et al.
2017/0175612 A1 6/2017 Tokozakura et al.
2017/0233022 A1 8/2017 Marko
2017/0284275 A1 10/2017 Nam
2017/0298805 A1 10/2017 Kloft et al.
2017/0298861 A1* 10/2017 Koyama ..... F02F 1/40
2018/0065464 A1 3/2018 Palhegyi
2018/0065472 A1 3/2018 Ohno et al.
2018/0156167 A1 6/2018 Yamaguchi et al.
2018/0327038 A1 11/2018 Battaglini et al.
2018/0328258 A1 11/2018 Nugteren

(56) References Cited

U.S. PATENT DOCUMENTS

| | | | |
|---|---|---|---|
| 2018/0328259 | A1 | 11/2018 | Bluhm et al. |
| 2019/0070952 | A1 | 3/2019 | Battaglini et al. |
| 2019/0376422 | A1 | 12/2019 | Bluhm et al. |

FOREIGN PATENT DOCUMENTS

| | | | |
|---|---|---|---|
| CA | 2295464 | A1 | 7/2000 |
| CA | 2374765 | A1 | 12/2000 |
| CA | 2599820 | A1 | 3/2008 |
| CA | 2634400 | A1 | 1/2009 |
| CA | 3005018 | A1 | 11/2018 |
| CN | 1755075 | A | 4/2006 |
| CN | 101852119 | A | 10/2010 |
| CN | 101943048 | A | 1/2011 |
| CN | 102691561 | A | 9/2012 |
| CN | 103122791 | A | 5/2013 |
| CN | 204060930 | U | 12/2014 |
| CN | 104632347 | A | 5/2015 |
| DE | 10047081 | A1 | 5/2002 |
| DE | 102014219252 | A1 | 4/2016 |
| DE | 102014220816 | A1 | 4/2016 |
| EP | 0473931 | A2 | 3/1992 |
| EP | 0707141 | A1 | 4/1996 |
| EP | 1185768 | | 3/2002 |
| EP | 1298288 | A1 | 4/2003 |
| EP | 2071150 | A1 | 6/2009 |
| EP | 2644861 | A2 | 10/2013 |
| FR | 2783278 | A1 | 3/2000 |
| FR | 2800125 | A1 | 4/2001 |
| JP | 3756502 | B2 | 3/2006 |
| JP | 3907903 | B2 | 4/2007 |
| JP | 4145506 | B2 | 9/2008 |
| JP | 2008-291803 | A | 12/2008 |
| JP | 2009-144596 | A | 7/2009 |
| JP | 4444056 | B2 | 3/2010 |
| JP | 4729535 | B2 | 7/2011 |
| JP | 4812636 | B2 | 11/2011 |
| JP | 4858718 | B2 | 1/2012 |
| JP | 4875573 | B2 | 2/2012 |
| JP | 5290029 | B2 | 9/2013 |
| JP | 2013-204524 | A | 10/2013 |
| JP | 5315066 | B2 | 10/2013 |
| JP | 5342306 | B2 | 11/2013 |
| JP | 2014-025438 | A | 2/2014 |
| JP | 2015-086767 | A | 5/2015 |
| JP | 2015-090143 | A | 5/2015 |
| JP | 5841025 | B2 | 1/2016 |
| WO | 00/77352 | A1 | 12/2000 |
| WO | 2015/146832 | A1 | 10/2015 |
| WO | 2018/213216 | A1 | 11/2018 |

OTHER PUBLICATIONS

International Search Report and Written Opinion issued by the International Searching Authority, dated Oct. 11, 2018, for International Patent Application No. PCT/US2018/032628; 17 pages.

Office Action issued by the Canadian Intellectual Property Office, dated Mar. 25, 2019, for Canadian Patent Application No. 3,005,018; 5 pages.

* cited by examiner

ENGINE

RELATED APPLICATIONS

The present application is a continuation of U.S. patent application Ser. No. 15/595,209, filed May 15, 2017, the complete disclosure of which is expressly incorporated by reference herein.

BACKGROUND

The present application relates generally to internal combustion engines, and particularly water cooled engines.

Multiple different engine types are known, for example, multiple fuel types are available, and multiple different sized engines are available, together with different numbers of cylinders. Engines may also be 2 or 4 stroke, and be positioned at multiple different orientations, for example the piston(s) may be oriented vertically, horizontally, or at any other possible orientation. It is also known to cool the engines by either air or water circulation. The subject disclosure is applicable to all types of such engines.

SUMMARY

In a first embodiment of the invention, an engine comprises a crankcase; a head having a cooling water discharge port; a water pump having an input port and a discharge port; and a water manifold coupled to the head and having a first coupling for engine cooling water intake, a second coupling for engine cooling water discharge, and a third coupling coupled to the water pump.

In another embodiment of the invention, an engine comprises a crankcase; a crankshaft supported by the crankcase; a cover which covers a portion of the crankcase; an idler shaft supported between the cover and a portion of the crankcase; and a water pump supported by the crankcase and drivingly coupled to the idler shaft.

In another embodiment of the invention, an engine comprises a crankcase; an oil pump having an oil intake and an oil discharge; and an oil pan coupled to the crankcase, the oil pan including an oil pump mounting portion and an internal passageway through the oil pan and having an intake duct communicating with the oil pump mounting portion and an outlet duct communicating with the crankcase.

In another embodiment of the invention an engine comprises a crankcase; an oil pump having an oil intake and an oil discharge; an oil pan coupled to the crankcase; an oil siphon positioned adjacent to a bottom surface of the oil pan; and an oil cooler to cool oil which circulates through the engine; wherein the oil pump is fluidly coupled to the oil cooler to pump oil through the oil cooler and the oil pump and is fluidly coupled to the oil pump intake to suction oil from the oil pan and pump the oil to the crankcase.

In another embodiment of the invention an engine comprises a crankcase having at least two cylinders; a crankshaft supported by the crankcase; at least two pistons coupled to the crankshaft and reciprocating within the cylinder; a head positioned over a top of the crankcase being provided with separate chambers in which the crankshaft portions for each cylinder operates; an oil pan coupled to the crankcase and positioned over the crankshaft and chambers; and a reed valve coupled over the chambers to allow blow-by gases to enter the oil pan during reciprocation of the pistons.

In another embodiment of the invention an engine comprises a crankcase having at least two cylinders; a crankshaft supported by the crankcase; at least two pistons coupled to the crankshaft and each reciprocating within one of the cylinders; a head positioned over the cylinders; at least two camshafts supported by the head, each camshaft extending along a longitudinal axis; at least four valves supported by the head and having a pair of two valves positioned over each cylinder and operatively connected to the camshafts, each pair of valves extending at a transverse axis relative to the longitudinal axis of the camshafts, and each pair of valves comprising an exhaust valve and an intake valve; a water pump for cooling the engine head; a first water cooling core extending through the head and extending longitudinally through the head on a first side of the exhaust valves; a first set of apertures extending upward through the head and communicating with the first water cooling core, the first set of apertures being positioned proximate each other and proximate a center of the head; a second water cooling core extending through the head and extending longitudinally through the head on a second side of the exhaust valves; a second set of apertures extending upward through the head and communicating with the second water cooling core; and a water discharge port for discharging the water from the first and second water cooling cores.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The foregoing aspects and many of the intended advantages of this invention will become more readily appreciated as the same becomes better understood by reference to the following detailed description when taken in conjunction with the accompanying drawings.

The invention will now be described in relation to the drawing figures where.

DETAILED DESCRIPTION OF THE EMBODIMENTS

Figure 1:
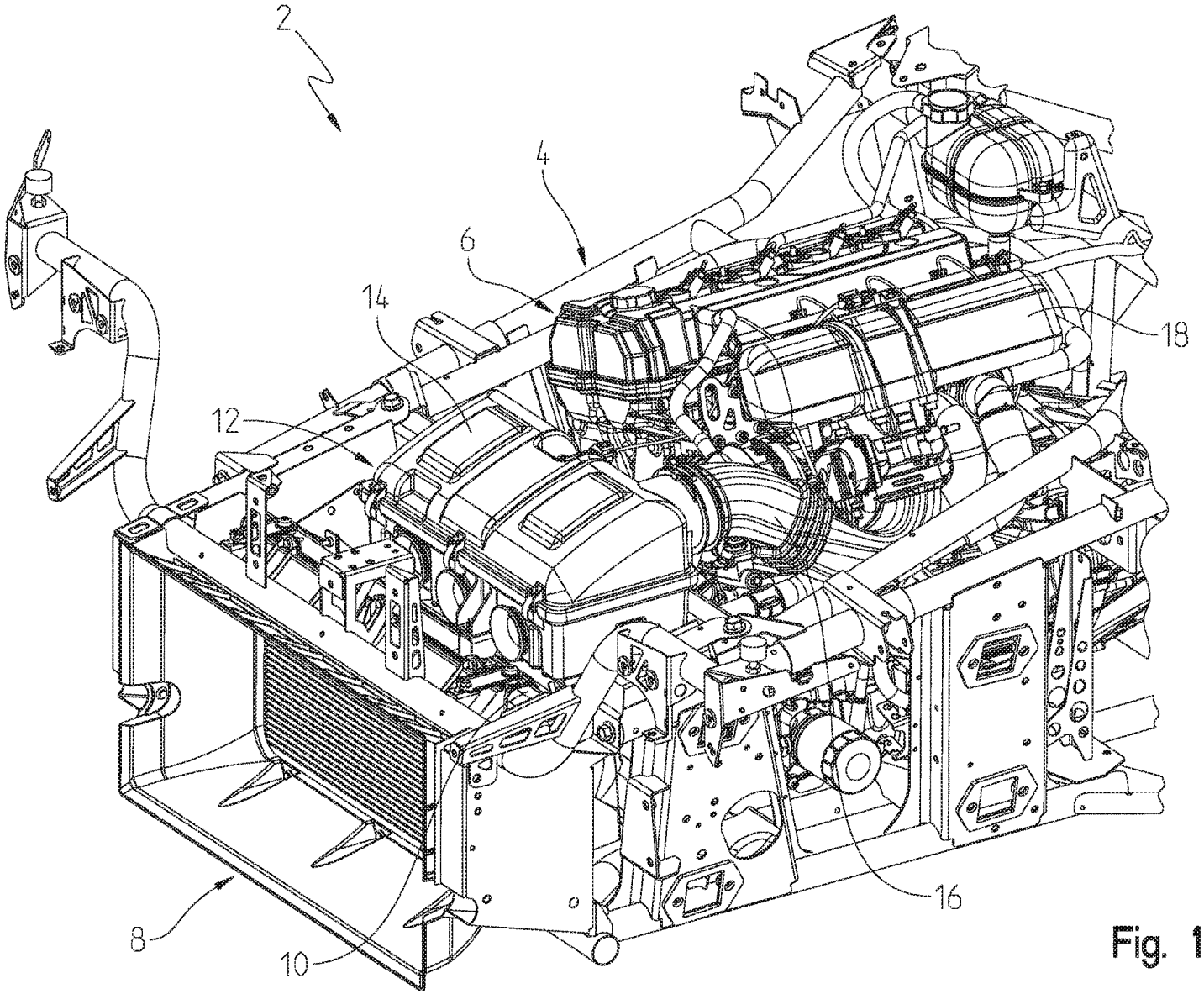
FIG. 1 is a left perspective view of a vehicle engine coupled to a frame and having an engine cooling system.
Figure 2:
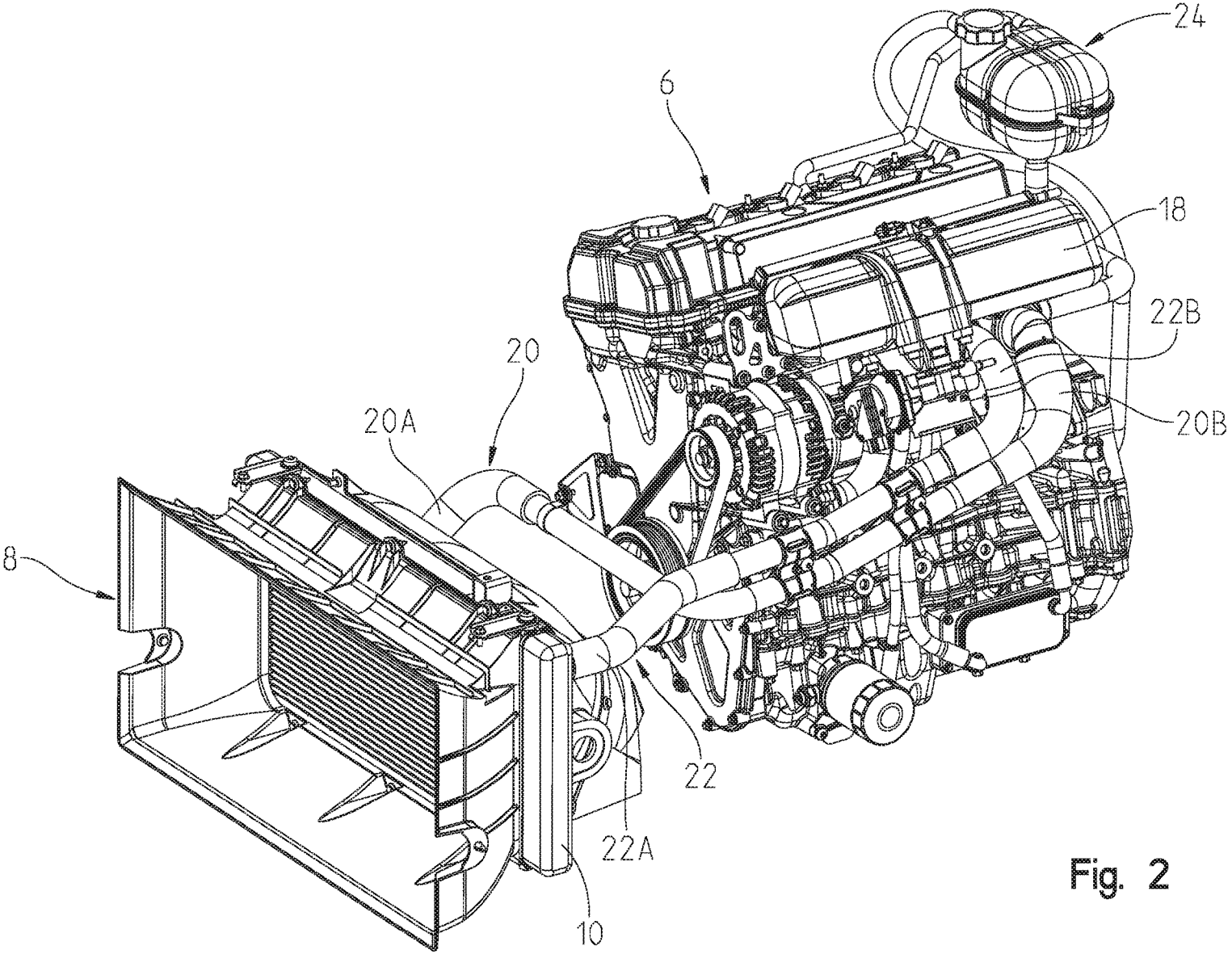
FIG. 2 is a view similar to that of FIG. 1 with the frame removed.
Figure 3:
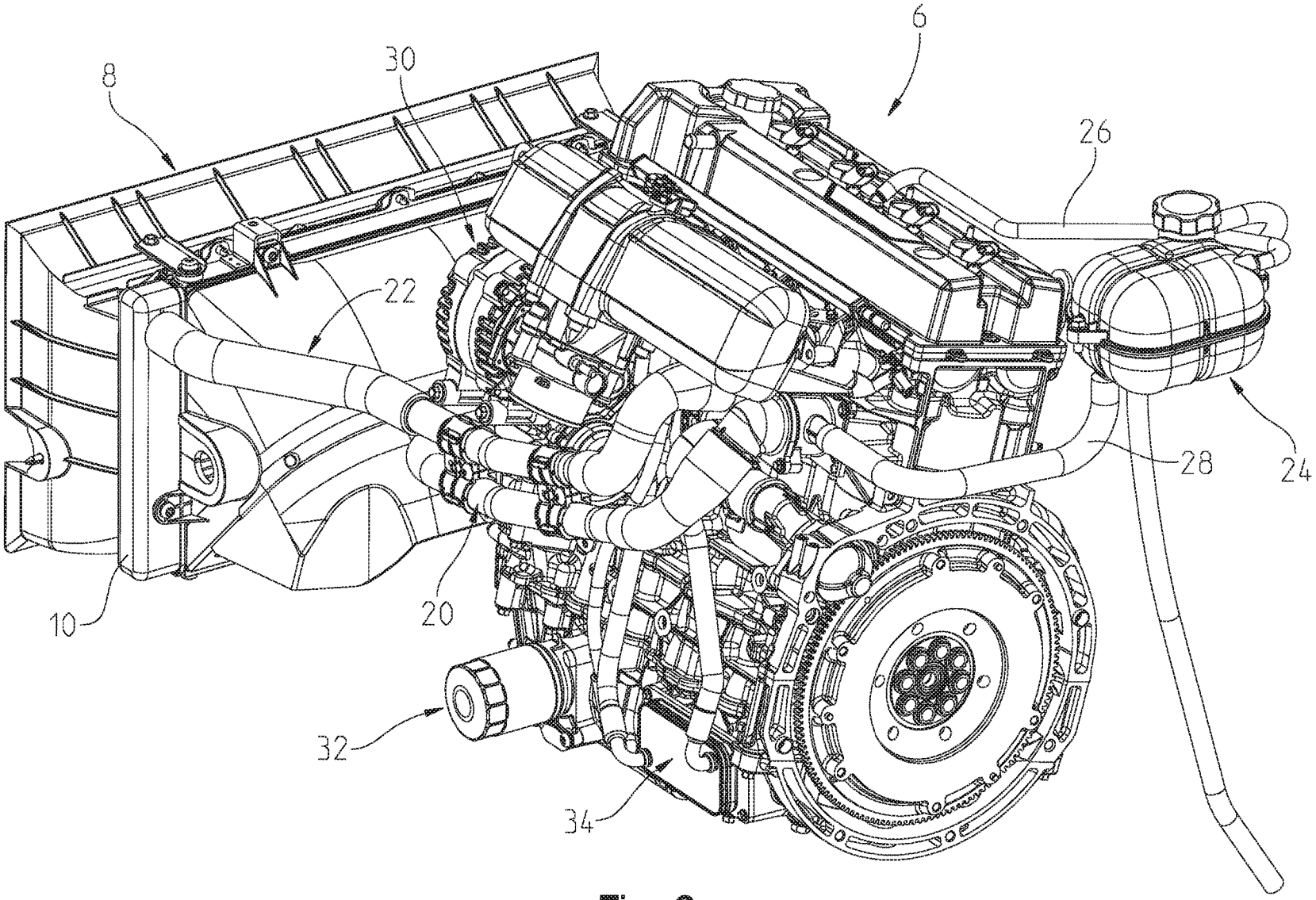
FIG. 3 is a rear left perspective view of the engine and cooling system of FIG. 2.

With reference first to FIGS. 1-3, a vehicle powertrain will be described in greater detail. With reference first to FIG. 1, the vehicle 2 includes a frame 4 and an engine 6. Vehicle 2 includes an air scoop at 8 which is positioned forward of a radiator 10. An air intake system 12 includes an air box 14, air duct 16 and an air intake manifold 18. In the embodiment shown, vehicle 2 is of the vehicle type shown in U.S. Pat. No. 8,695,746, the subject matter of which is incorporated herein by reference. The vehicle shown in FIGS. 1-3 is better shown in U.S. patent application Ser. No. 15/595,628, filed May 15, 2017, filed concurrently with the present application; the subject matter of which is incorporated herein by reference.

With reference now to FIGS. 2 and 3, a water cooling supply line is shown at 20 which is coupled to the radiator at a first end 20A and which couples to the engine at a second end 20B. A return line is also shown at 22 coupled to the radiator at 22A and coupled to the engine at 22B. A coolant surge bottle is provided at 24 which is coupled to the engine by a vent tube 26 and by a supply hose at 28. As best shown in FIG. 3, engine 6 further includes an alternator 30, an oil filtration system 32 and an oil cooling system 34.

Figure 4:
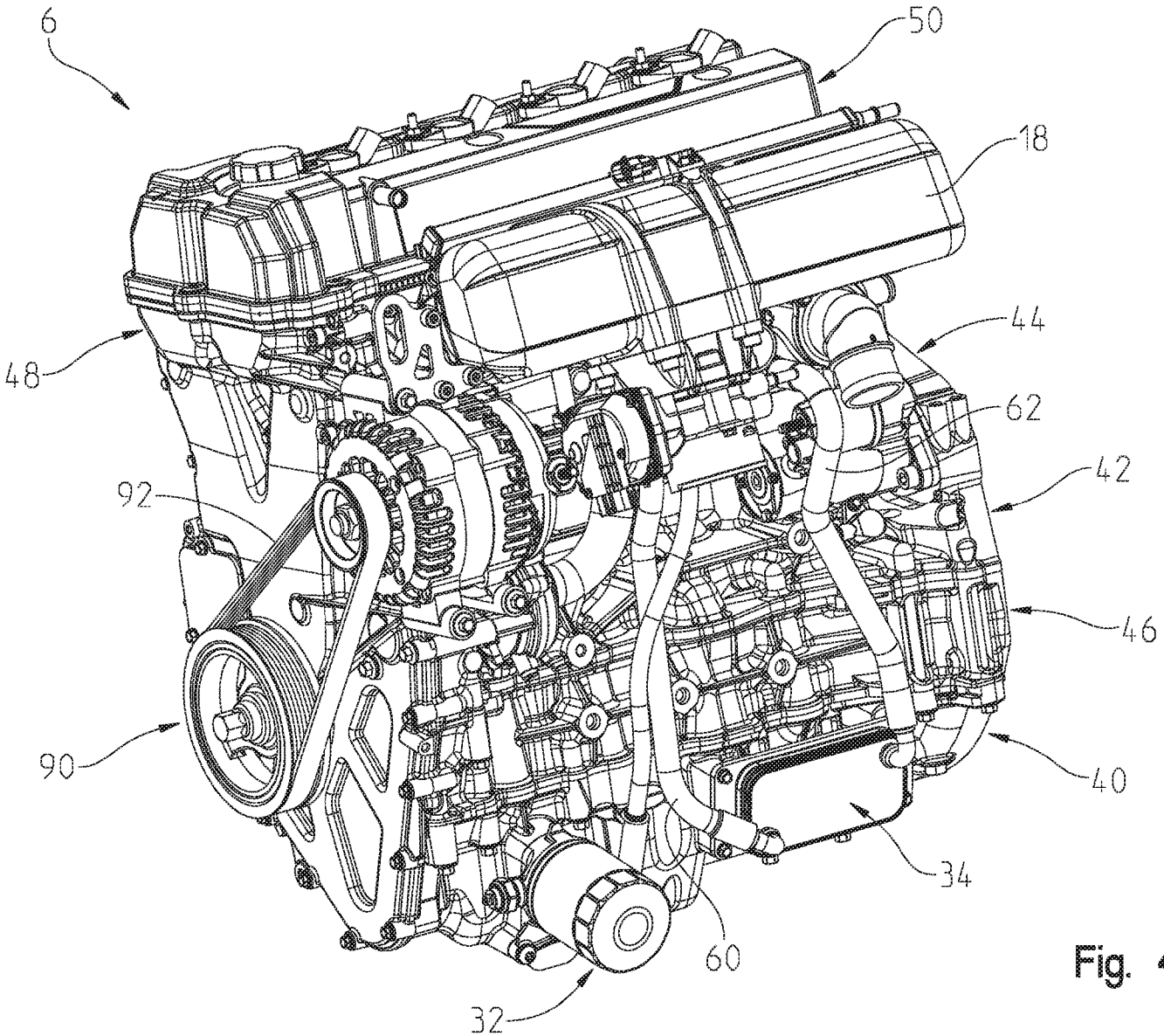
FIG. 4 is a front left perspective view of the engine.
Figure 5:
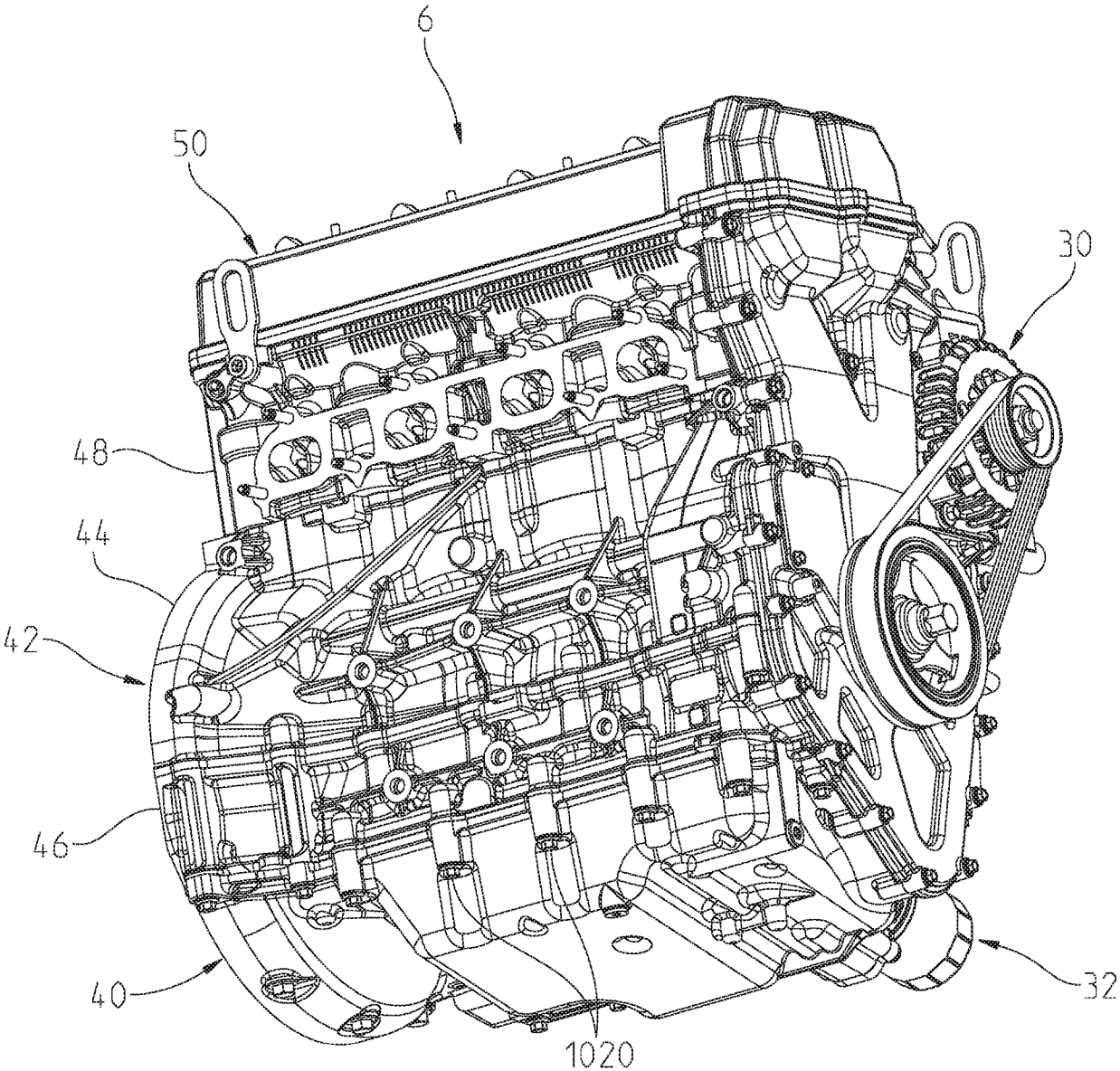
FIG. 5 is a front right perspective view of the engine.
Figure 6:
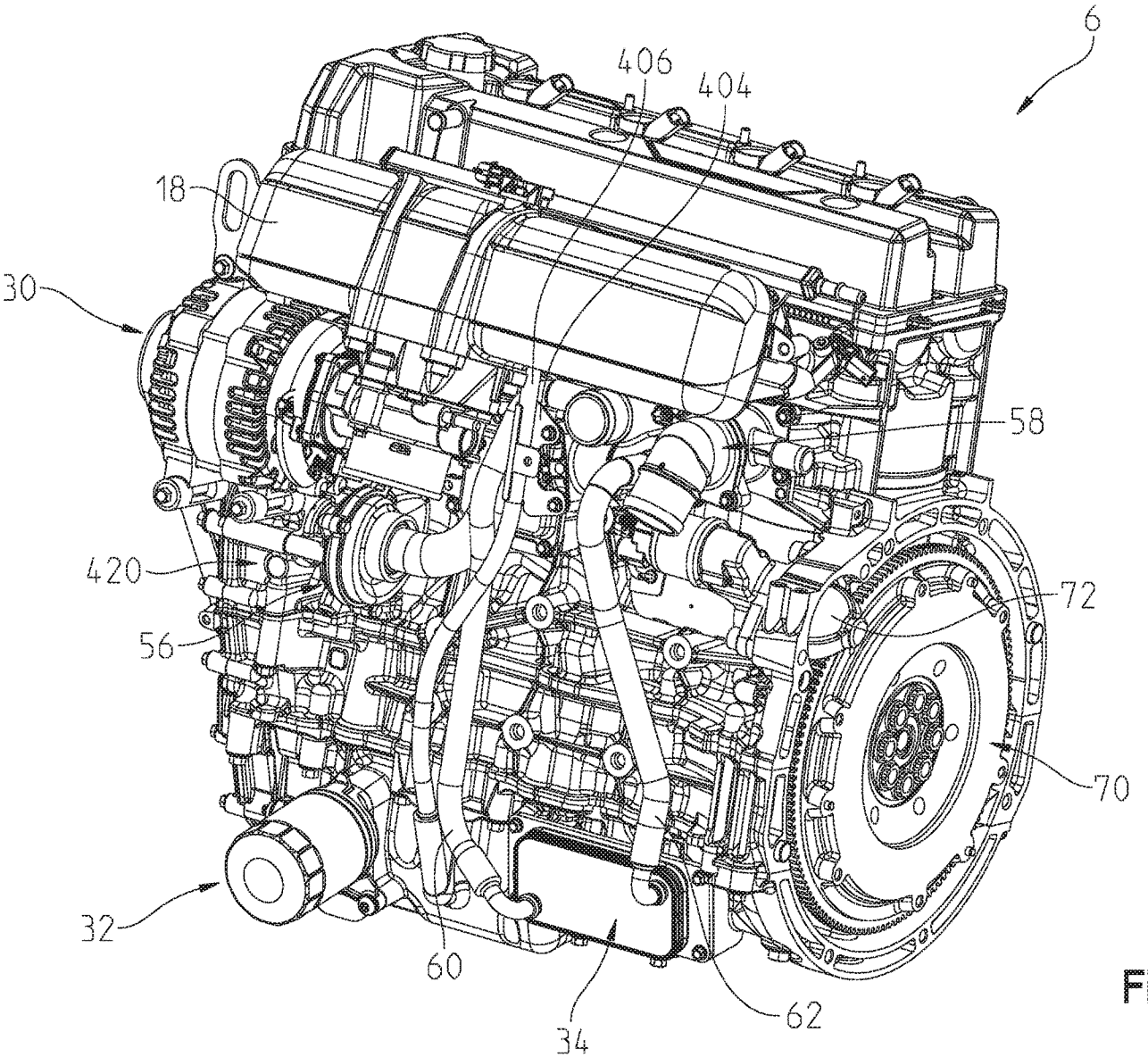
FIG. 6 is a left rear perspective view of the engine.

With reference now to FIGS. 4-7, engine 6 is comprised of oil pan or sump 40, crankcase 42 which is comprised of upper crankcase portion or block 44 and bed plate 46, head 48 and valve cover 50, as best shown in FIG. 5. As best shown in FIG. 6, engine 6 further includes a water pump at 56 which is coupled to a water manifold 58 as further described herein. Oil cooling system 34 includes a supply hose at 60 and a return hose at 62, where each of the hoses 60, 62 couple to the water manifold 58.

Figure 7:
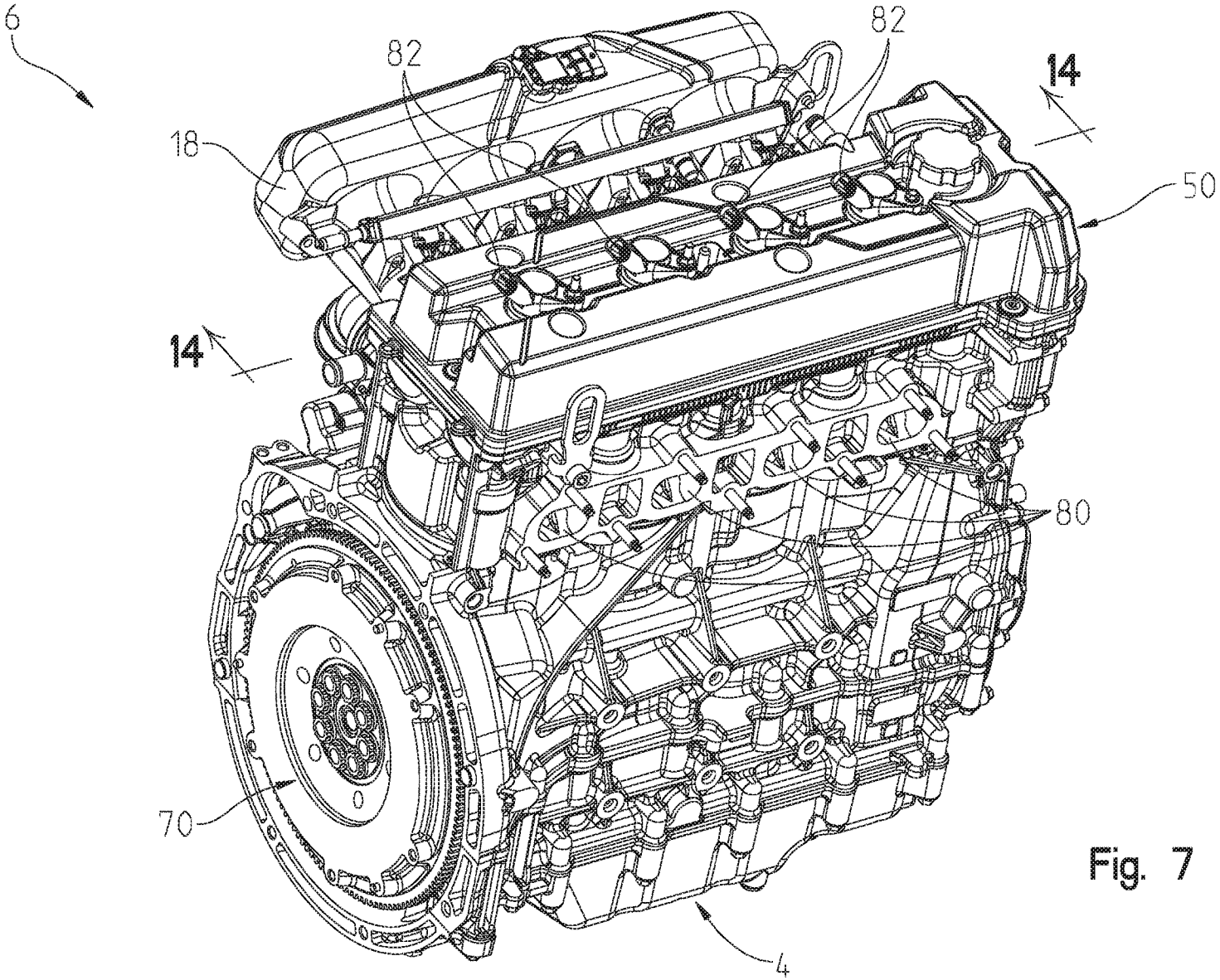
FIG. 7 is a right rear perspective view of the engine.
Figure 8:
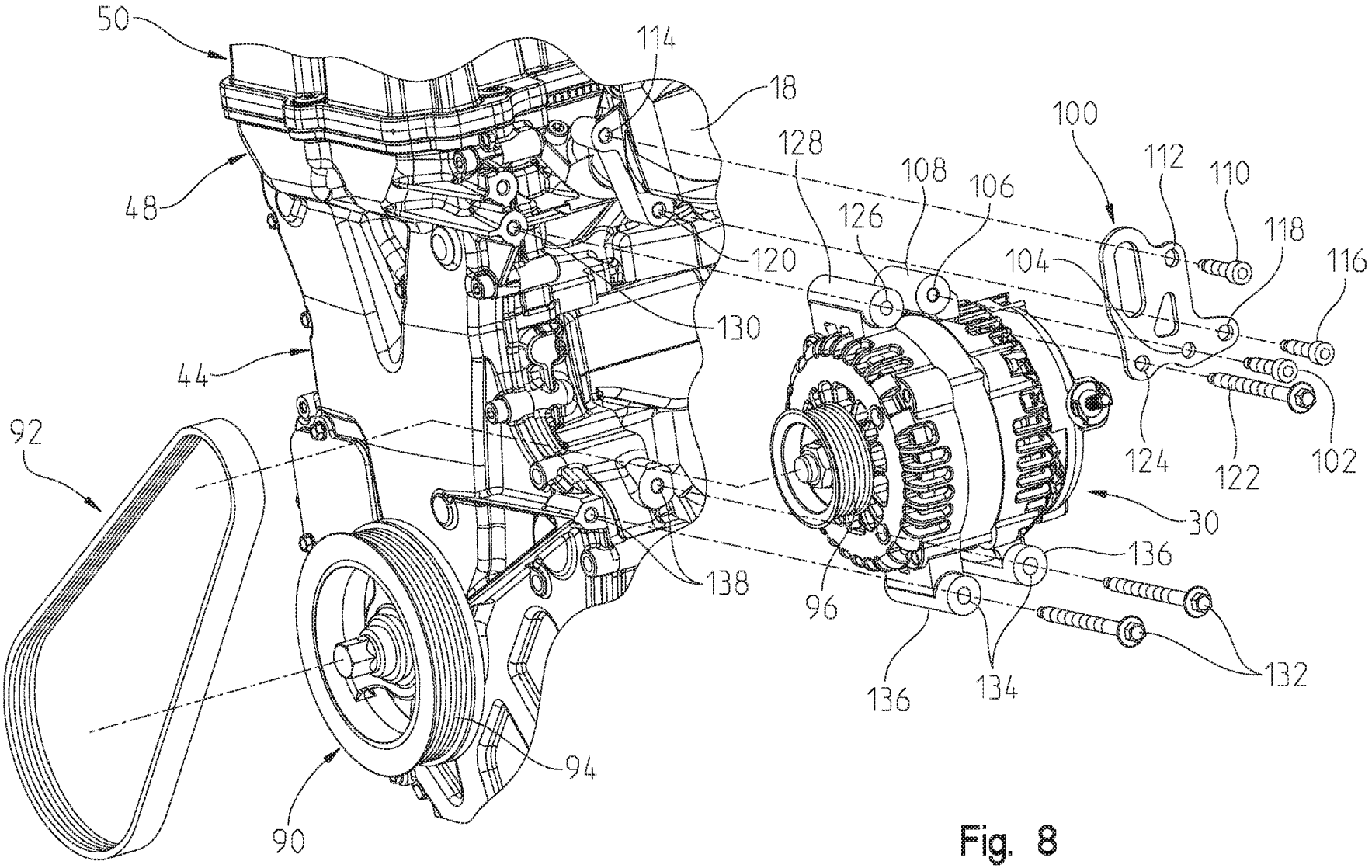
FIG. 8 is an exploded view showing the alternator removed from the engine.

With reference still to FIG. 6, engine 6, further includes a flywheel at 70 which is coupled to a starter motor 72. With reference to FIG. 7, engine 6 is illustrated as an inline-four cylinder engine having four exhaust ports at 80 and four spark plug connectors 82. With reference now to FIG. 8, alternator 30 will be described in greater detail.

With reference now to FIGS. 4 and 8, alternator 30 is driven by a harmonic damper 90 which is coupled by a stretch belt 92. Stretch belt 92 entrains pulley 94 of harmonic damper 90 and pulley 96 of alternator 30. As described below, alternator 30 is coupled to crankcase 42, head 48 and intake manifold 18. As shown in FIG. 8, a bracket 100 is coupled to alternator 30 by way of fastener 102 extending through aperture 104 and engaging threaded aperture 106 of boss 108. This couples the bracket 100 to alternator 30. A combination of the alternator and bracket are then coupled to the engine by way of fastener 110 extending through aperture 112 and coupling with threaded aperture 114 on intake manifold 18. In a like manner, fastener 116 is received through aperture 118 and received in threaded aperture 120. Fastener 122 is received through aperture 124, through aperture 126 of boss 128 and then received into threaded aperture 130 on head 48. Finally, fasteners 132 are received through apertures 134 of bosses 136 and into threaded engagement with threaded apertures 138.

Figure 9:
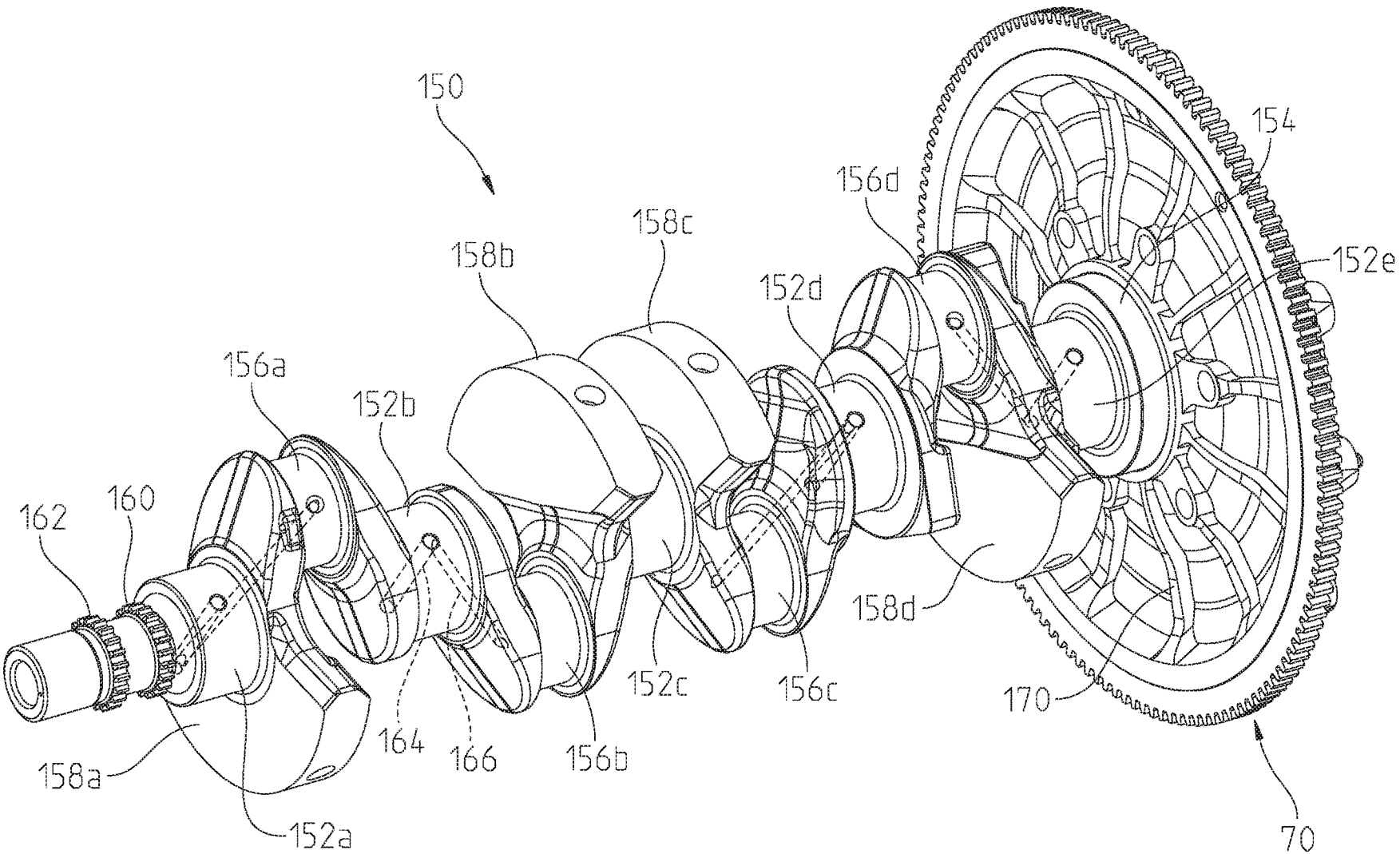
FIG. 9 shows a front left perspective view of the crankshaft and flywheel of the engine.

With reference now to FIG. 9, the crankshaft of engine 6 is shown at 150 coupled at a rear end to flywheel 70. Crankshaft 150 includes main bearing portions 152A, 152B, 152C, 152D, and 152E. A hub portion 154 is rearward of main bearing portion 152E and couples to the flywheel 70. Crankshaft 150 further includes connecting rod portions 156A, 156B, 156C, and 156D. It should be noted that the crankshaft is configured with positions 156A and 156D at a top dead center (TDC) position while the positions 156B and 156C are at a bottom dead center (BDC) position.

In a like manner, crankshaft 150 has counterweights 158 such that a single counterweight is positioned in an opposing sequence to the connecting rod position. In other words, counterweight 158A is positioned in an opposite sequence as connecting rod position 156A; counterweight 158B is positioned in an opposite sequence as connecting rod position 1566; counterweight 158C is positioned counter to connecting rod position 156C and counterweight 158D is positioned counter to connecting rod position 156D. It should be appreciated from FIG. 9, that crankshaft 150 has just a single counterweight for each connecting rod position whereas most crankshafts have two counterweights for every single connecting rod position. Thus, this crankshaft is specifically designed to minimize its rotational inertia and therefore only has a single counterweight 158 for each connecting rod position 156.

Furthermore, the crankshaft 150 is a forging yet includes machined in drive gears, namely inner gear 160 and outer gear 162. Crankshaft 150 is also internally drilled, for example, at 164 to provide oil passage to the main bearing position 152B and drilling 166 providing an oil passage to connecting rod position 156B.

Flywheel 70 is also a low inertia flywheel, produced from a cast iron material and somewhat dish-shaped, with the concavity facing the crankshaft as shown in FIG. 9. Flywheel 70 however includes a plurality of ribs at 170 to rigidify the flywheel while keeping the inertia low. The reduced inertia of the crankshaft and flywheel combination has at least two advantages; namely, the engine has a high operational speed and the engine has high acceleration. That is, the engine as disclosed redlines at 8500 rpm whereas engines of a similar size would redline at 6500 rpm.

Figure 10:
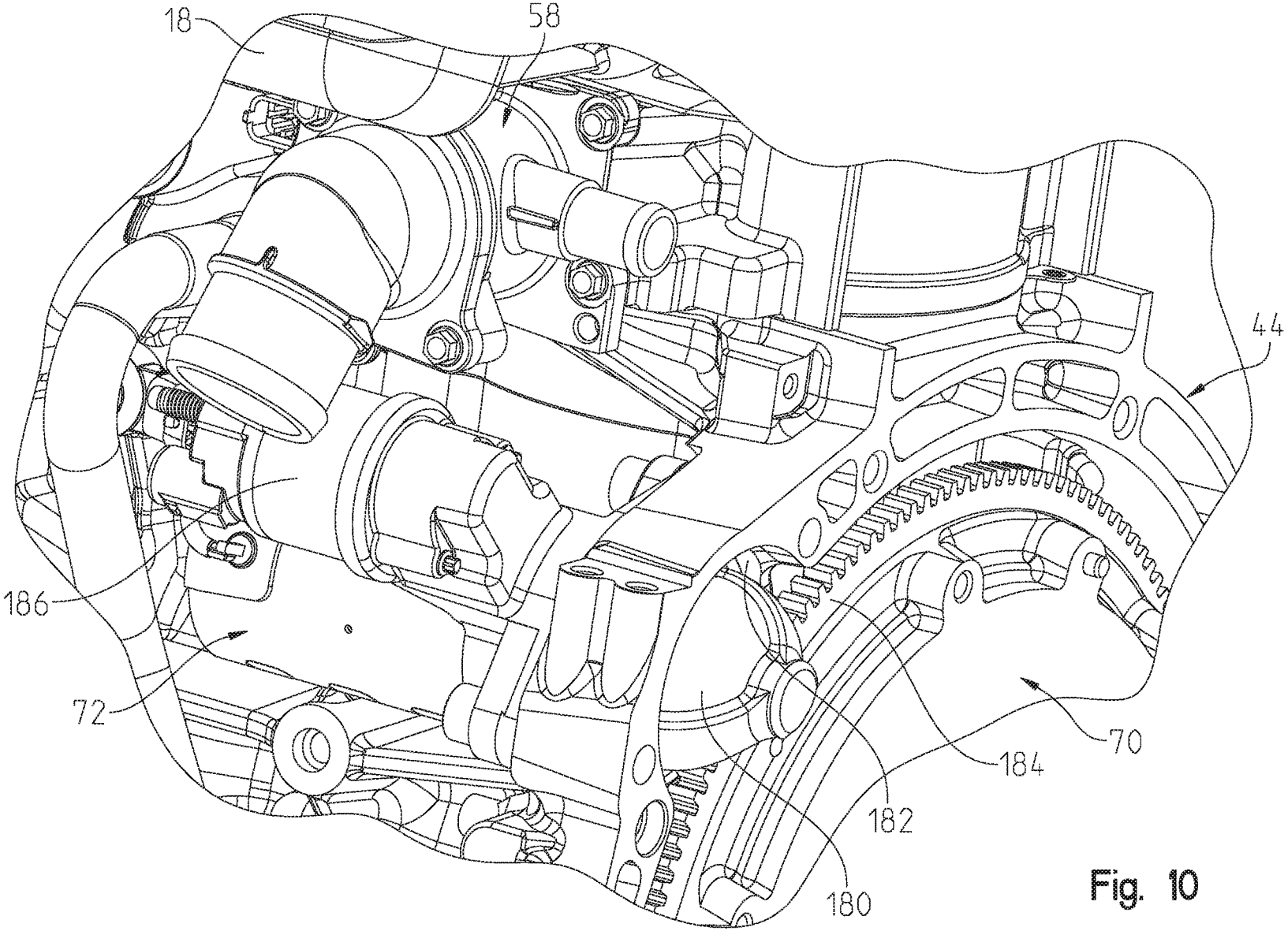
FIG. 10 shows a left rear view in partial fragmentation showing the starting motor location.
Figure 11:
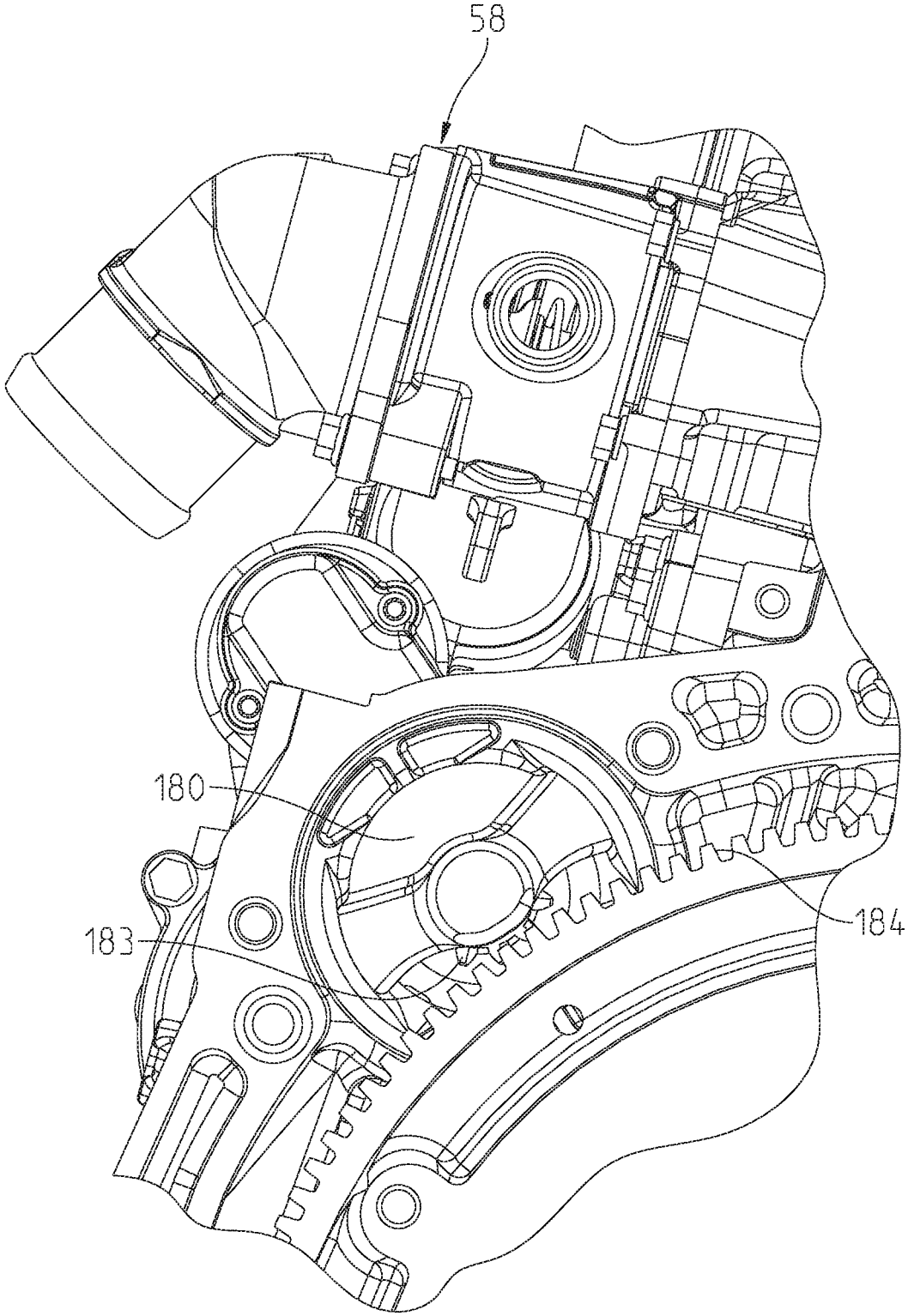
FIG. 11 is an end view showing the starter motor of FIG. 10.

With reference now to FIGS. 10 and 11, the location of the starter motor 72 will be described. As shown, a nose 180 of the starter 72 is positioned through an arcuate opening 182 of the crankcase 42 to position a drive pinion 183 (FIG. 11) of the starter motor 180 adjacent to gear 184 of flywheel 70. Starter motor 72 is positioned high in the engine with the solenoid 186 positioned beneath the intake manifold 18 and the water manifold 58. Thus, in some off road applications of the engine, the starter is kept high and out of any water.

Figure 12:
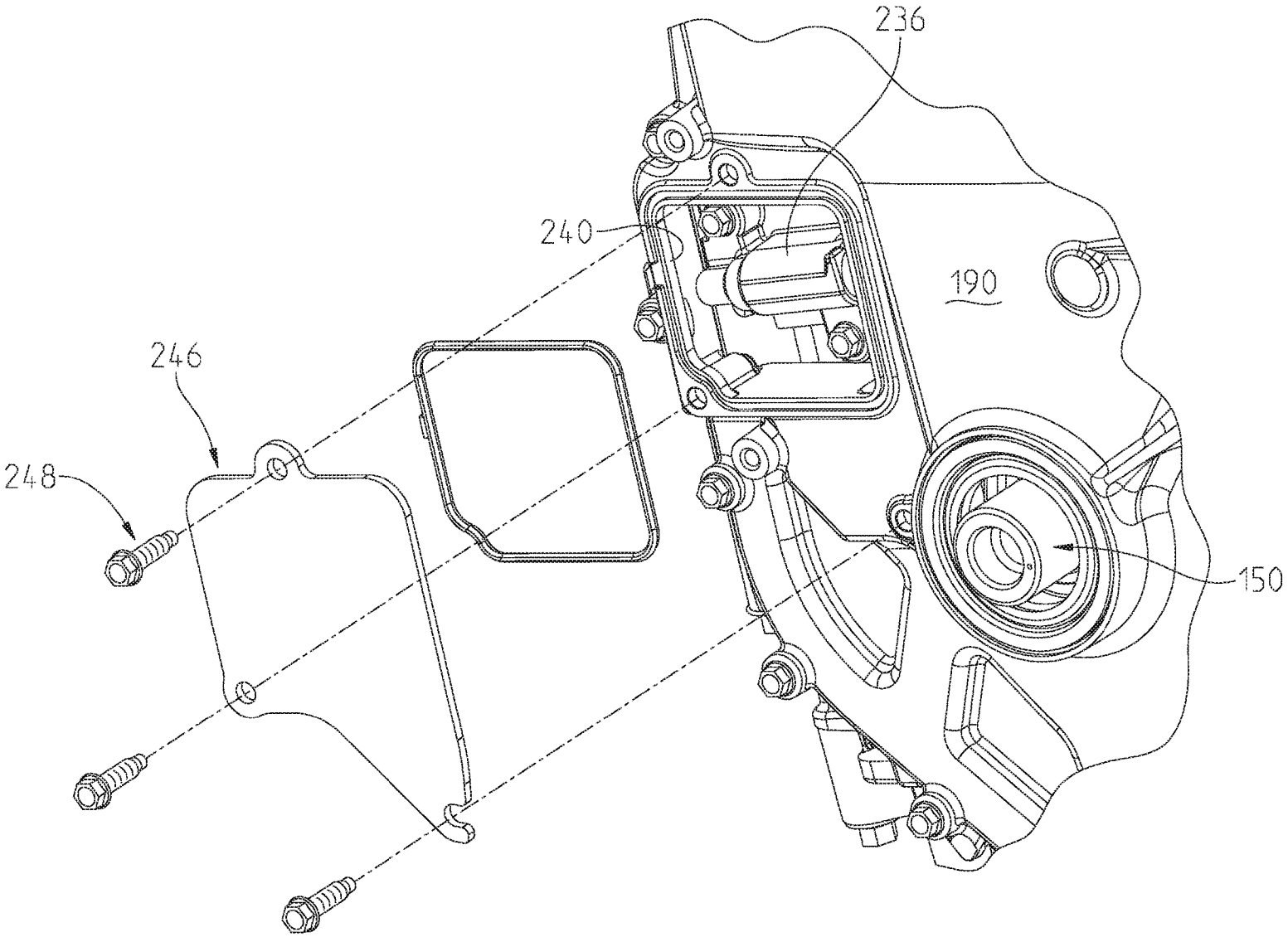
FIG. 12 shows an access panel providing access to the chain tightener for the valve chain.
Figure 13:
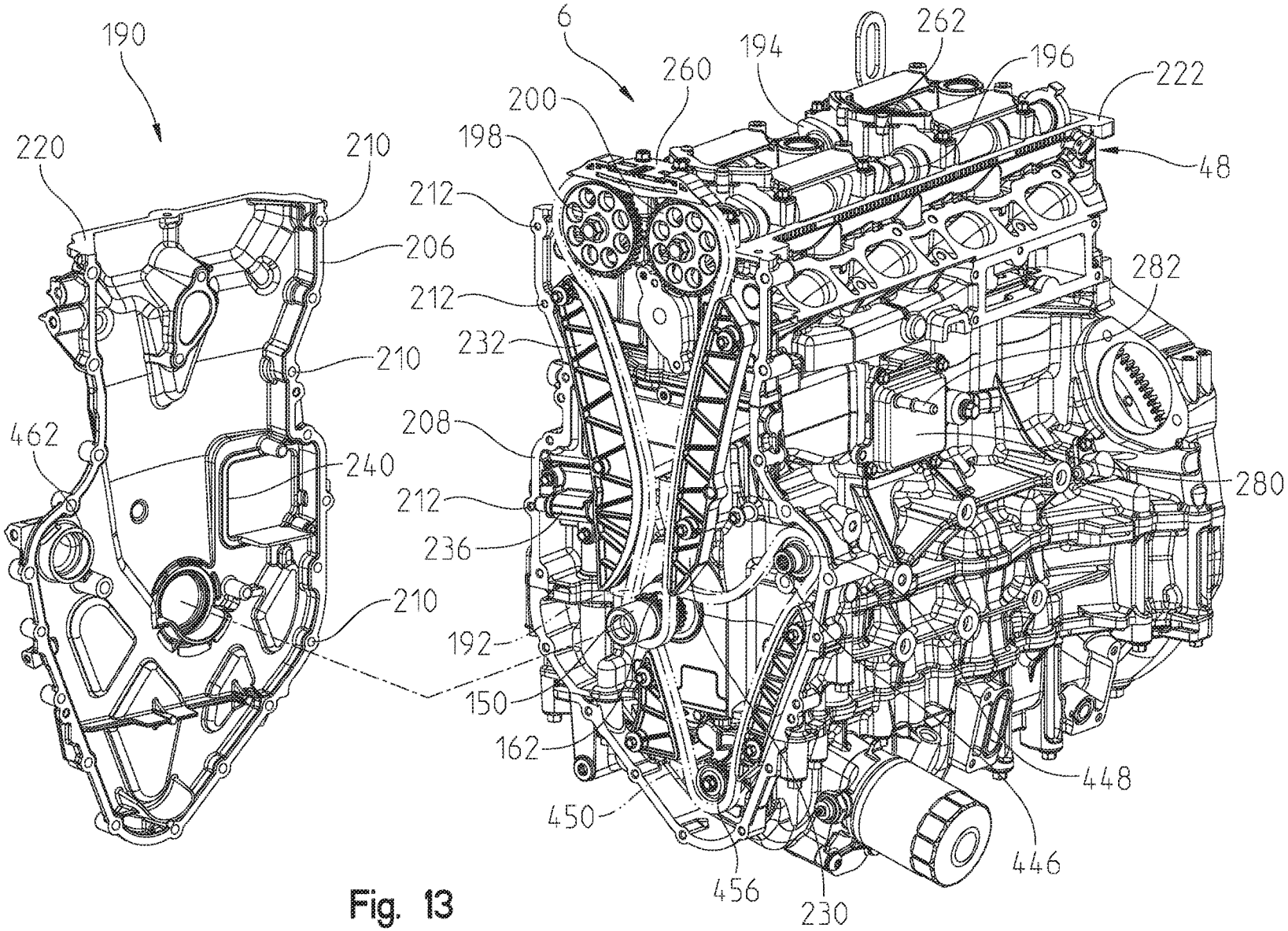
FIG. 13 shows a front left perspective view of the engine showing the front cover exploded away from the remainder of the engine.
Figure 16:
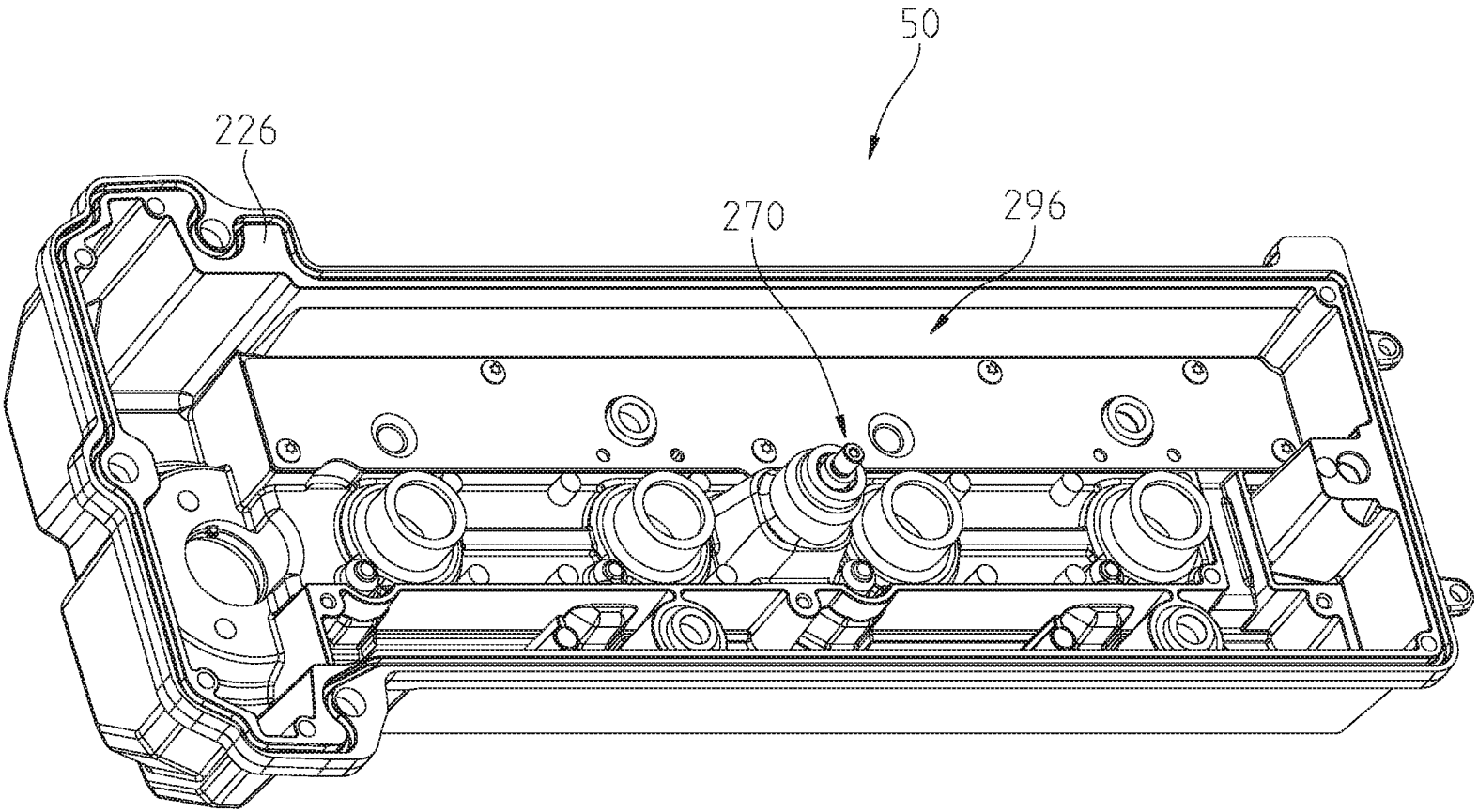
FIG. 16 is an underside perspective view of the valve cover.

With reference now to FIGS. 12 and 13, engine 6 is shown with a front cover or timing chain cover 190 which couples to the engine 6 and which covers timing chain 192. As shown, timing chain 192 is driven by gear 162 of crankshaft 150, which in turn drives exhaust camshaft 194 and intake cam shaft 196 through gears 198 and 200, respectively. As shown best in FIG. 13, front cover or timing chain cover 190 includes a marginal edge 206 which matches a marginal edge 208 of engine 6 and includes a plurality of apertures 210 which match corresponding apertures 212 on engine 6. Cover 190 further includes a top surface 220 which matches a top surface 222 of head 48. Valve cover 50, as best shown in FIG. 16, includes a peripheral surface 226 which matches the combined surfaces 220 and 222 of cover 190 and head 48. With respect still to FIG. 13, engine 6 includes chain tensioning guides 230 and 232 where guide 230 is fixed and guide 232 is movable into and out of the chain 192 by way of chain tensioner 236. Cover 190 includes a window 240 providing access through the cover to the chain tensioner 236. With reference to FIG. 12, window 240 is covered by way of access panel 246 which is coupled to the cover 190 by way of fasteners 248. Thus by removing the panel 246 to access chain tensioner 236, the chain tensioner 236 may be removed and or replaced without removing the cover 190, as described below.

Figure 30:
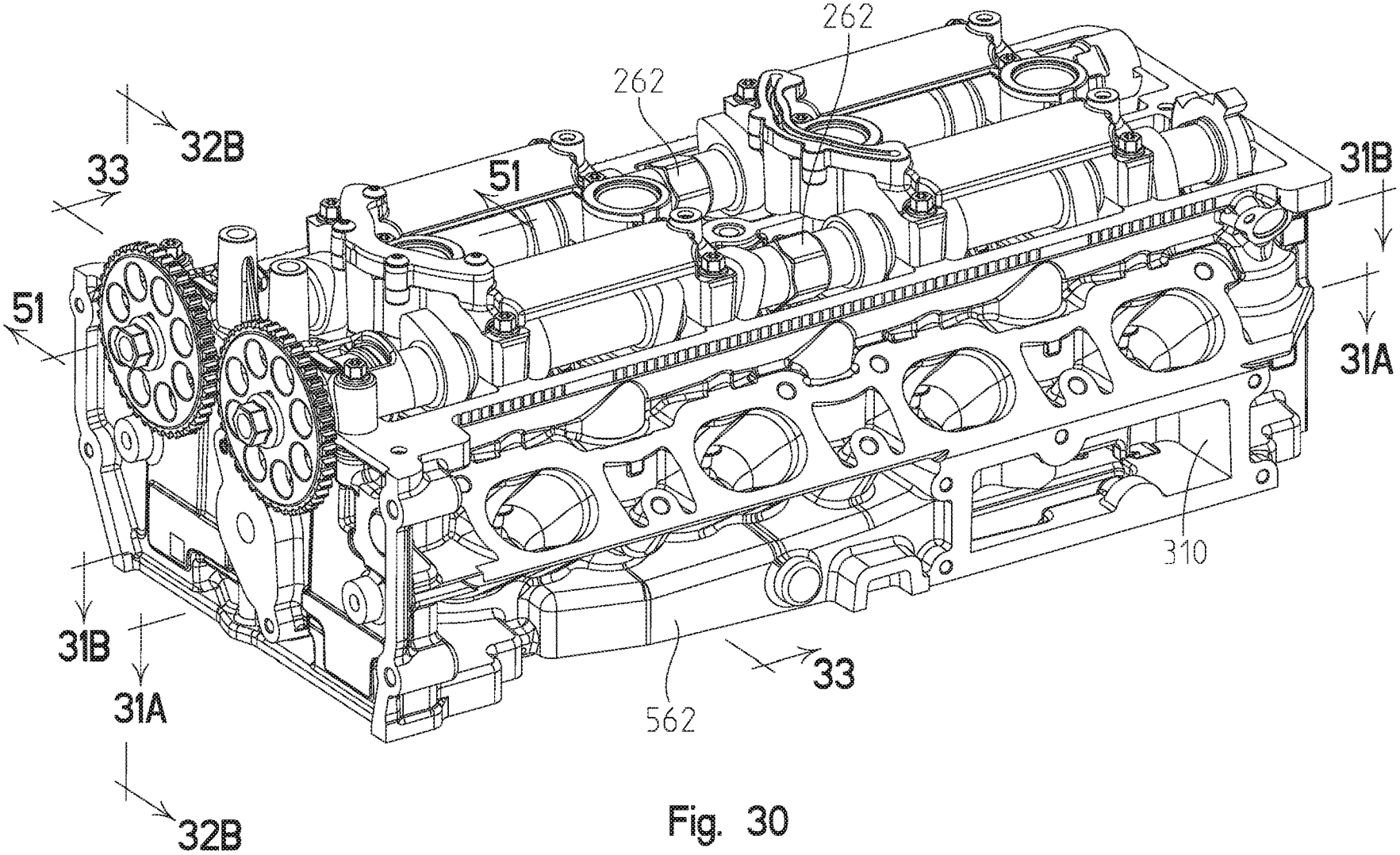
FIG. 30 is a front left perspective view of the engine head of the present disclosure.

In the event the engine requires maintenance to the valve train components, the chain tensioner can be removed, whereby the panel 246 is removed to access the chain tensioner 236. Disengaging the chain tensioner 236 causes a relaxation of the chain 192 due to the movement of the chain tensioning guide 232. Due to the fact that the cover 190 doesn't overlap a top of the timing chain 192, the gears 198 and 200, and the chain 192 is accessible by removing only the valve cover 50. Once the valve cover is removed, upper chain guide 260 is removed and the cams 194, 196 may be removed. As shown in FIGS. 13 and 30, cams also include hexagonal portions 262 allowing manual rotation by way of a wrench.

Figure 14:
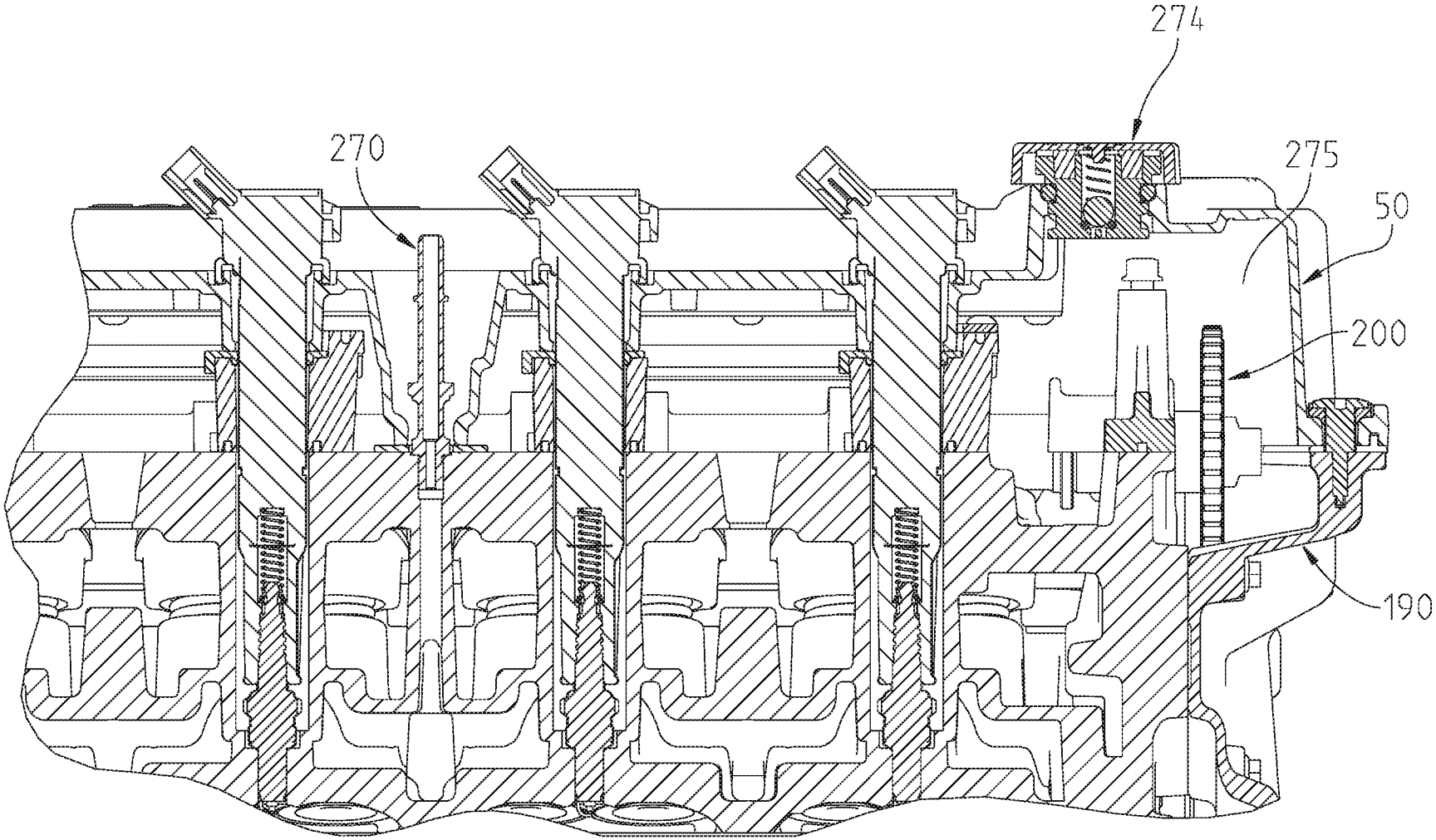
FIG. 14 is a cross-sectional view through lines 14-14 of FIG. 7.
Figure 15:
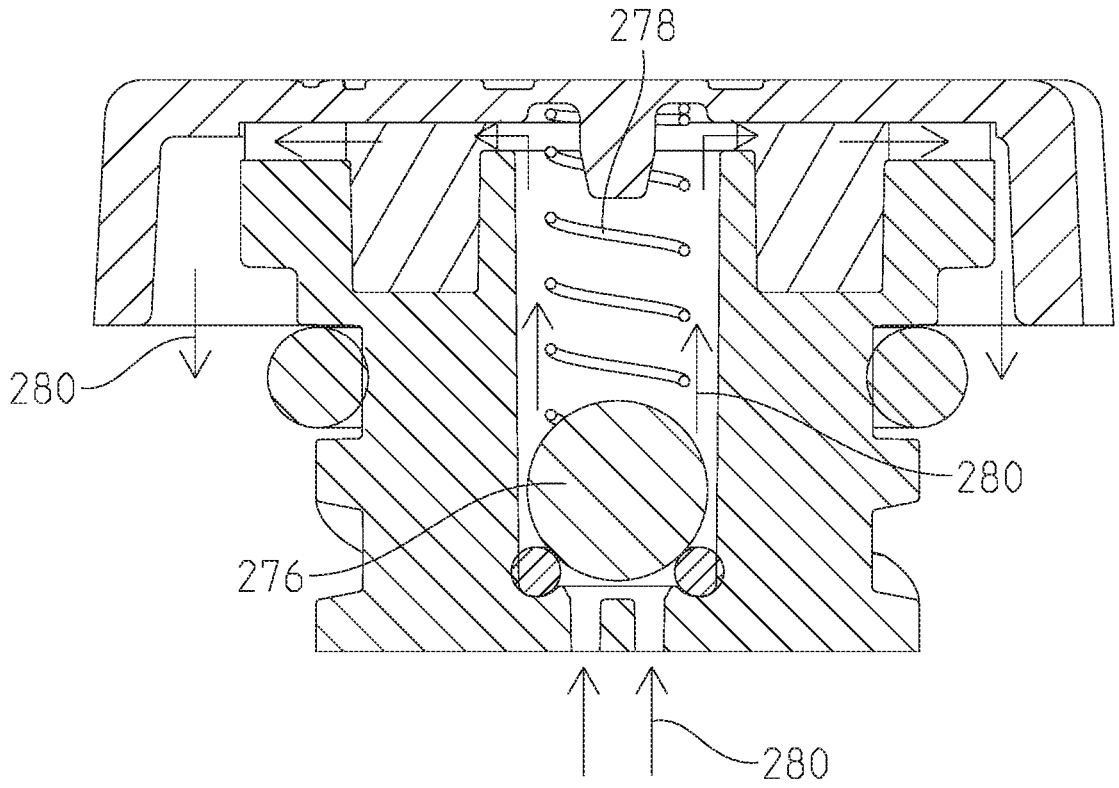
FIG. 15 is an enlarged view of the oiler filler cap and internal pressure relief valve of FIG. 14.
Figure 17:
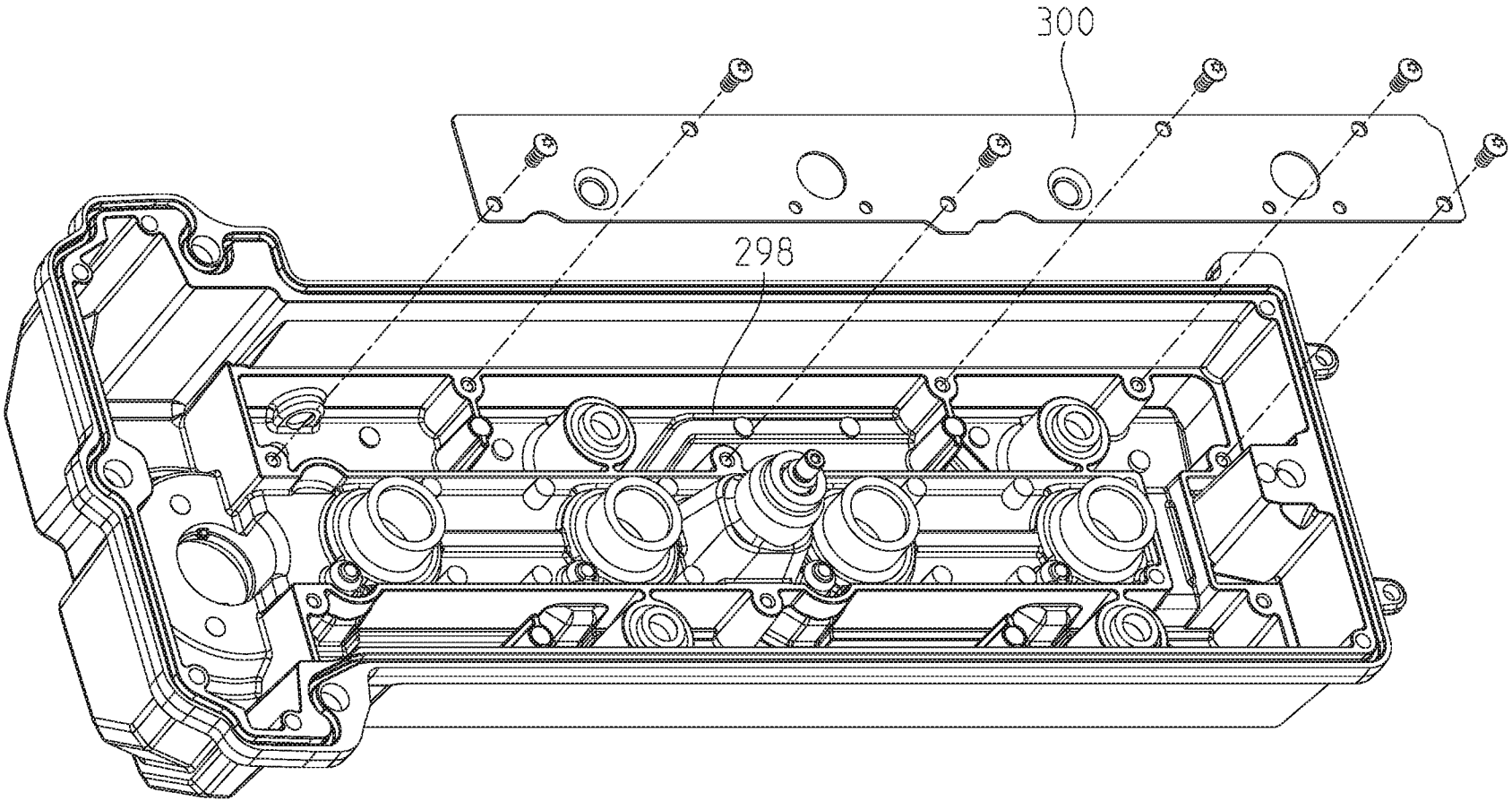
FIG. 17 is a view similar to that of FIG. 16 showing the baffle plate removed.

Engine 6 is also provided with a plurality of gas vents. First, with reference to FIG. 14, an air vent 270 is shown which couples to a high point in the cooling system and is coupled to the reservoir bottle 24 (FIG. 3) by way of hose 26. As also shown in FIG. 14, oil fill cap 274 includes a pressure relief spring loaded ball 276 which releases pressure by way of a spring load at 278 in the direction of arrows 280. As shown in FIG. 13, a PCV cover 280 is provided, providing a vent 282. PCV cover 280 covers an opening 286 (FIG. 25) which communicates with the oil sump 40 (FIG. 4) to release blow-by gases. Finally with reference to FIGS. 16 and 17, a fresh air breather is shown at 296 having flow director ribs 298 and a baffle plate at 300.

Figure 18:
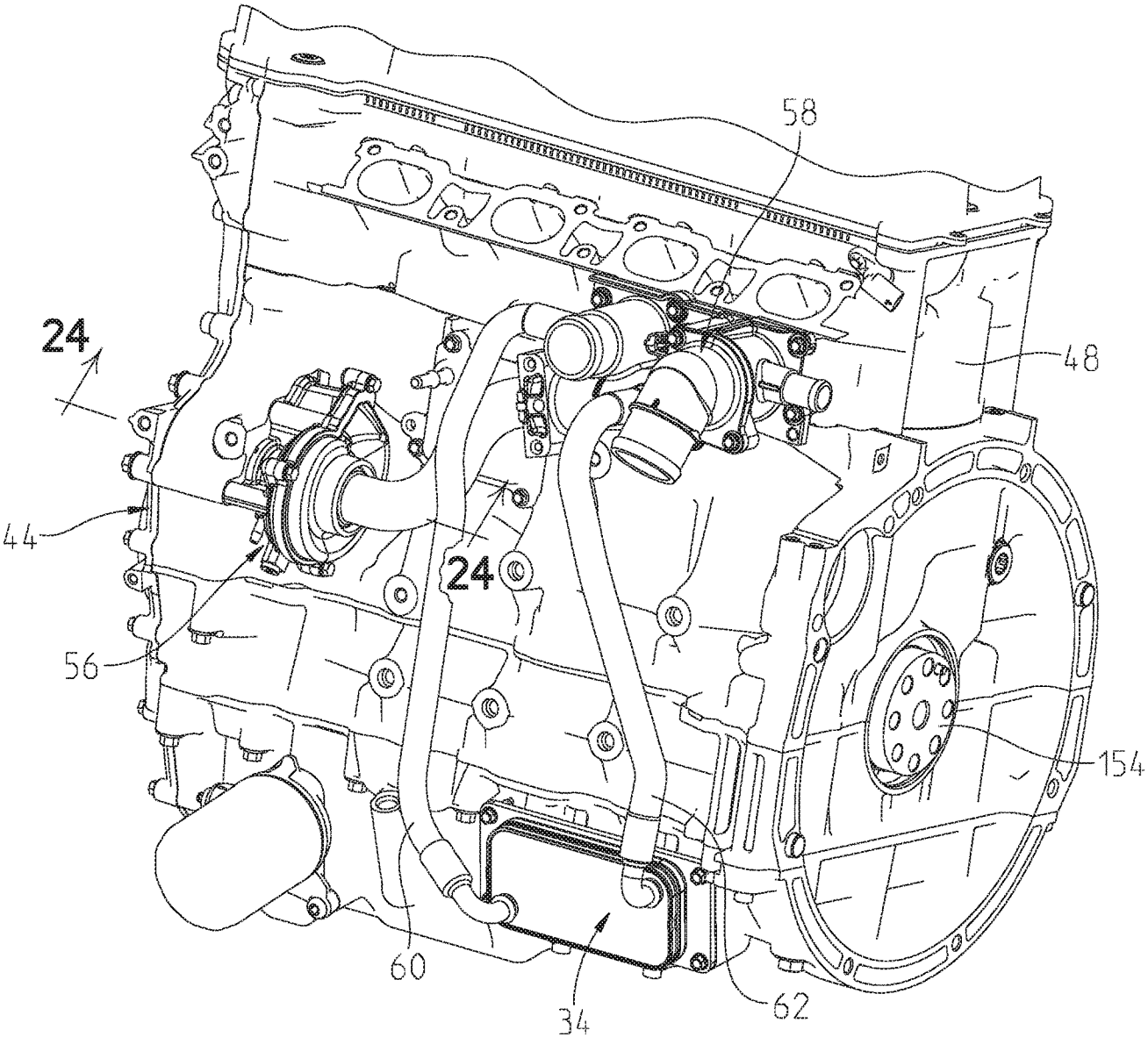
FIG. 18 is a rear left perspective view of the engine showing the engine and oil cooling system of the present disclosure.
Figure 19:
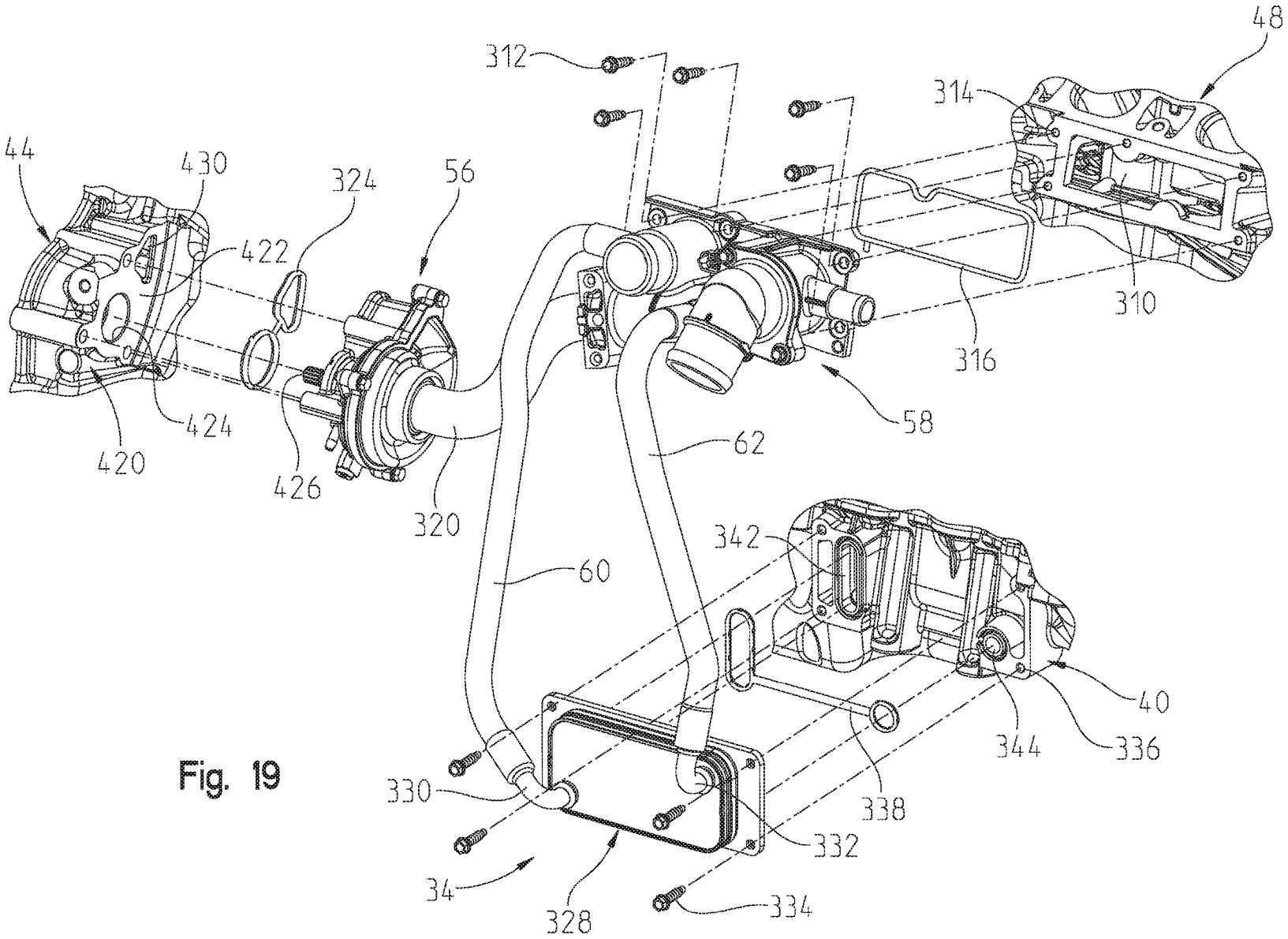
FIG. 19 shows a left rear perspective view of the cooling system of FIG. 18 exploded away from the engine.

With reference now to FIGS. 18-23, a general description of the water flow through the head 48, the radiator 10 (FIG. 2) and through oil cooling system 34 will be described in greater detail. As shown in FIGS. 18-19, water manifold 58 couples to the head 48 and over a water discharge opening 310 and is coupled by fasteners 312 into threaded openings 314. A gasket 316 is positioned between the water manifold 58 and head 48 to seal the connection thereto. Water pump 56 is fluidly coupled to water manifold 58 by way of a metal tube 320 and water pump 56 is mechanically coupled to the crankcase 42. A seal 324 is positioned between the water pump 56 and the crankcase 42 to seal the connection therewith. The oil cooling system 34 also includes an oil cooler 328 having a fitting 330 coupled to hose 60 and a fitting 332 coupled to hose 62. Oil cooler 328 is coupled to the oil pan 40 by way of fasteners 334 which couple to threaded apertures 336. A seal 338 is positioned between the oil cooler 328 and the oil pan 40 to seal the connection therewith. Although described in greater detail herein, the general flow of the oil is that the oil is pumped into oval opening 342 and out of opening 344 and through the oil cooler 328.

Figure 20:
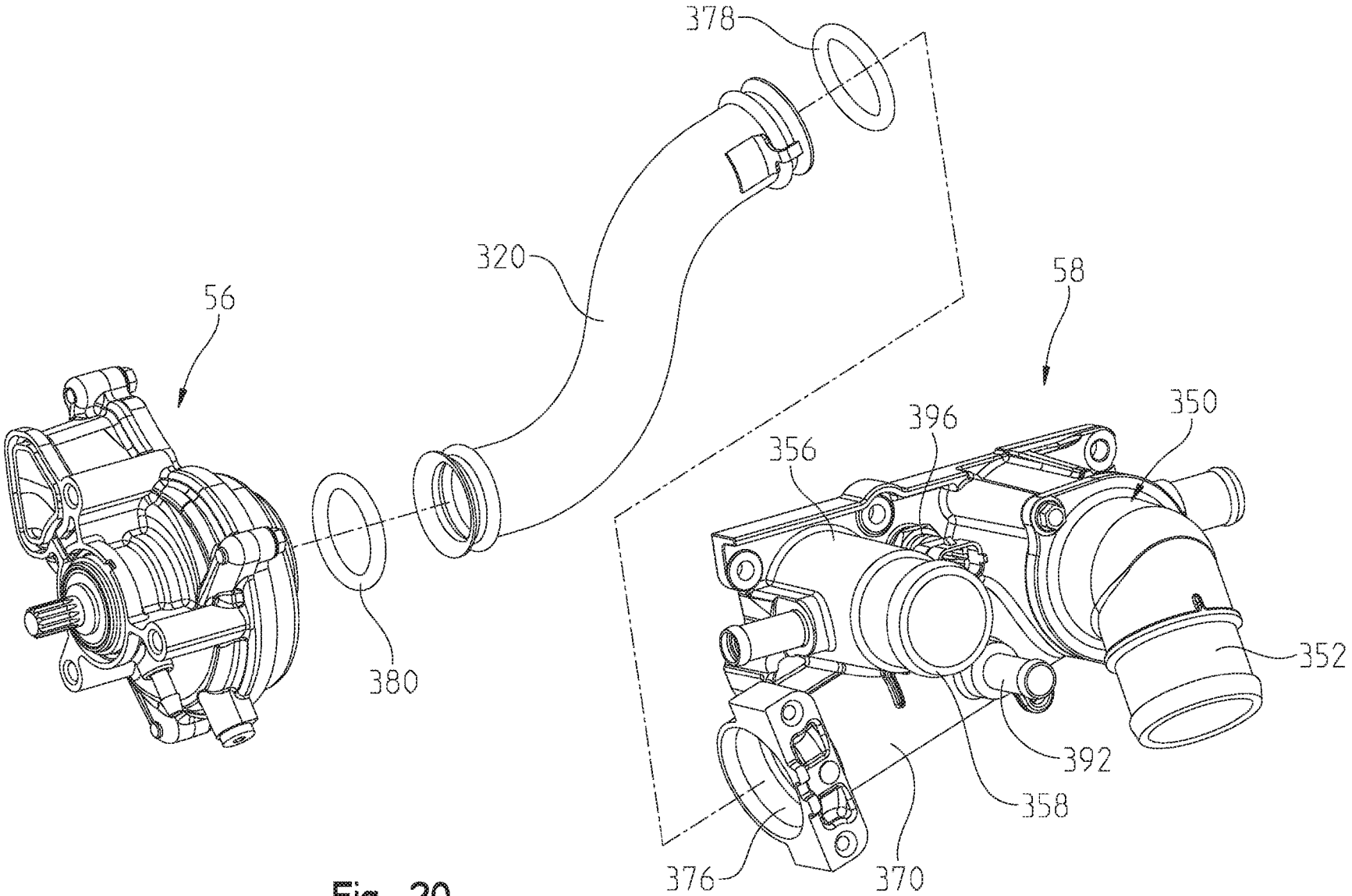
FIG. 20 shows a front left perspective view of the water pump and water cooling manifold.
Figure 21:
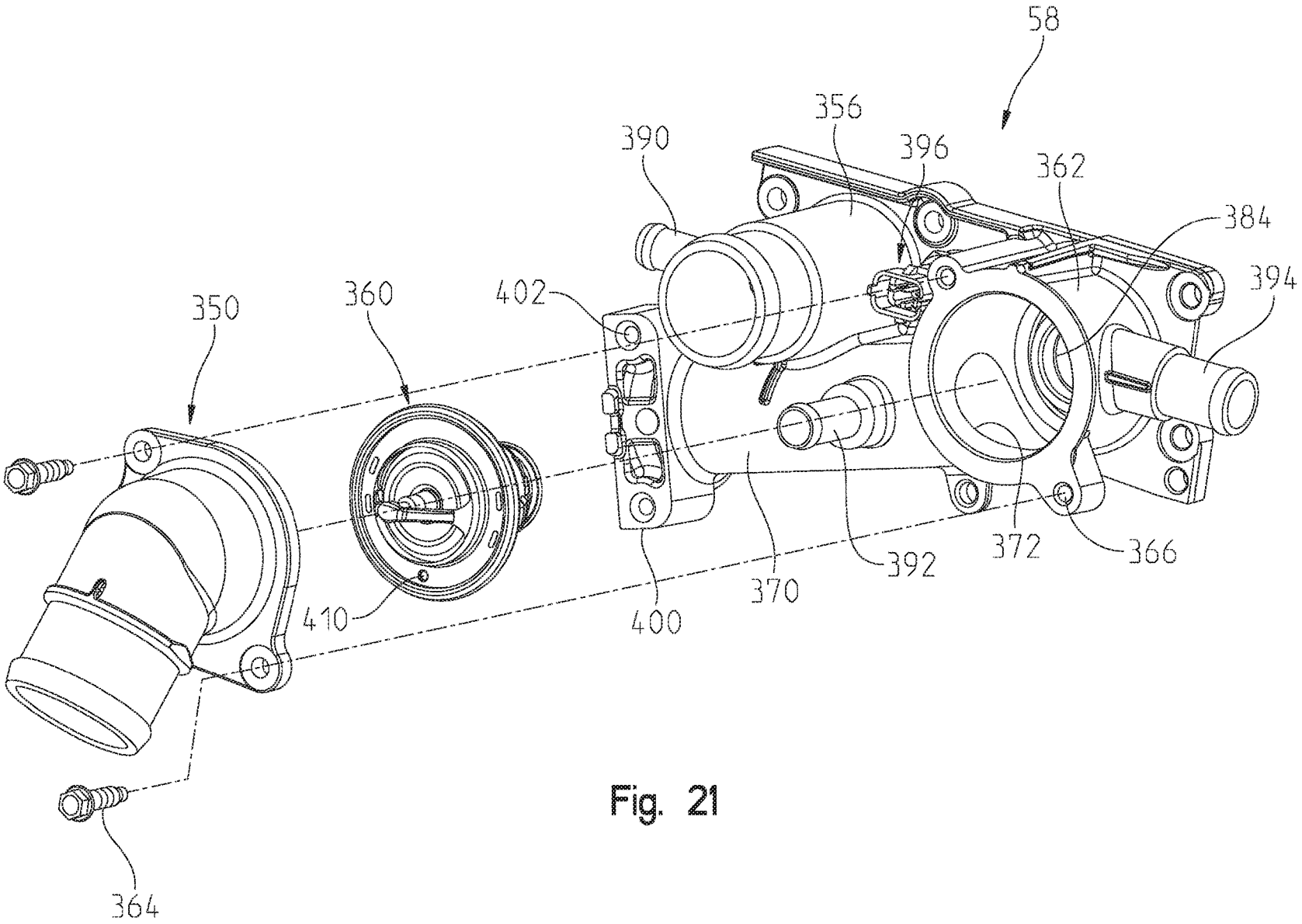
FIG. 21 shows the water cooling manifold with the hose bib and thermostat removed from the water cooling manifold.
Figure 22:
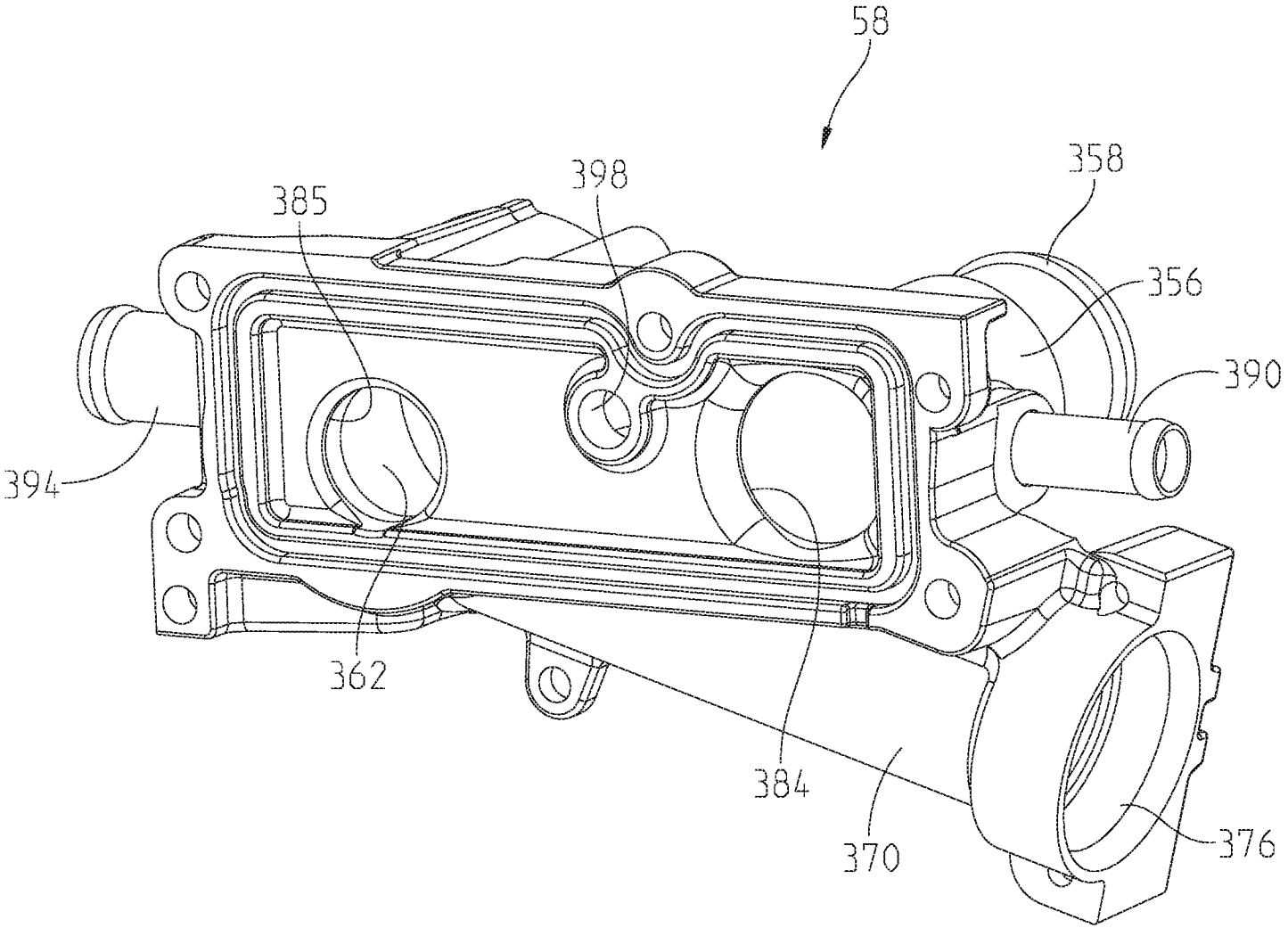
FIG. 22 shows a rear right perspective view of the water cooling manifold.
Figure 23:
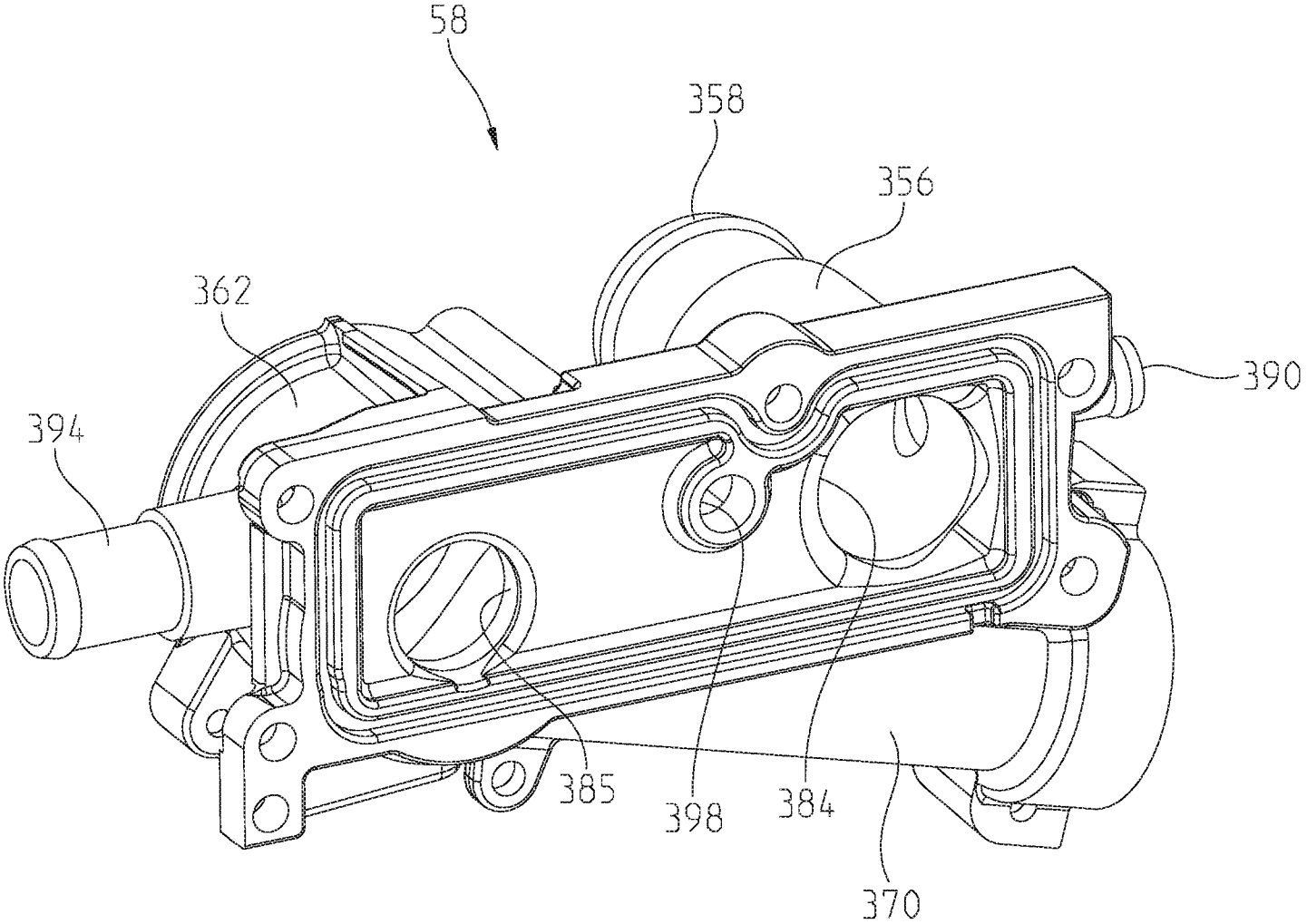
FIG. 23 shows a right front perspective view of the water cooling manifold.

With reference now to FIGS. 20-23, the water manifold 58 will be described in greater detail. As shown, water manifold 58 includes a removable fitting 350 having a coupling 352. Coupling 352 is coupled to hose end 20B (FIG. 2) which is cooling water from the radiator 10. Manifold 58 also includes a fitting 356 having a coupling 358 which couples to hose end 22B (FIG. 2) which is the cooling water return to the radiator 10. As shown best in FIG. 21, a thermostat 360 is provided intermediate fitting 350 and circular fitting 362. Fitting 350 couples to fitting 362 by way of fasteners 364 in threaded engagement with threaded apertures 366, trapping thermostat 360 between fitting 350 and fitting 362. An angled tube 370 is provided which communicates with fitting 362 by way of opening 372, as best shown in FIG. 21. As shown in FIG. 20, tube 370 includes a hose fitting at 376 which couples to metal tube 320 with an O-ring 378 therebetween. Tube 320 also couples to water pump 56 with an O-ring 380 therebetween. As shown best in FIGS. 22 and 23, fitting 358 includes an opening 384 and fitting 362 includes an opening 385. Fitting 356 does not directly communicate with tube 370; rather tube 370 is coupled only to fitting 362 through aperture 372 as shown in FIG. 21.

Manifold 58 further includes a reduced diameter fitting 390 which communicates with fitting 356 and is coupled to hose 60 (FIG. 19). A second reduced diameter fitting 392 (FIG. 21) couples to tube 370 and to tube 62 (FIG. 19). A third reduced diameter fitting 394 couples to fitting 362 and to hose 28 (FIG. 3) and to reservoir bottle 24. Manifold 58 also includes a thermistor 396 which couples to a front of manifold 58 and accesses the water temperature through an opening 398 (FIG. 22) on the back side of manifold 58. Finally, and as shown in FIGS. 6 and 21, water manifold 58 includes a flange 400 having threaded apertures at 402. This flange is for retaining a bracket 404 which holds the oil dipstick tube 406 (FIG. 6).

With the water manifold as described above, the water flow through the engine 6 and oil cooler 328 will be described in greater detail. As should be appreciated, the water manifold 58 defines a pre-pump thermostat such that the water from the radiator isn't fed directly into the engine but rather is mixed with the hot water coming into fitting 362 through aperture 384. This prevents cold water from contacting hot engine components and potentially damaging them due to the heat variation. Rather, fitting 362 defines a mixing chamber to mix water from the radiator and water directly from the engine and allows it to flow through tube 370 and to water pump 56.

More particularly, water enters from the engine head discharge 310 (FIG. 19) into both fittings 356 and 362. If the thermostat is closed, virtually all of the water is drawn through tube 372 and no water flows through fitting 356. However, a nominal amount of water is constantly moving through relief aperture 410 (FIG. 21) in thermostat 360 to allow some water from the radiator at all times. Thus, when the thermostat is open, water is flowing into fitting 350 from the radiator and into fitting 362 from the engine and mixing together and flowing through tube 370 back to the water pump. The water that flows through fitting 356 returns to the radiator through hose 22 (FIG. 2) to be cooled. As fittings 390 and 392 are coupled directly to fittings 356 and tube 370, the water pump 56 will draw water into fitting 392 and suction it out of 390 through oil heat exchanger 398.

Figure 24:
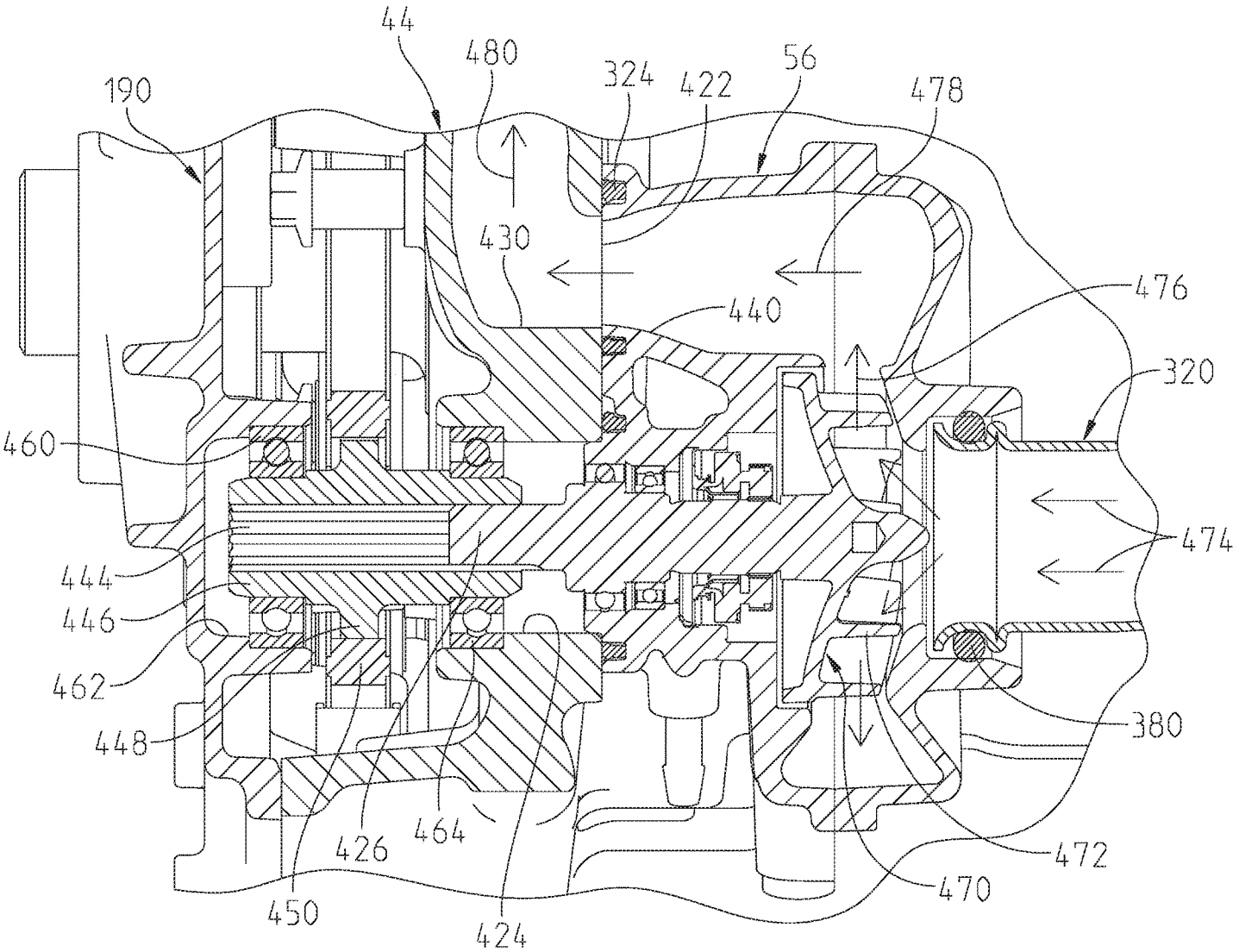
FIG. 24 is a cross-sectional view through lines 24-24 of FIG. 18.
Figure 25:
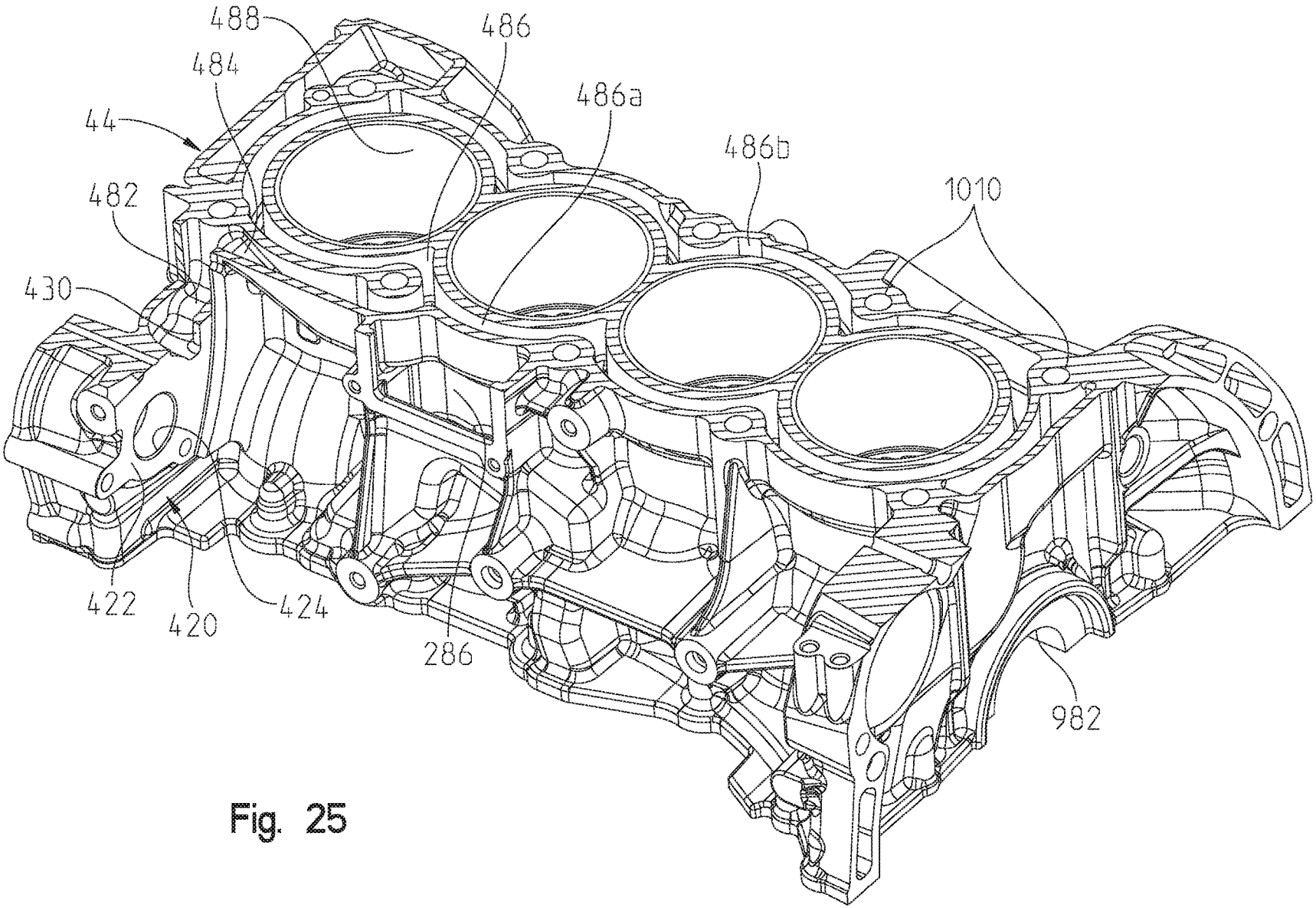
FIG. 25 is a staggered cross-section through the water pump mounting wall and just under a top surface of the crankcase.

With reference now to FIGS. 19, 24 and 25, water pump 56 and its operation will be described in greater detail. As shown in FIG. 19, a wall 420 protrudes outwardly from the crankcase 42 to provide a mounting surface at 422. Wall 420 includes a circular aperture at 424 to receive drive shaft 426 therein. Wall 422 also includes an opening at 430 for water to move upwardly through the crankcase 42 and into the head 48 as described herein. As shown in FIG. 24, water pump 56 abuts surface 422 to align a pump discharge opening 440 with opening 430 in wall 420. At the same time, water pump drive shaft 426 extends through opening 424 to engage a splined opening 444 of an idler shaft 446. Idler shaft 446 includes an idler gear 448, which is also viewable in FIG. 13 when cover 190 is removed. A chain 450 (FIG. 13) entrains gear 448, inner gear 160 (FIG. 9) on crankshaft 150 and gear 456 (FIG. 13). Gear 456 drives an oil pump, as further described herein. Idler shaft 446 is rotatably held in place by way of a first set of roller bearings 460 positioned within an opening 462 in cover 190 (FIG. 13 and FIG. 24) and a second set of roller bearings 464 positioned within opening 424. Thus, as the idler shaft 446 is positioned in a rotatably fixed position between the cover 190 and the crankcase 42, if the water pump needs to be removed from the engine, the water pump 56 is simply unbolted from surface 422 and can be removed without having to remove the outer cover 190.

The water pump 56 also includes an impeller 470 having plural vanes 472 which rotate upon rotation of the idler shaft 446 to draw water in from hose 320 in the direction of arrows 474, upwardly through the water pump 56 in the direction of arrows 476, out the discharge opening 440 of the water pump in the direction of arrows 478, and upwardly through opening 430 in the direction of arrows 480. As shown best in FIG. 25, opening 430 opens into a channel 482 in the block 44, into a further channel 484 and into a channel 486 which surrounds the engine cylinders 488. Channel 486 defines a channel 486A on the intake side of the engine and a channel 486B which is on the exhaust side of the engine.

Figure 26:
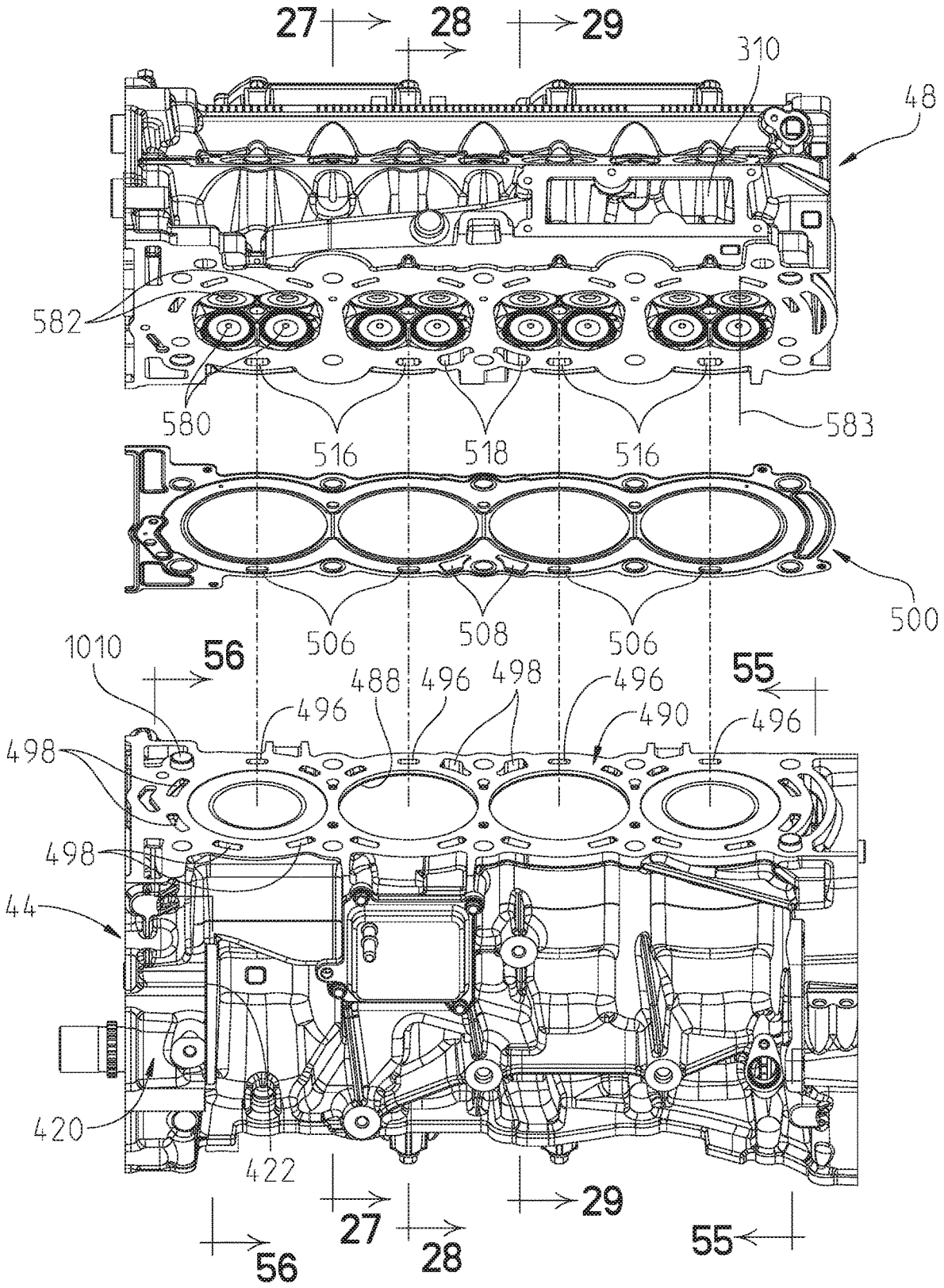
FIG. 26 is an exploded view of the engine block, head and head gasket.
Figure 27:
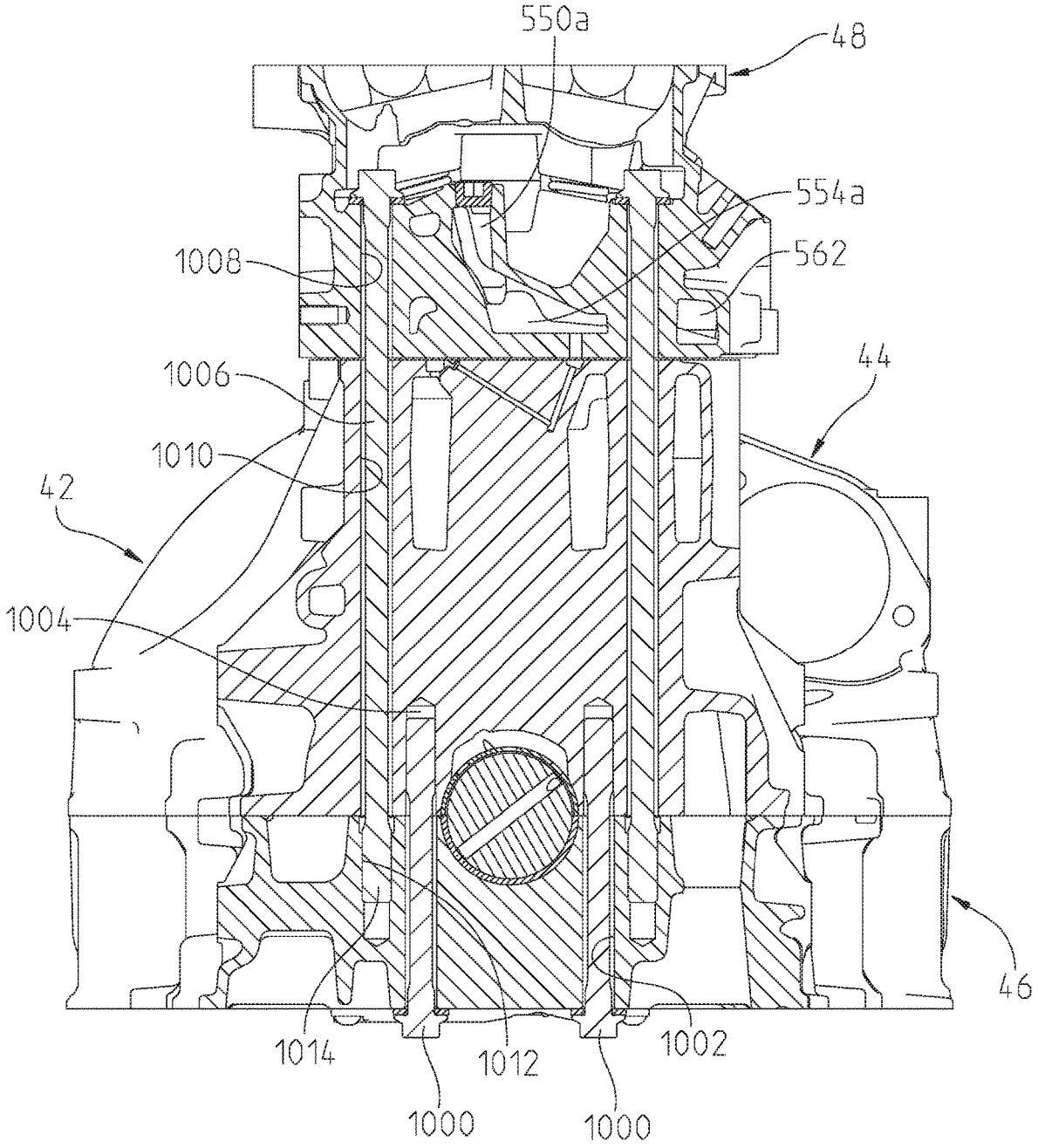
FIG. 27 is a cross-sectional view through lines 27-27 of FIG. 26.
Figure 28:
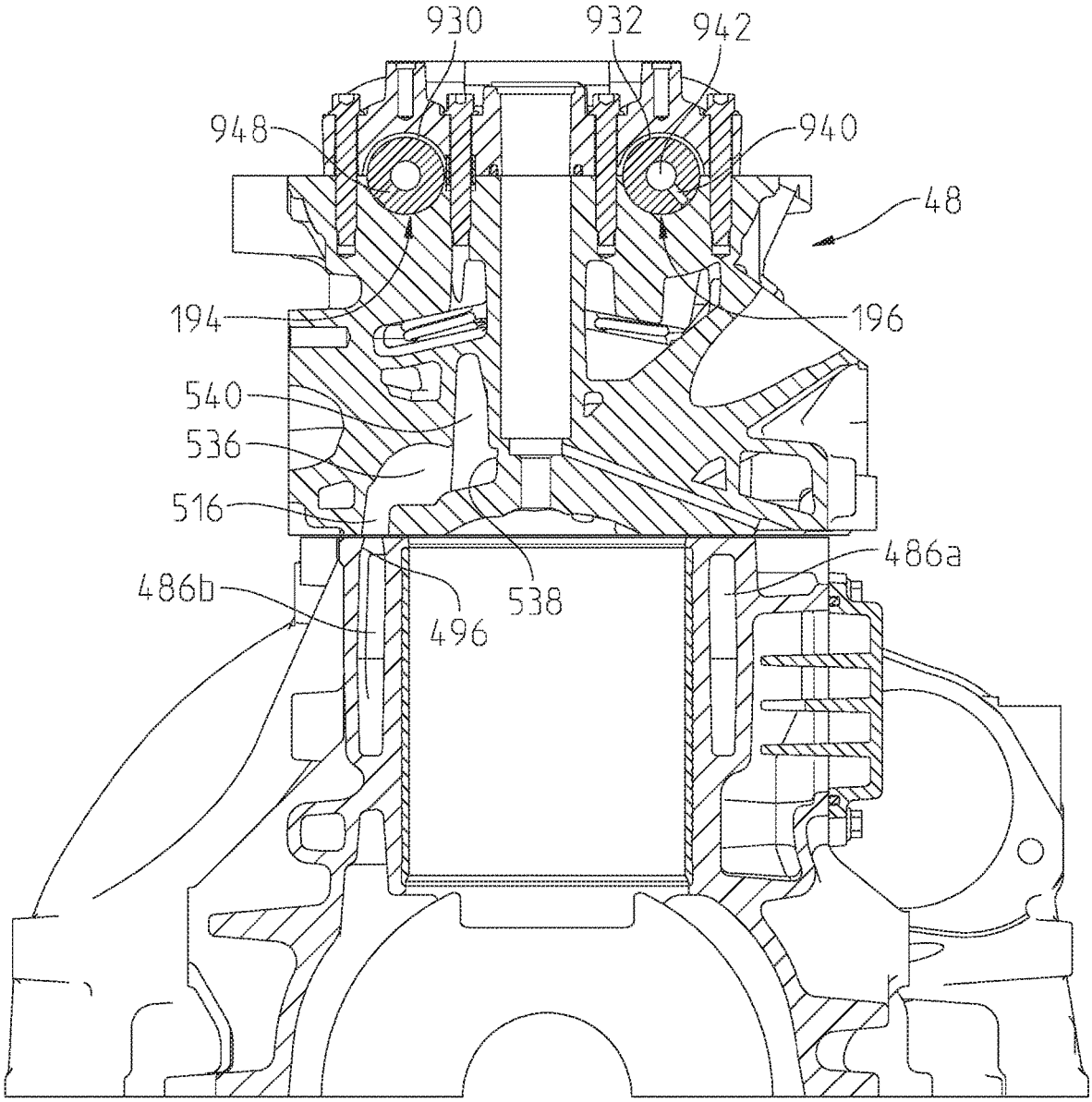
FIG. 28 is a cross-sectional view through lines 28-28 of FIG. 26.
Figure 29:
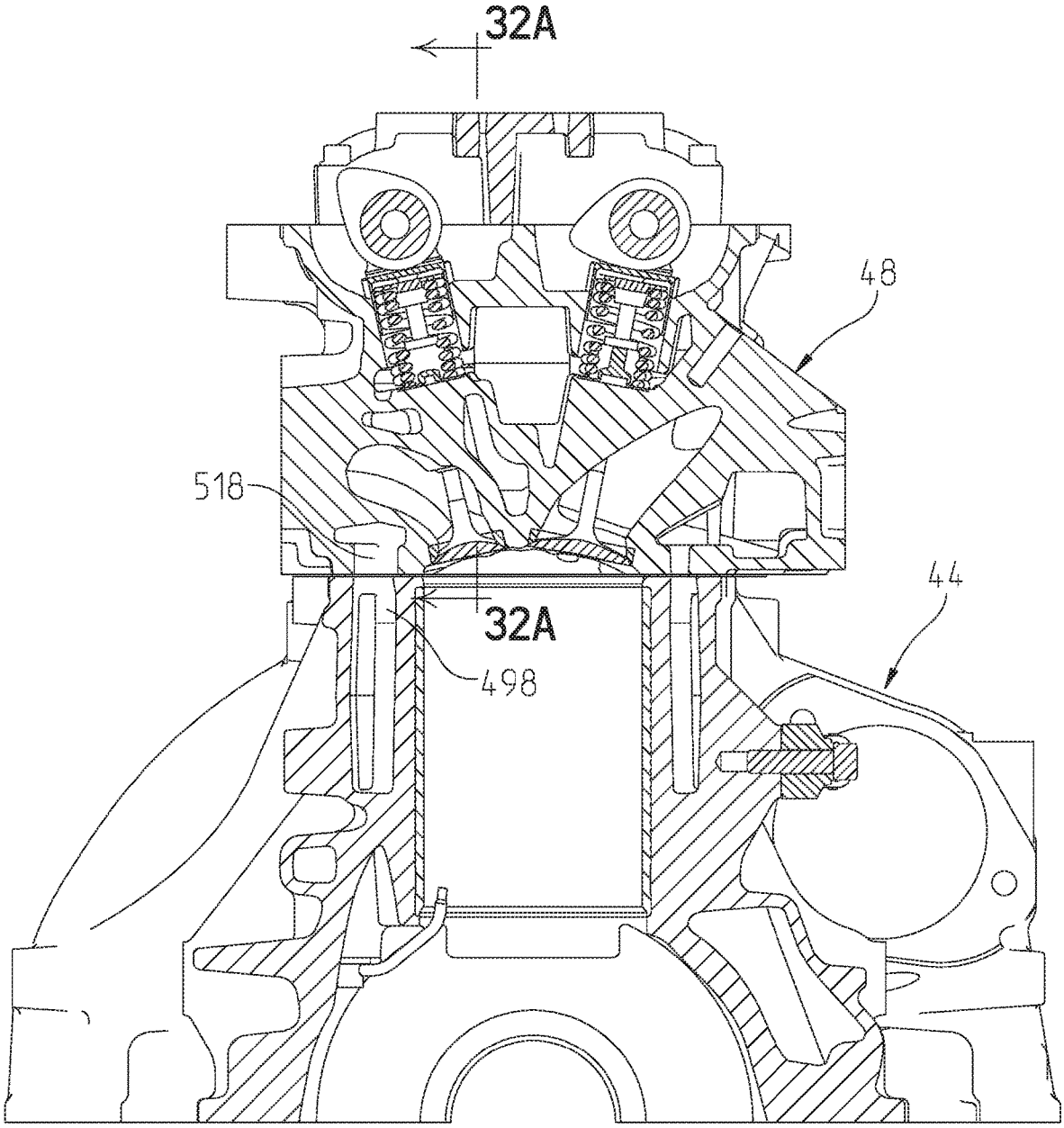
FIG. 29 is a cross-sectional view through lines 29-29 of FIG. 26.

With reference now to FIG. 26, block 44 is shown including a top wall 490 with a plurality of arcuate openings surrounding each of the cylinders 488. Namely, four arcuate openings 496 are provided on the exhaust side of the cylinders 488 and a plurality of arcuate openings 498 are positioned in various other positions around the cylinders 488. The apertures 498 are simply for communicating with the channels 486A, 486B (FIG. 25) to clear out the casting of the openings. Rather, a single opening on each cylinder, namely opening 496, and two openings 498 in the center of the head 48, are used for introduction of the water into head 48, as described herein.

With reference still to FIG. 26, a gasket 500 is provided for placement between the cylinder block 44 and head 48. As shown, gasket 500 is provided with four arcuate slots 506 which align with arcuate slots 496 in the cylinder block 44. However, no slots in the gasket 500 are provided which align with slots 498, such that the water does not traverse higher than the top surface of the cylinder block 44. In a like manner, gasket 500 is provided with two slots 508 which align with openings 498 in the top of the cylinder block 44. In a like manner, the bottom of head 48 includes arcuate slots 516 which align with arcuate slots 496 and 506 and openings 518 which align with openings 498 and 508. Thus, it should be appreciated that water coming from water pump 56 fills the channels 486 around the four cylinders 488 and is pushed upwardly into the head through the arcuate slots 516 and openings 518. With reference now to FIGS. 27-33, the water flow path through head 48 will be described from its entrance into passageways 516, 518 through discharge port 310.

Figure 31A:
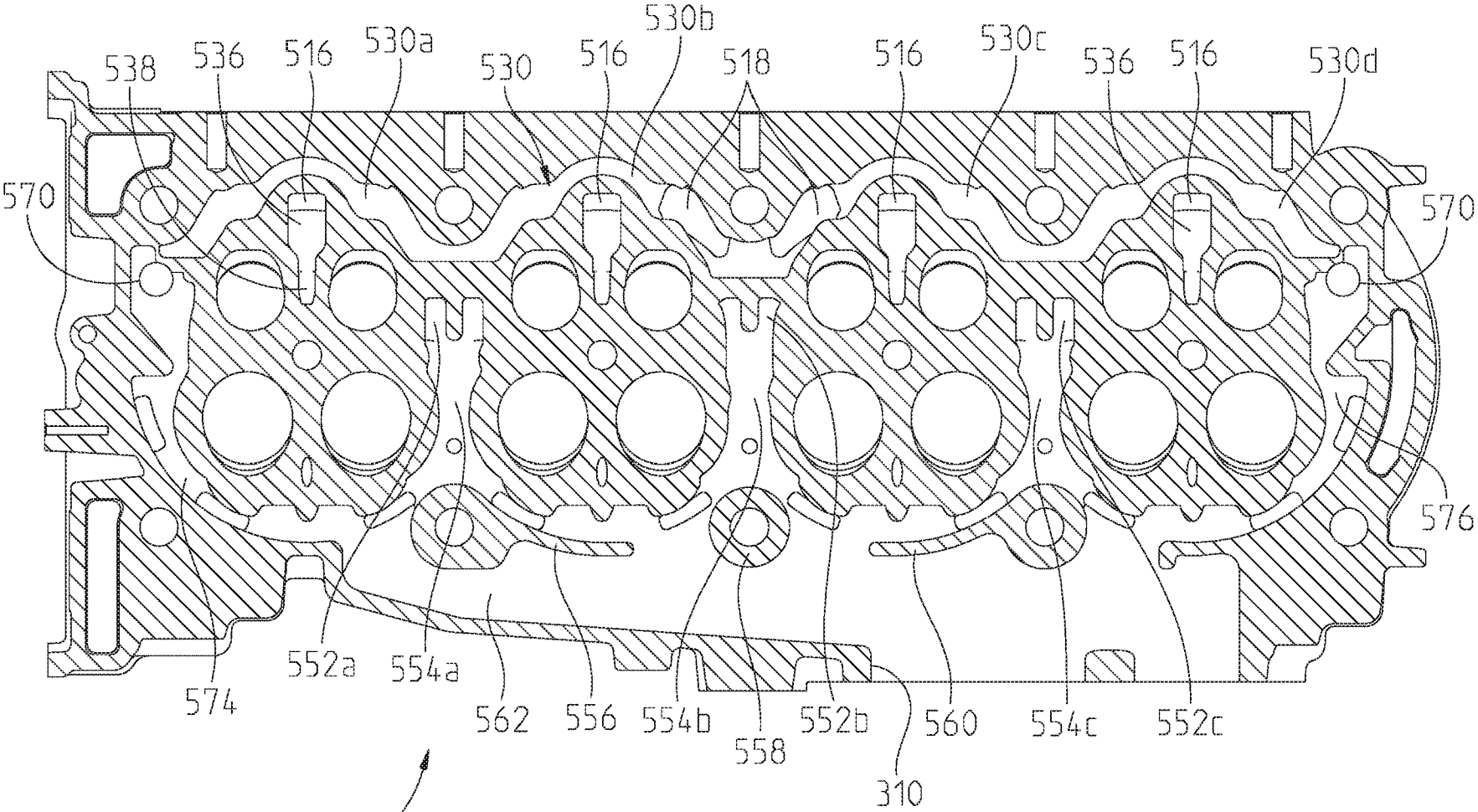
FIG. 31A is a cross-sectional view through lines 31A-31A of FIG. 30.
Figure 31B:
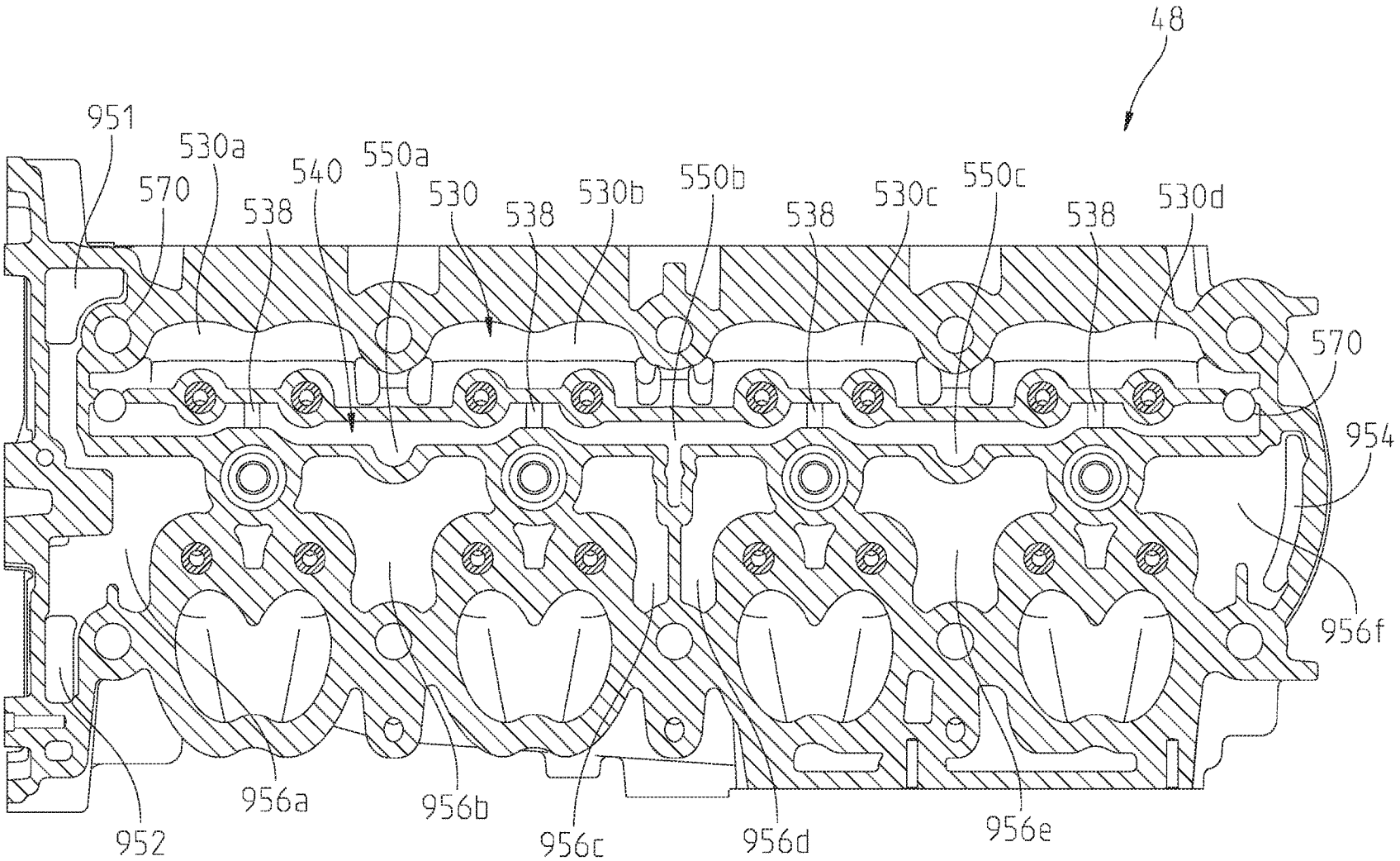
FIG. 31B is a cross-sectional view through lines 31B-31B of FIG. 30.
Figure 32A:
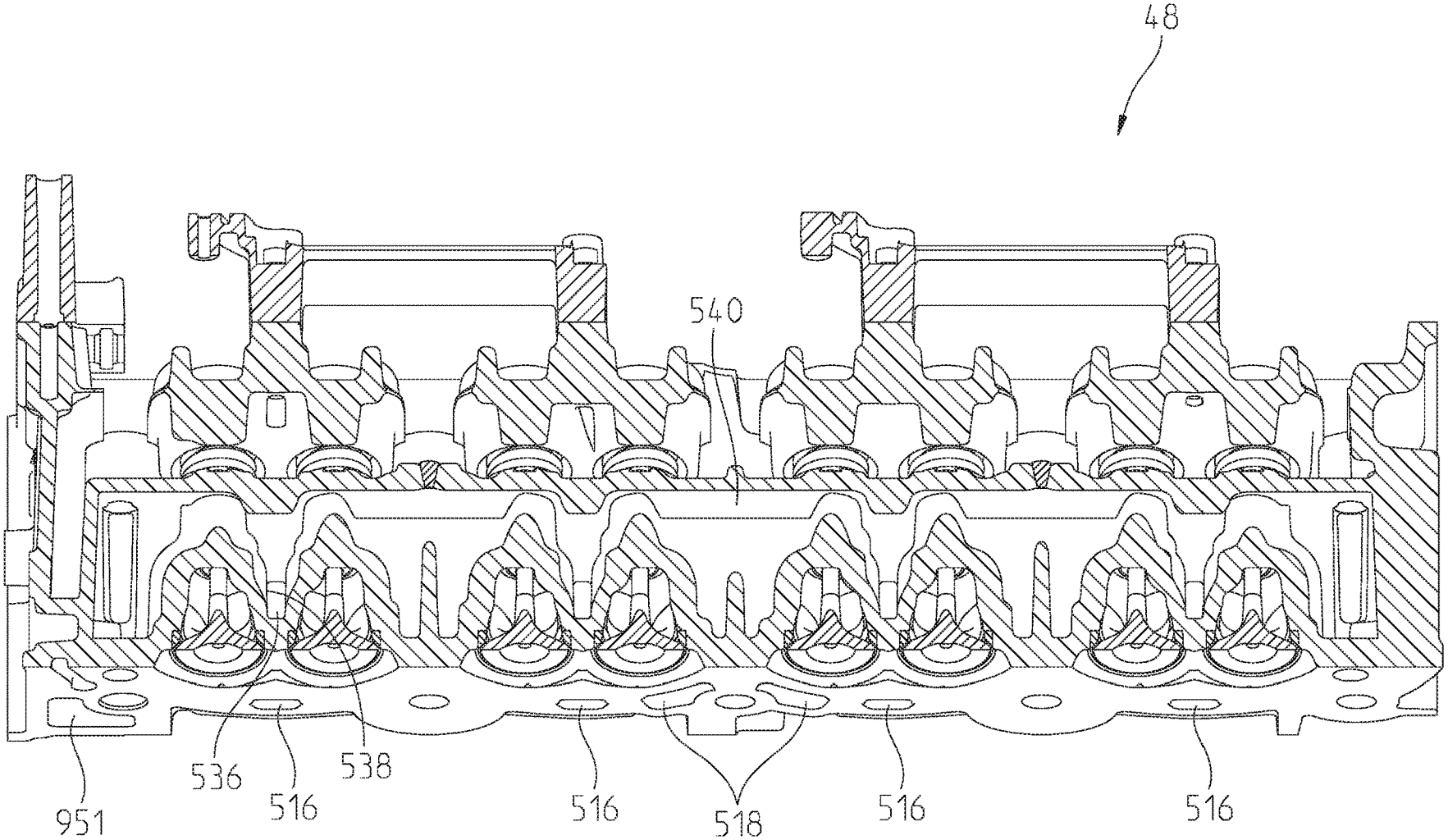
FIG. 32A is a cross-sectional view through lines 32A-32A of FIG. 29.
Figure 32B:
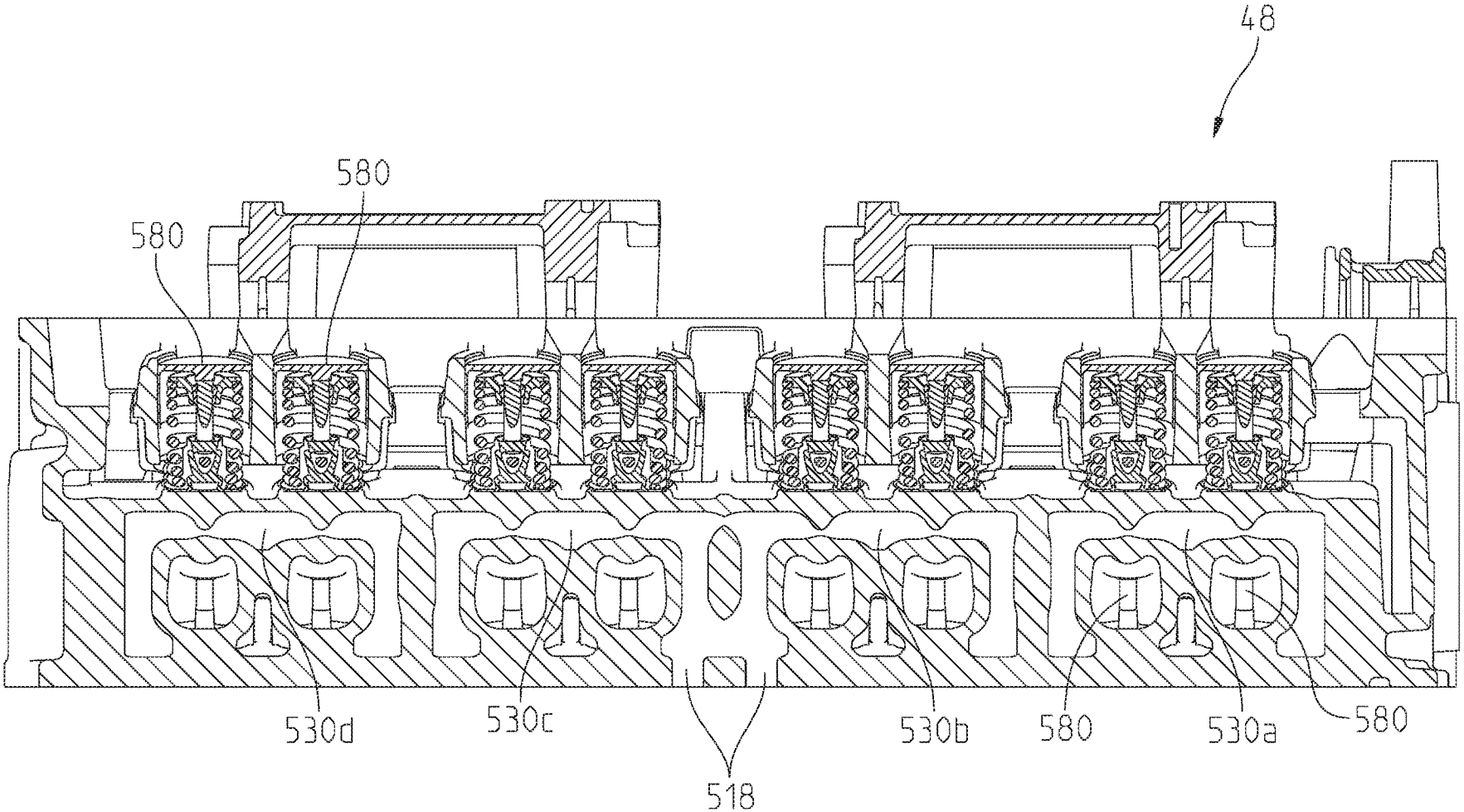
FIG. 32B is a cross-sectional view through lines 32B-32B of FIG. 29.
Figure 33:
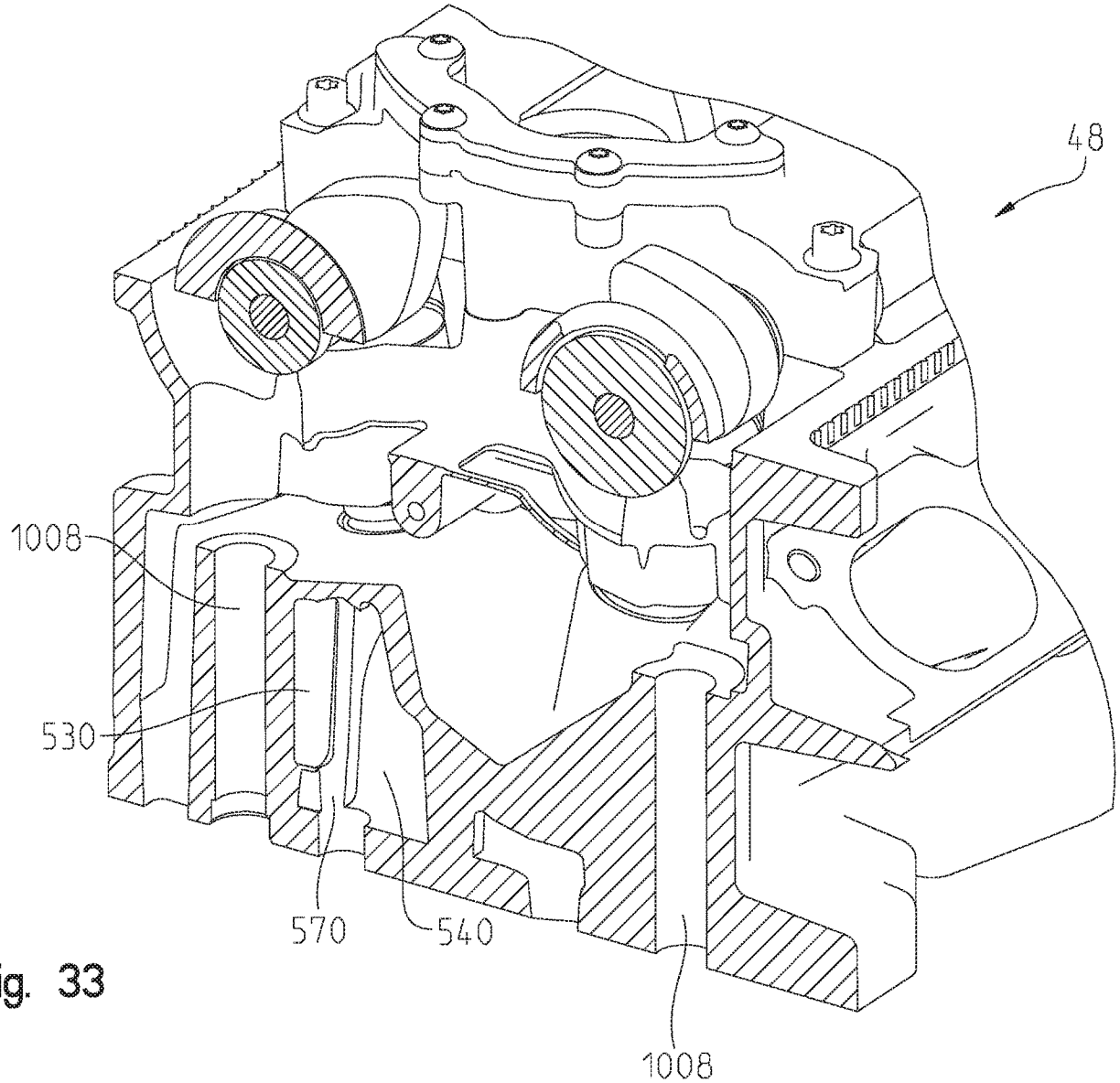
FIG. 33 is a cross-sectional view through lines 33-33 of FIG. 30.

With reference first to FIG. 31A, water comes up through openings 518 to fill a core 530 including arcuate sections 530A, 530B, 530C and 530D. This is also shown in FIG. 32B, where openings 518 are shown in cross section together with the core portions 530A-530D. With reference again to FIG. 31A, openings 516 extend vertically upwardly and connect with right-angled portions 536. This can be seen in FIG. 28 where right-angled portion 536 extends towards a center of head 48. Right-angled portion 536 then extends into a portion 538 which extends vertically upwardly to fill a core 540 as shown best in FIGS. 28 and 31B. Note that the position of cross section 31B is at a higher vertical level than the cross section of 31A, such that the water in cores 530 and 540 need to drain through the discharge opening 310. For this purpose, and with reference to FIG. 31B, three ports are provided, namely at 550A, 550B and 550C. These locations align and communicate with channels 552A, 552B and 552C (FIG. 31A). Positions 552A-552C feed into corresponding channels 554A, 554B and 554C. Water is diverted around diverters 556, 558 and 560 where it flows into channel 562 and out discharge port 310. Core 530 and 540 are coupled together by way of blind holes 570 at each end, as best shown in FIG. 31B. This can also be shown in FIG. 33, where hole 570 extends upwardly part way through head 48 to connect core 530 with core 540. This allows water to flow down channels 574, 576 (FIG. 31A) from core 540.

Thus, the intent of the water flow path is to cool the head, and particularly to the exhaust valves first, to prevent a large temperature gradient across the head. As shown in FIG. 26, the engine includes eight exhaust valves 580 and eight intake valves 582. Exhaust valves 580 are also shown in FIG. 32B. Each pair of exhaust valve 580 and intake valve 582 extends along a transverse axis 583, which is transverse to a longitudinal direction of the head and camshaft, as shown best in FIG. 26. Thus, the water flow through openings 518 up into the head fills the core 530 which surrounds the exhaust valves 580 on a rear side thereof and the water flow is such that the water flows from core portion 530B towards core portion 530A; and from core portion 530C towards core portion 530D. At the same time water is fed upwardly through openings 516A-516D to fill core portion 540 which is on the opposite side of exhaust valves 580 as core 530, as best shown in FIG. 31B. The water in core portions 530 and 540 when mixed together as described above through blind holes 570 is drained through channels 574 and 576 (FIG. 31A). At the same time water drains downwardly through portions 550A, 550B and 550C draining to channels 554A, 554B and 554C. Thus, all water is draining into channel 562 and outwardly through the discharge port 310. This water leads back to the water pump by way of the water manifold 58 as described above.

Figure 34:
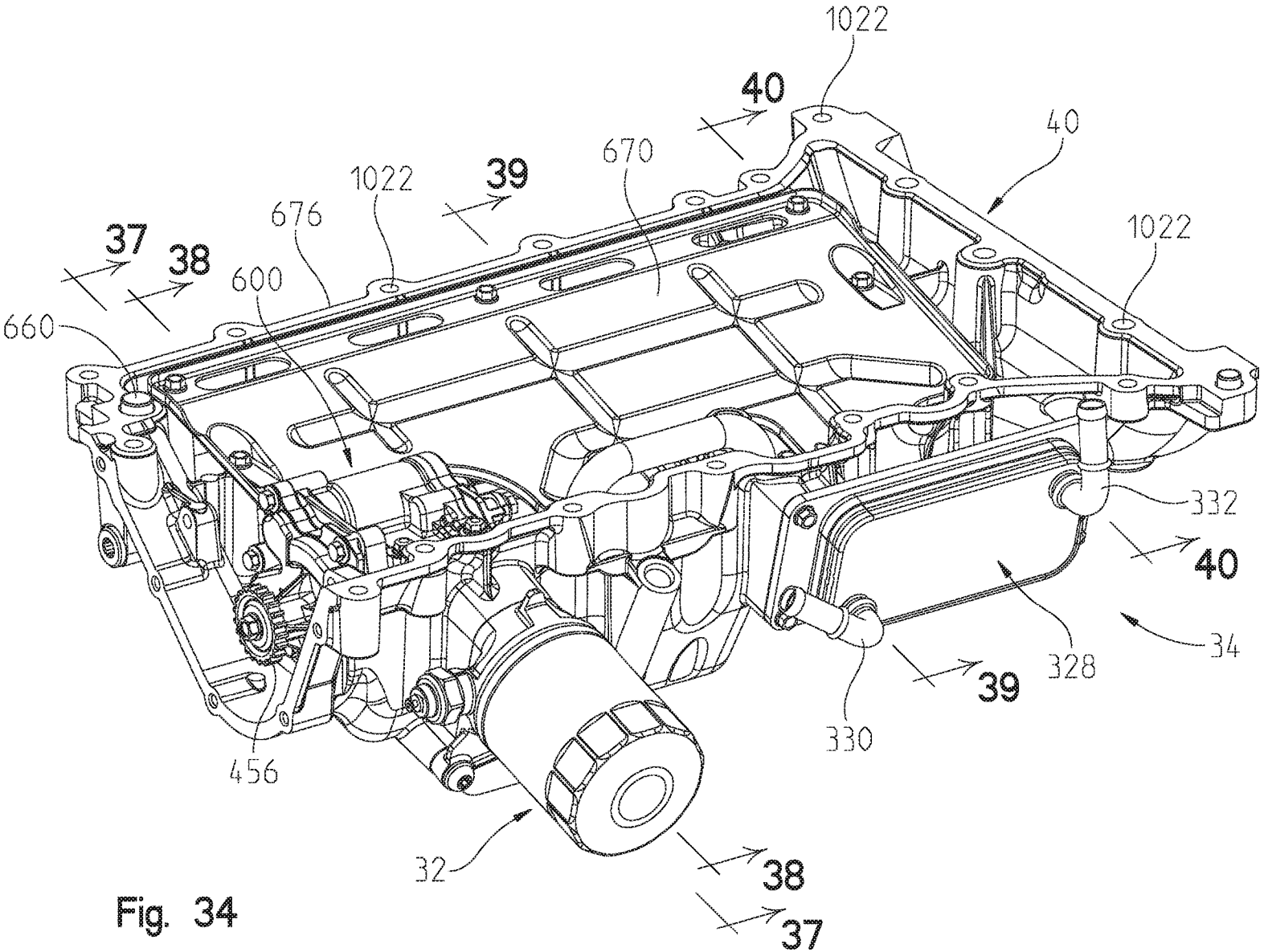
FIG. 34 shows a front left perspective view of the engine oil pan and oil pumping system.
Figure 35:
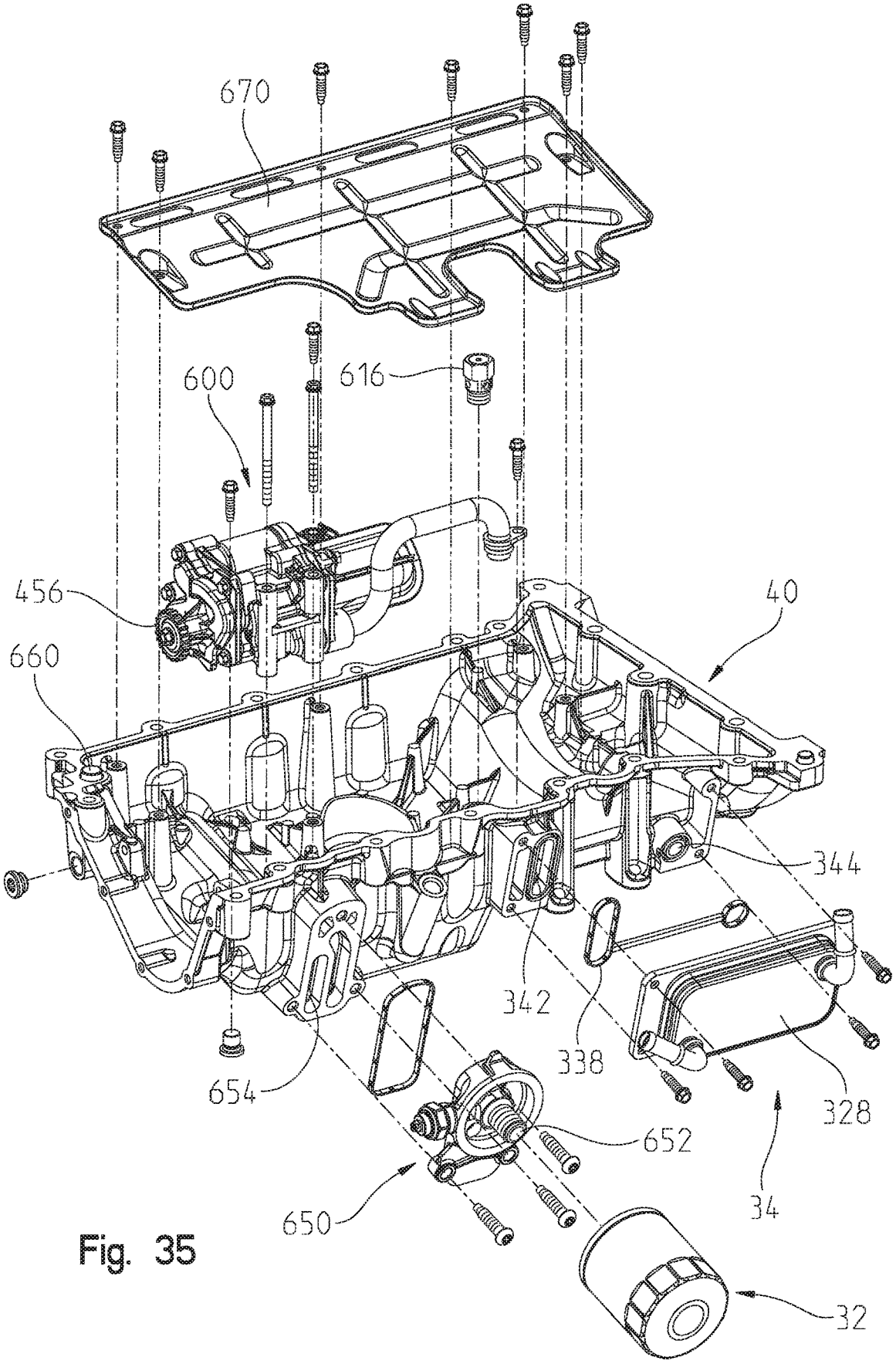
FIG. 35 shows an exploded view of the oil system of FIG. 34.
Figure 36:
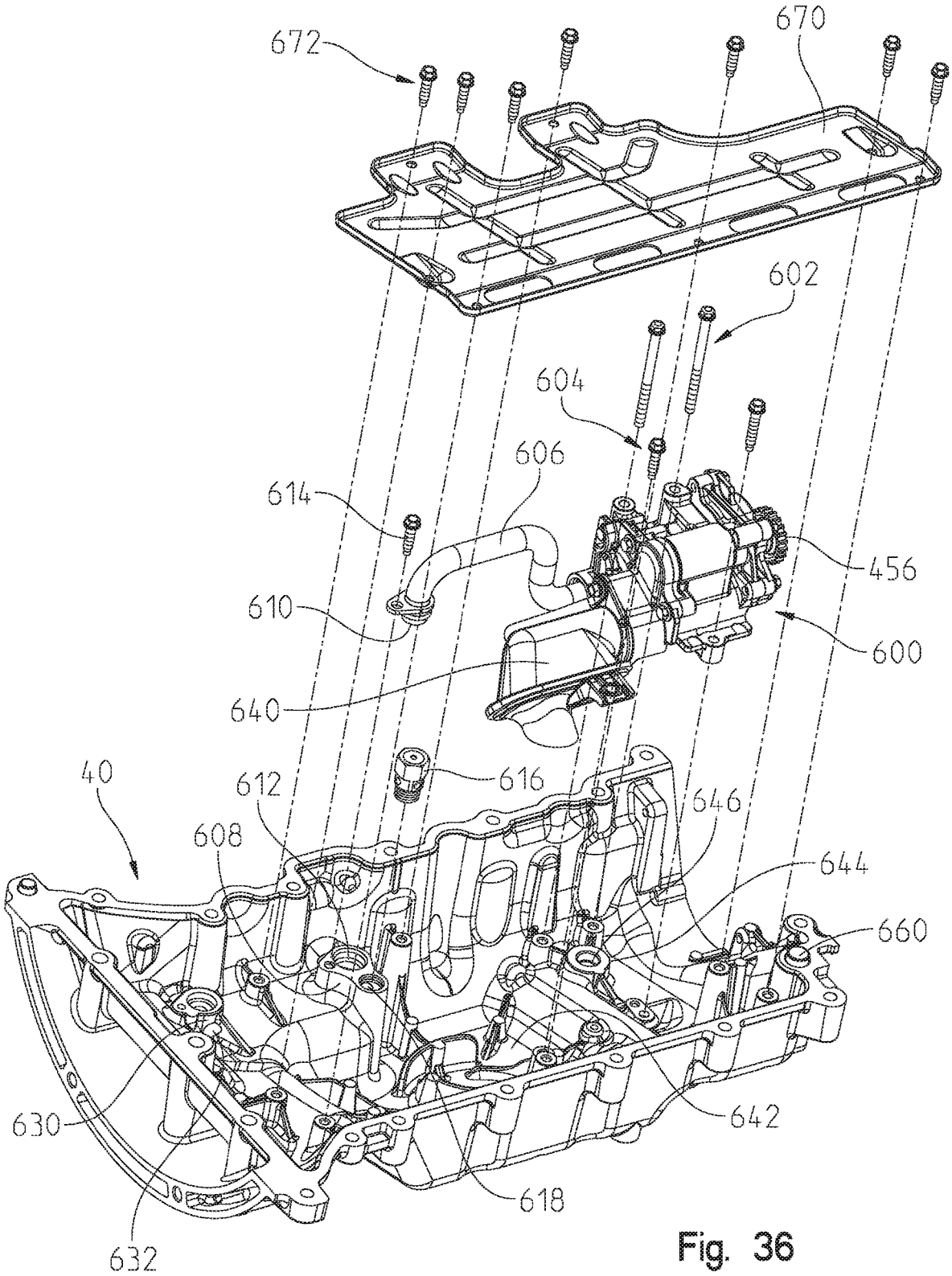
FIG. 36 shows the exploded view of FIG. 35 from the opposite direction.
Figure 39:
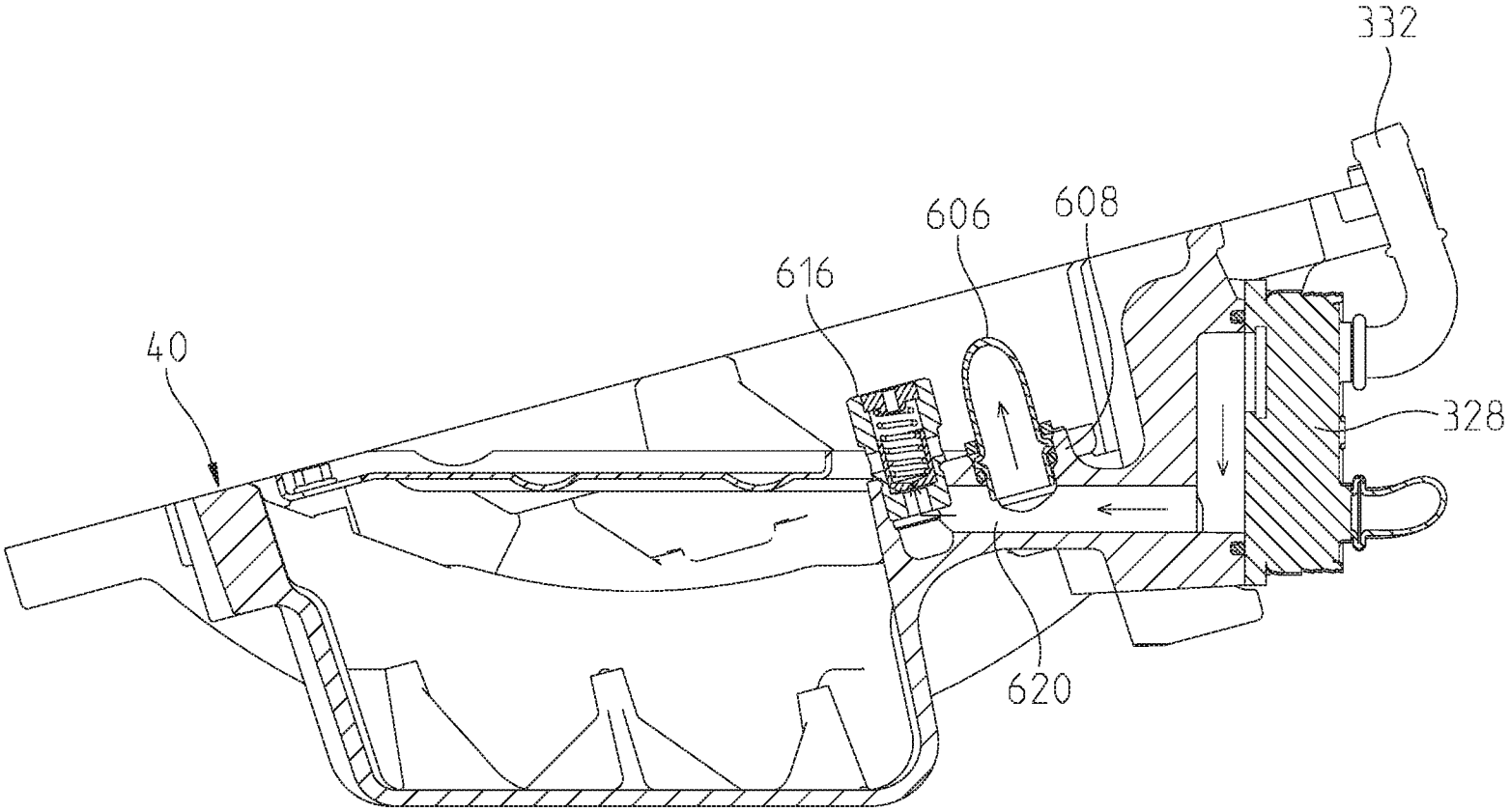
FIG. 39 shows a cross-sectional view through lines 39-39 of FIG. 34.
Figure 40:
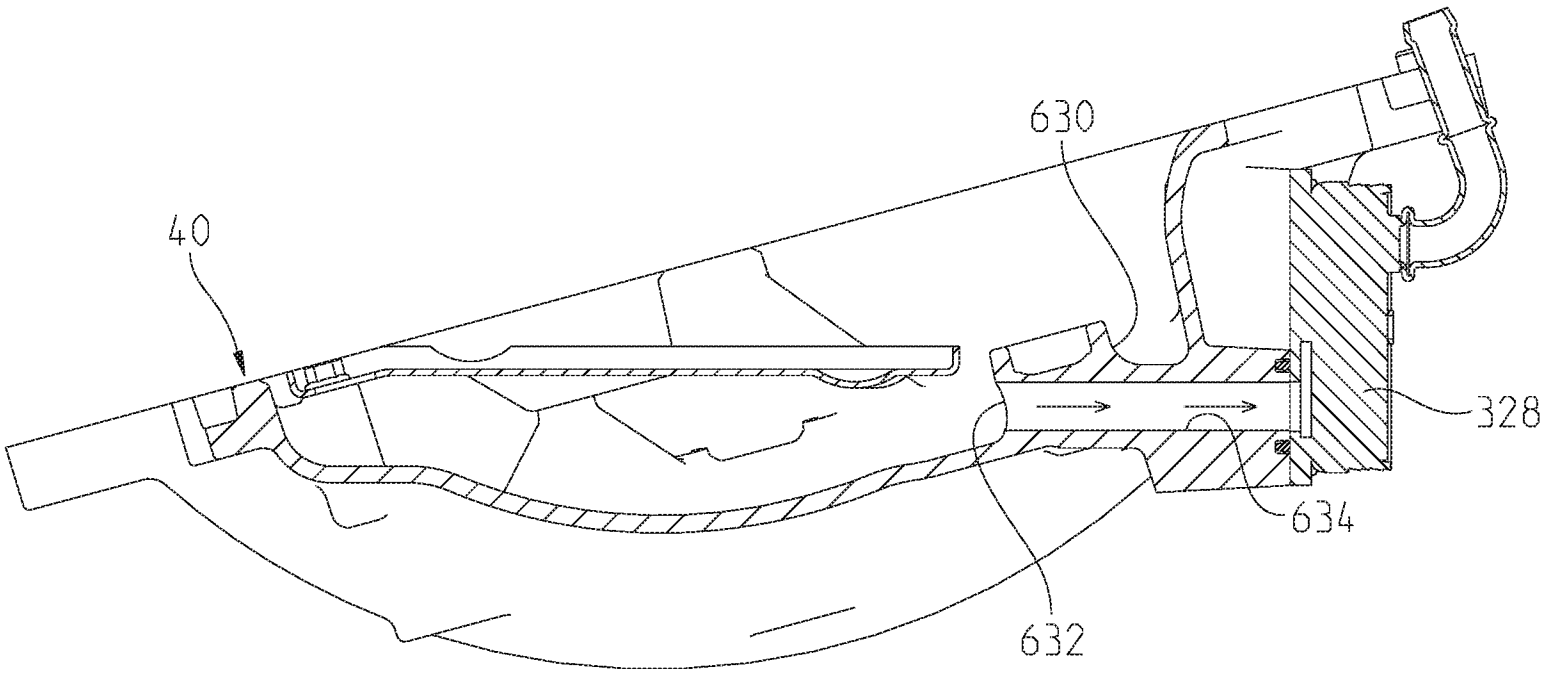
FIG. 40 shows a cross-sectional view through lines 40-40 of FIG. 34.

With reference now to FIGS. 34-36 the lubrication system will be described in greater detail. As shown, the lubrication system generally includes the oil filtration system 32, the oil cooling system 34 and a pump 600 coupled to the oil pan 40. As disclosed herein, pump 600 is a two circuit pump have first and second discharges. As shown best in FIG. 36, oil pump 600 is coupled to the base of the oil pan 40 by way of a plurality of fasteners 602 and 604 with a discharge tube 606 coupled to a conduit 608 defined within the oil pan 40. Discharge tube 606 includes a fitting at 610 which couples to an opening 612 and is fastened to the conduit 608 by way of a fastener 614. Coupling 612 communicates with opening 342 (FIG. 35) to pump oil into the cooler 328 as described previously. A pressure relief valve 616 is positioned in the conduit 608 within a fitting at 618. FIG. 39 shows a cross section through conduit 608 showing the internal channel 620 which communicates with the discharge tube 606 and relief valve 616. FIG. 36 shows a second internal conduit 630 having an opening 632 which as shown in FIG. 40 opens to an internal channel 634 communicating with the oil cooler 328. A main siphon 640 is coupled to pump 600 to suction oil from the oil pan 40. Thus, pump 600 suctions oil through opening 640 and pumps the oil through the oil cooler 328 and back to the oil pan through opening 632.

Figure 37:
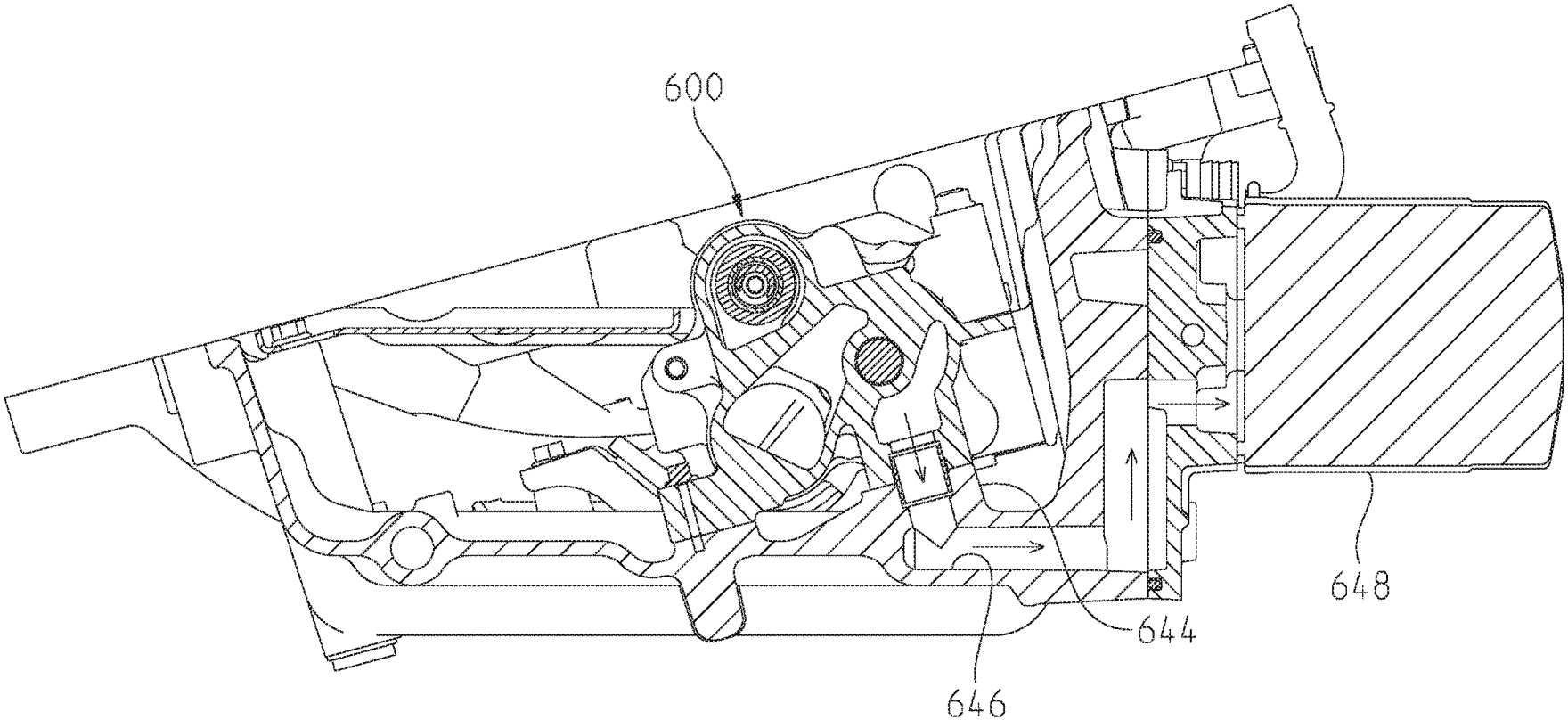
FIG. 37 shows a cross-sectional view through lines 37-37 of FIG. 34.
Figure 38:
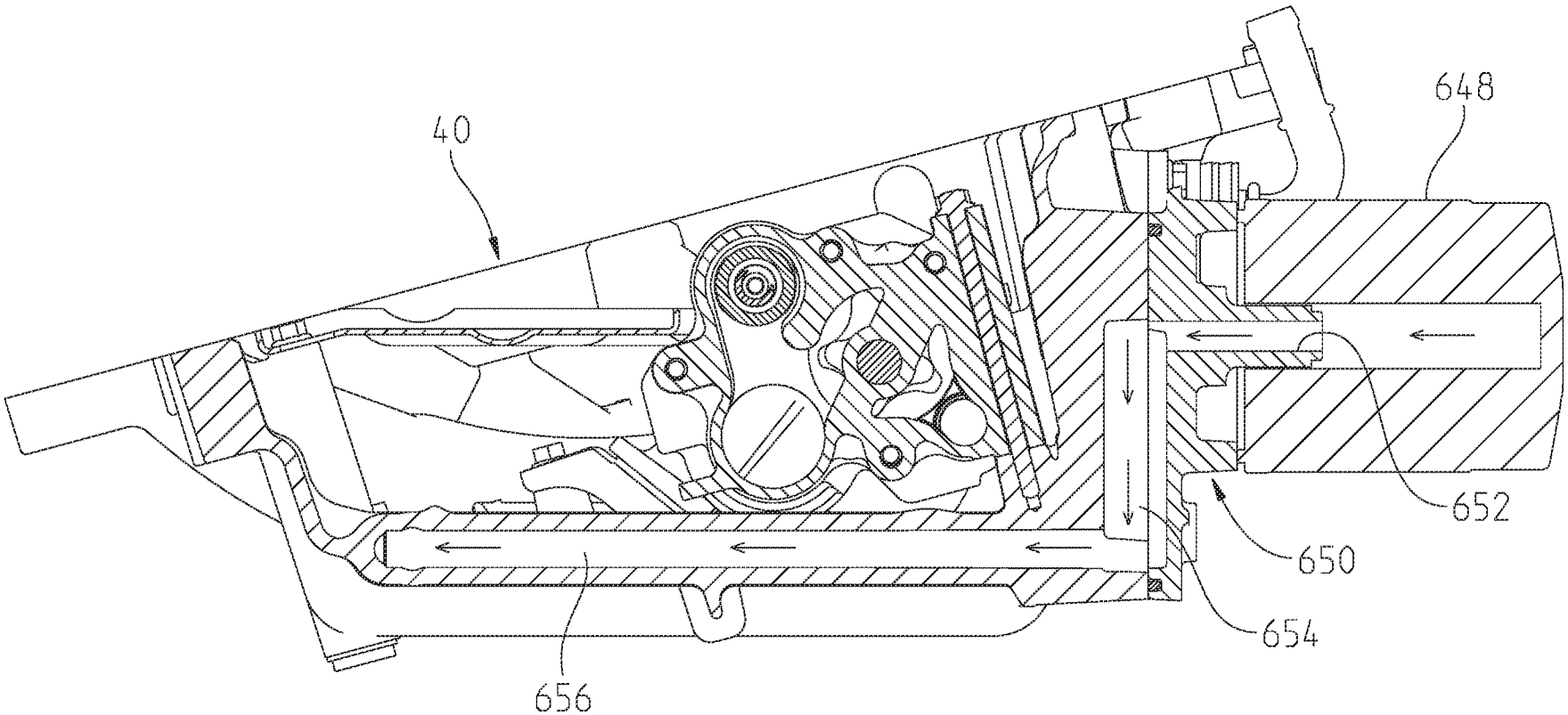
FIG. 38 shows a cross-sectional view through lines 38-38 of FIG. 34.

A third internal channel 644 is provided having an opening 646 which receives oil from oil pump 600 to deliver oil to the engine. As shown in FIG. 37, conduit 644 is shown in sectional view showing internal channel 646 leading to oil filter 648. With reference to FIG. 38, oil leaves filter 648 extends through oil filter mount 650 through channel 652 thereof, through channel 654 and through internal channel 656 (FIG. 38) defined within oil pan 40. Channel 656 connects with an output 660 (FIG. 35) to deliver oil up to the crank case 42. As also shown, an oil drip plate 670 is positioned over a top of oil pan 40 and is coupled by way of fasteners 672 to oil pan 40.

Figure 41:
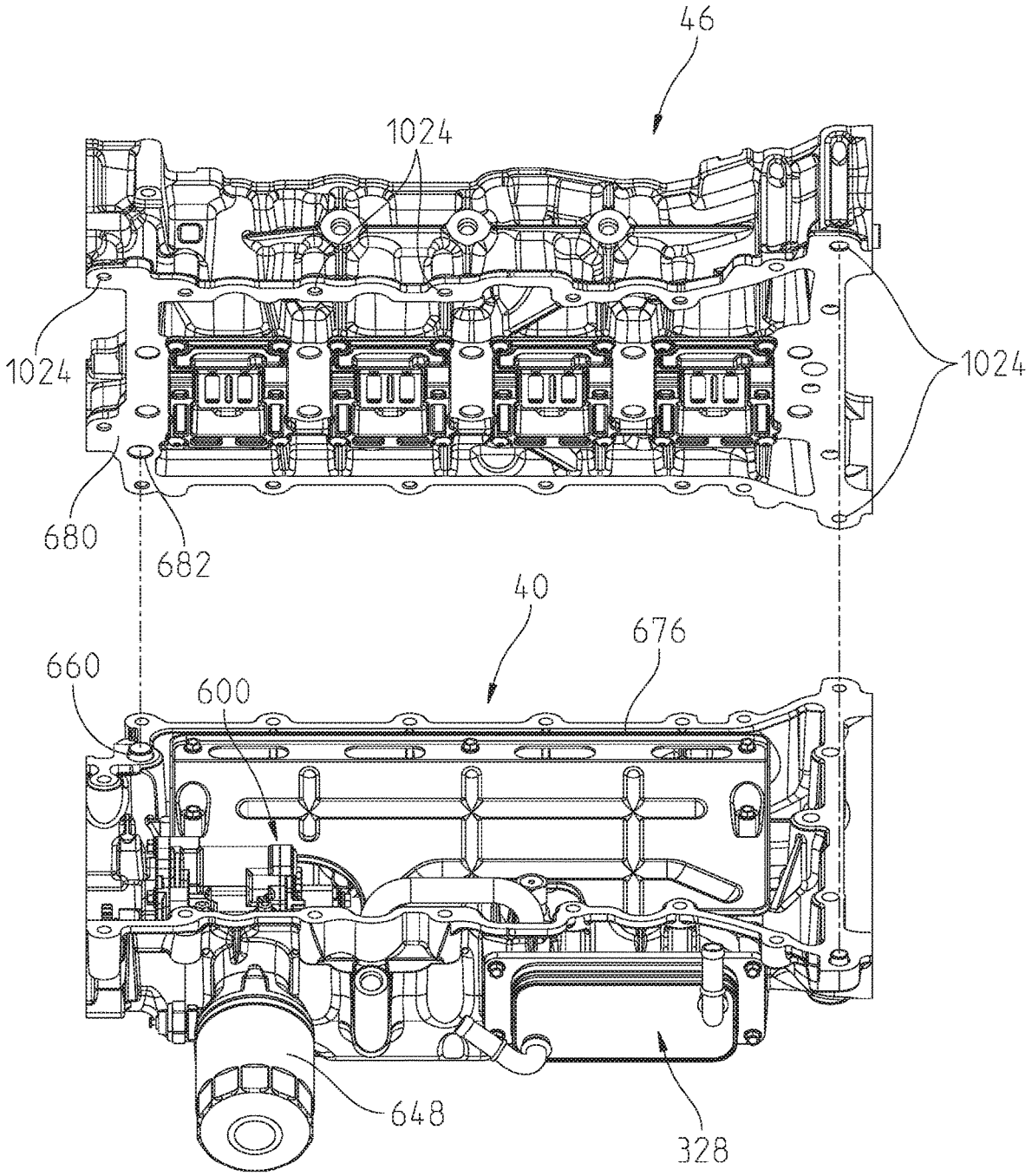
FIG. 41 shows an exploded view of a portion of the engine block positioned over the oil pan.
Figure 42:
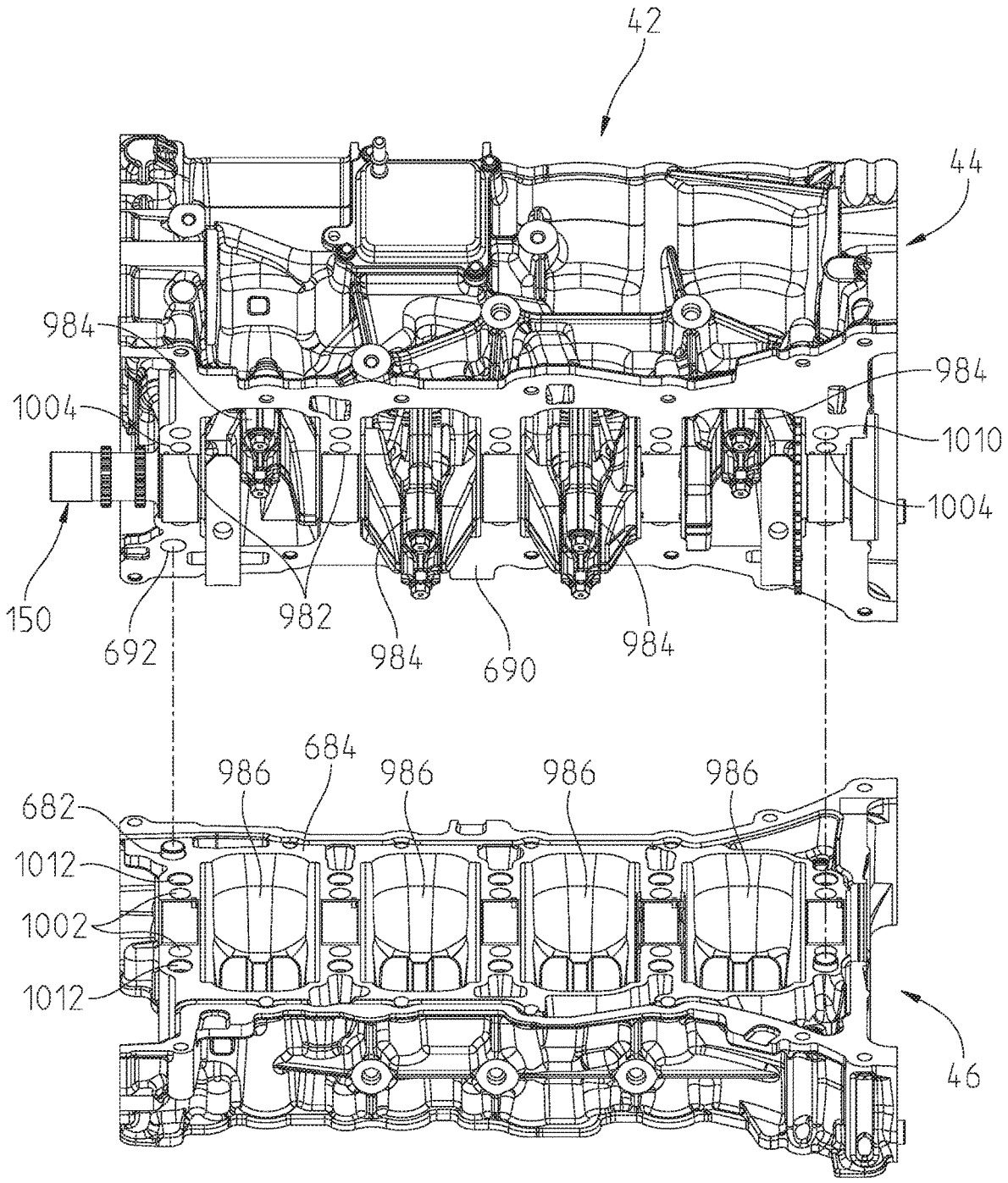
FIG. 42 shows an exploded view of the crankcase and bed plate of the engine block in an exploded manner.
Figure 43:
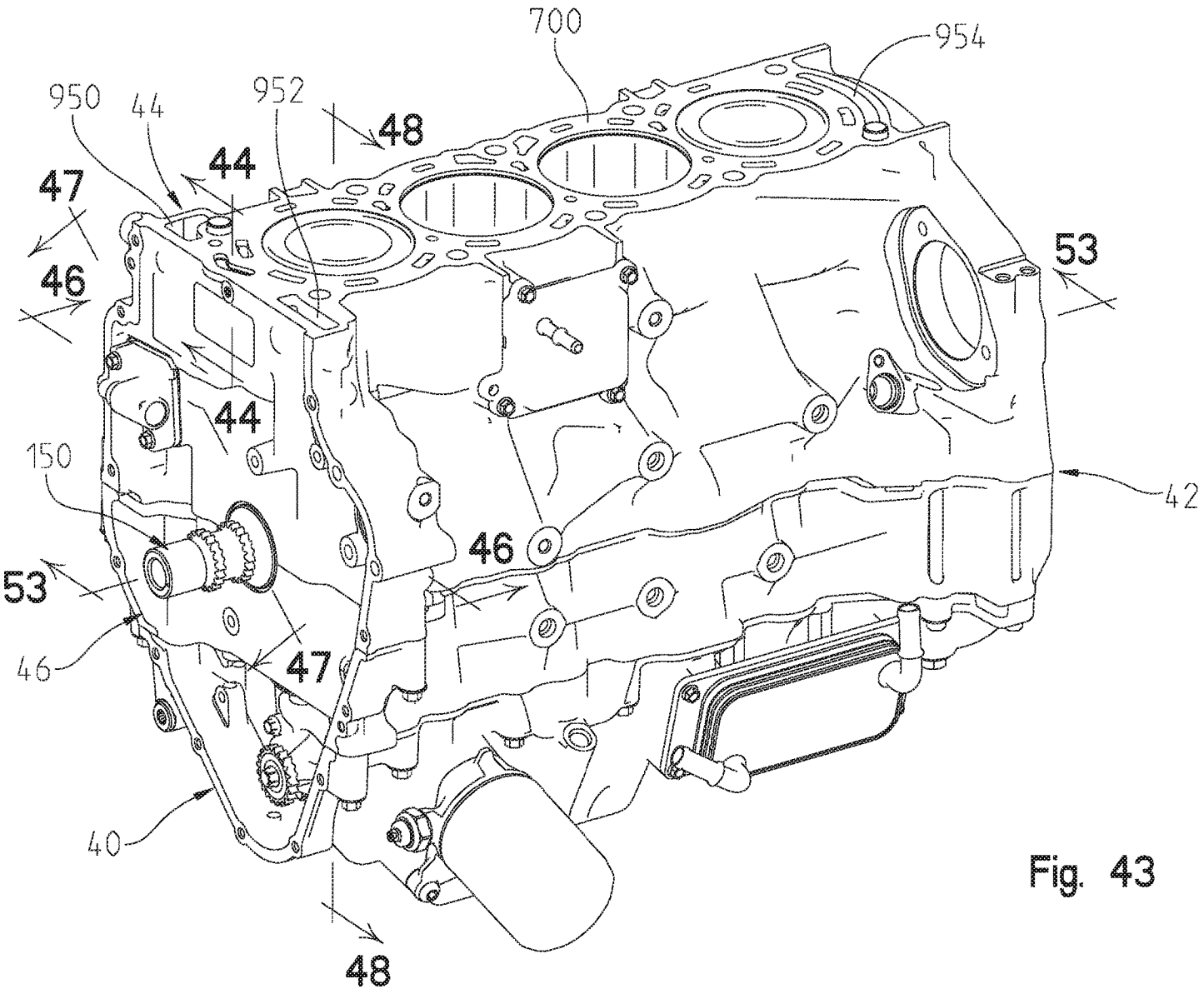
FIG. 43 shows a left front perspective view of the engine block and oil pan.
Figure 44:
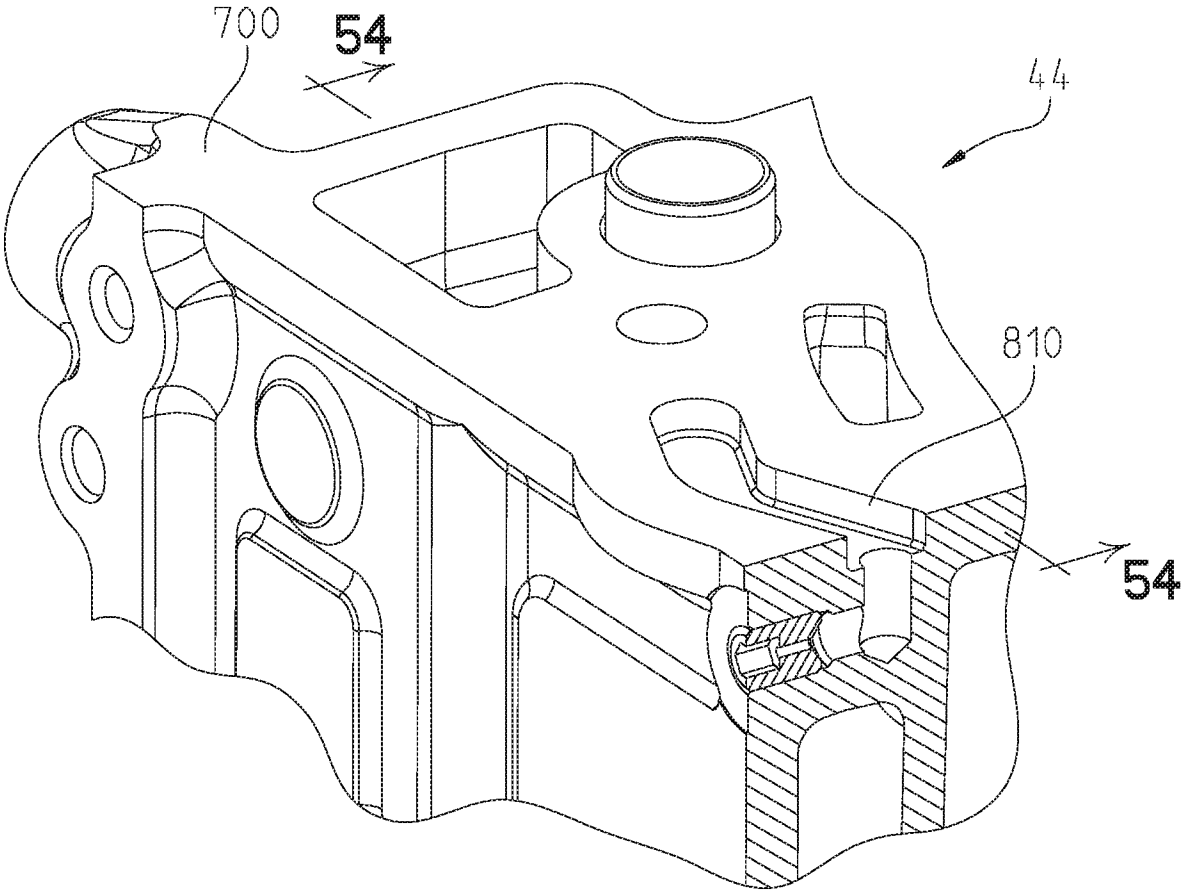
FIG. 44 shows a cross-sectional view through lines 44-44 of FIG. 43.

With reference now to FIGS. 41-43, the flow of oil from the oil pan 40 to the head will now be described. With reference to FIG. 41, oil pan 40 includes an upper surface 676 profiled to match lower surface 680 of bedplate 46. Furthermore, the aperture at 660 (which is the aperture through which oil is pumped from oil pump 600) aligns with aperture 682 of bedplate 46. With reference now to FIG. 42, an upper surface 684 of bedplate 46 is shown to align with a lower surface 690 of cylinder block 44. In a like manner, aperture 682 of bedplate 46 aligns with aperture 692 in crankcase 44. As shown in FIG. 43, the oil pan 40, the bedplate 46 and the crankcase 42 are shown stacked one above the other in their proper alignment.

Figure 46:
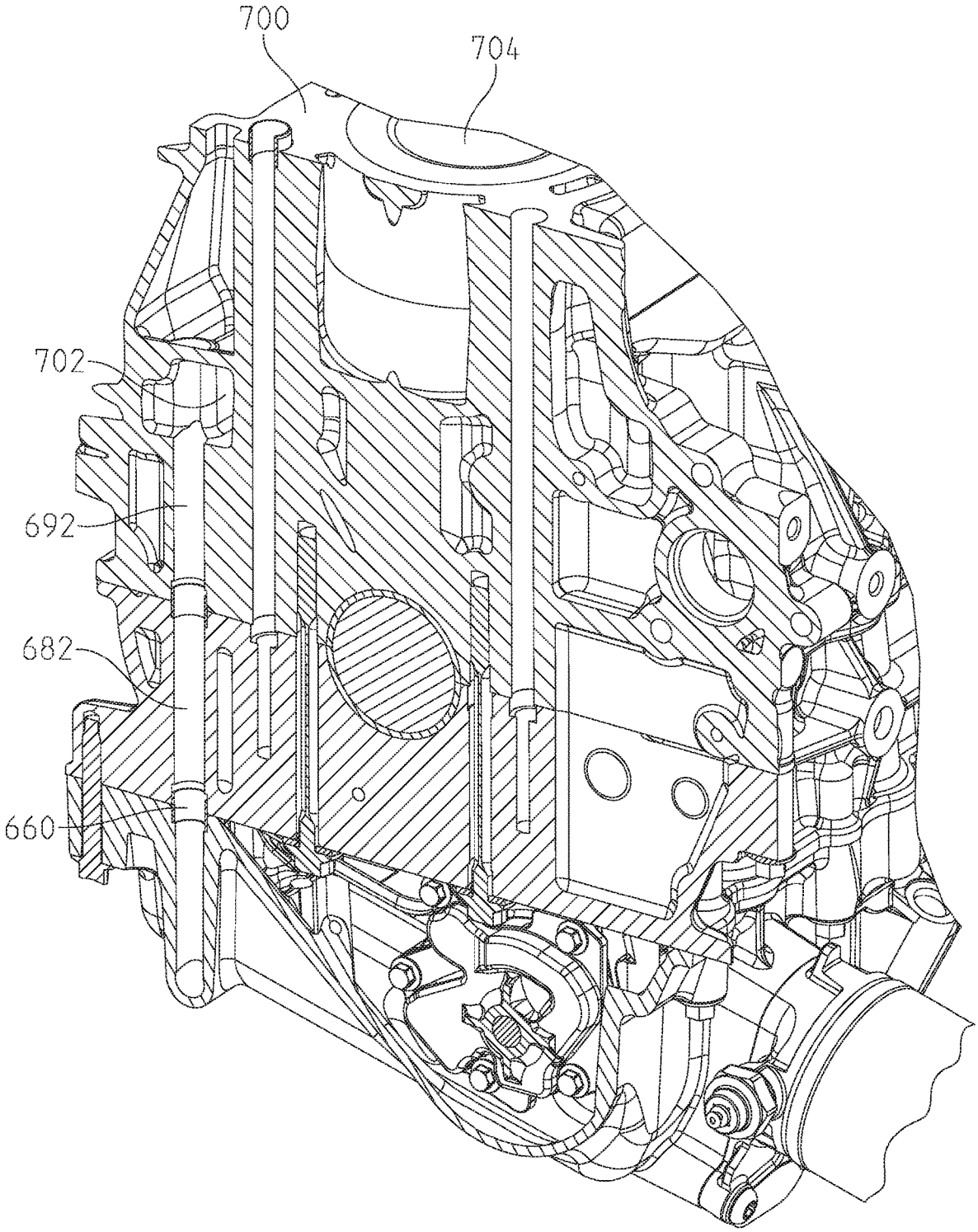
FIG. 46 is a cross-sectional view through lines 46-46 of FIG. 43.
Figure 47:
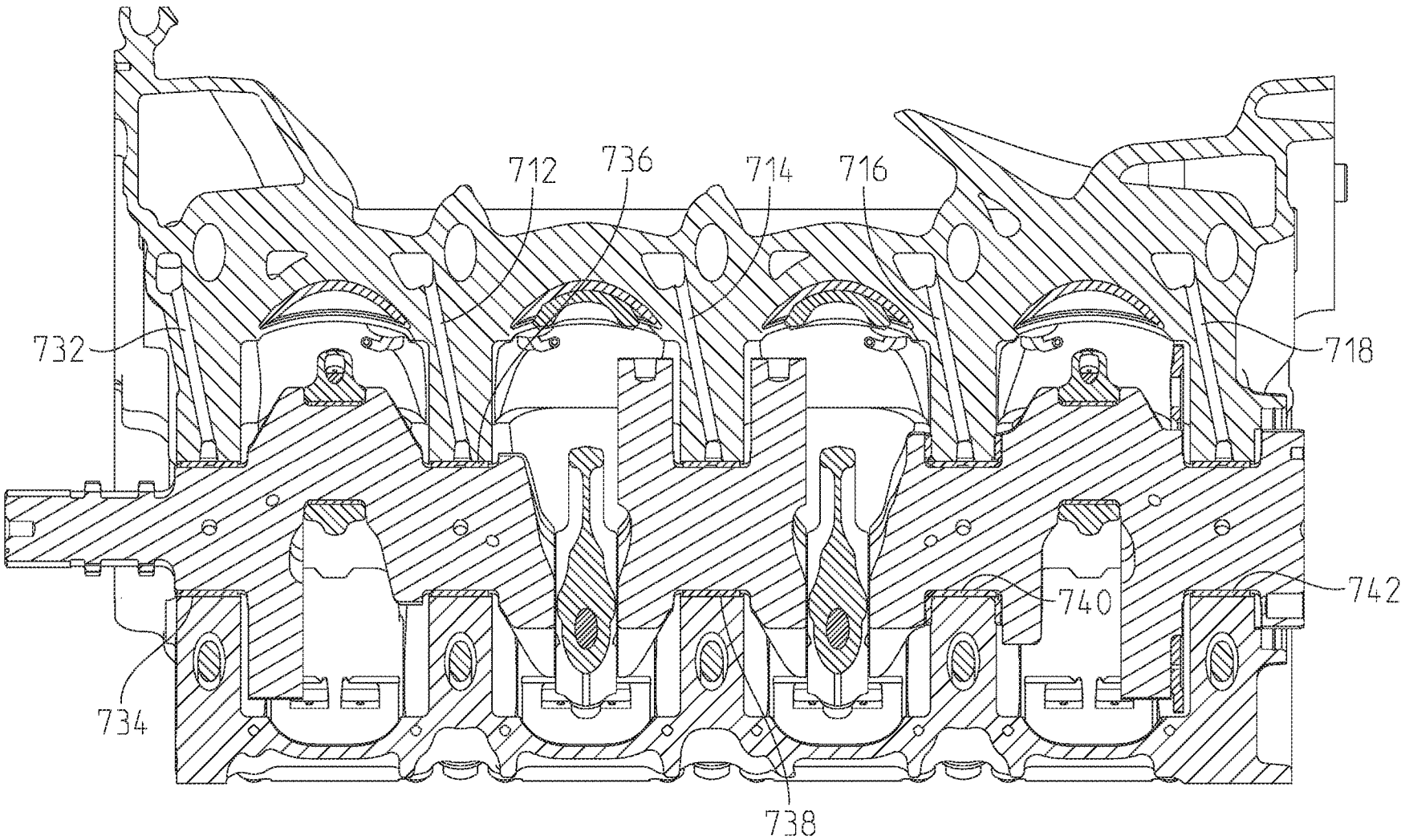
FIG. 47 is a cross-sectional view through lines 47-47 of FIG. 43.
Figure 48:
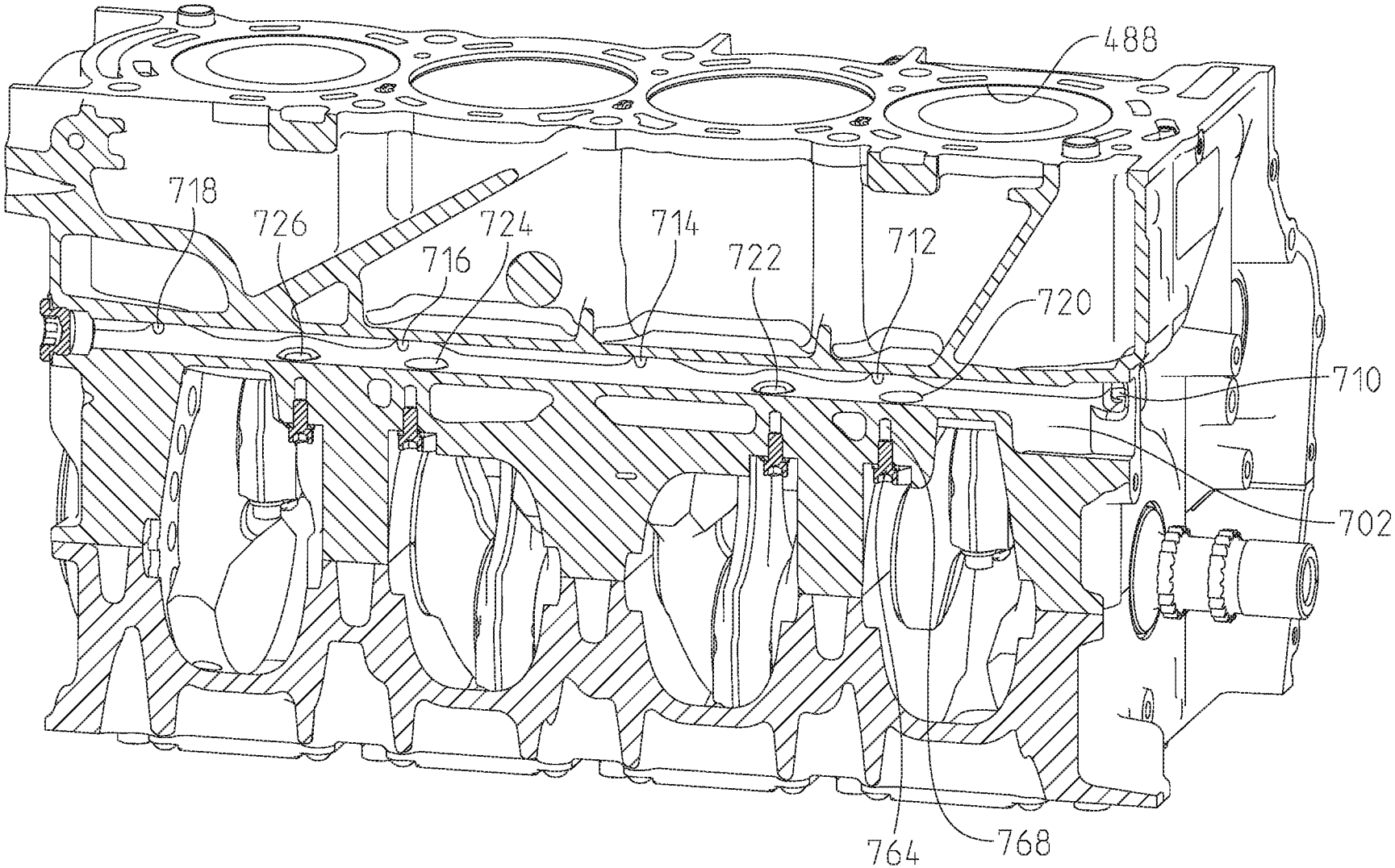
FIG. 48 is a cross-sectional view through lines 48-48 of FIG. 43.
Figure 53:
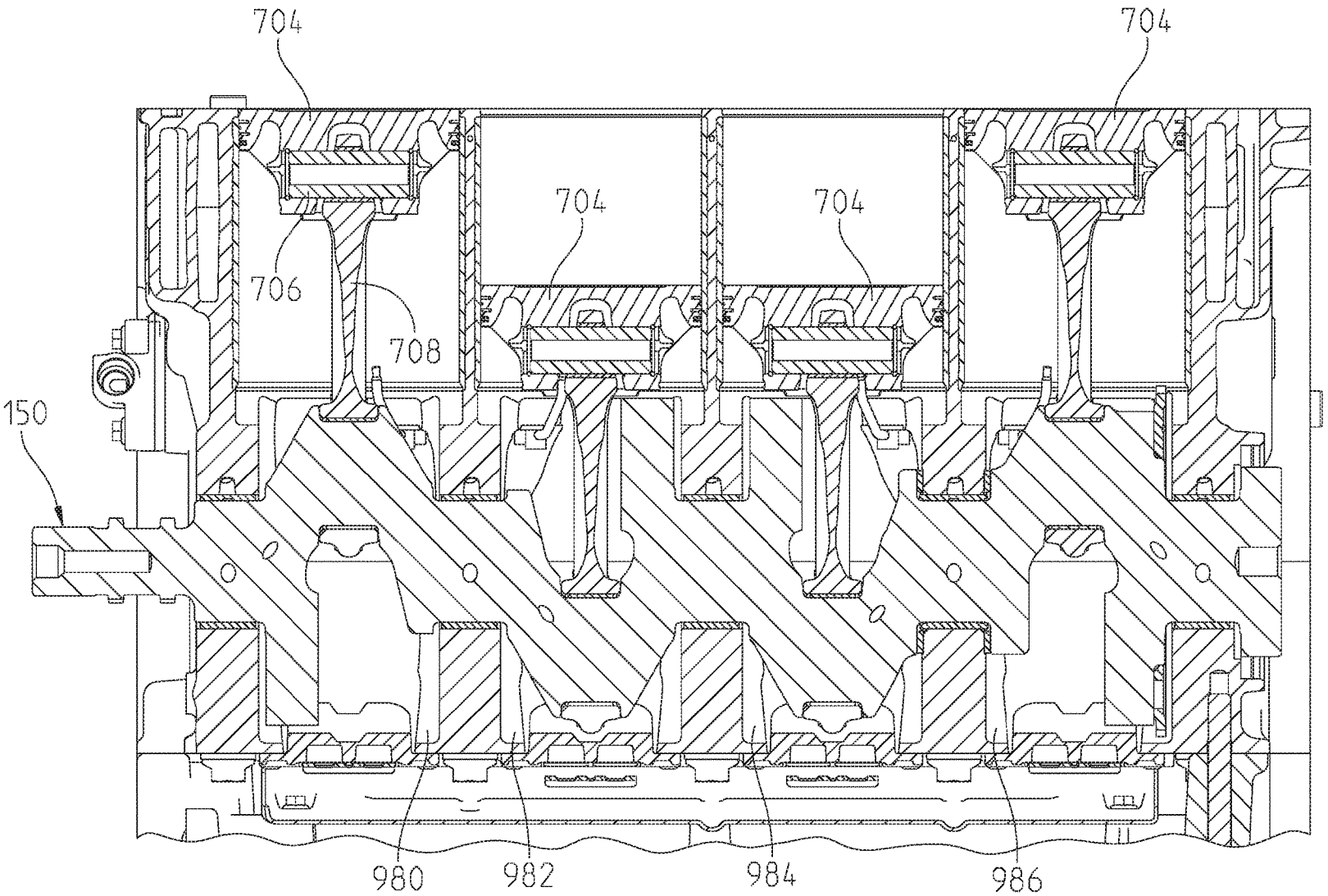
FIG. 53 is a cross-sectional view through lines 53-53 of FIG. 43.
Figure 54:
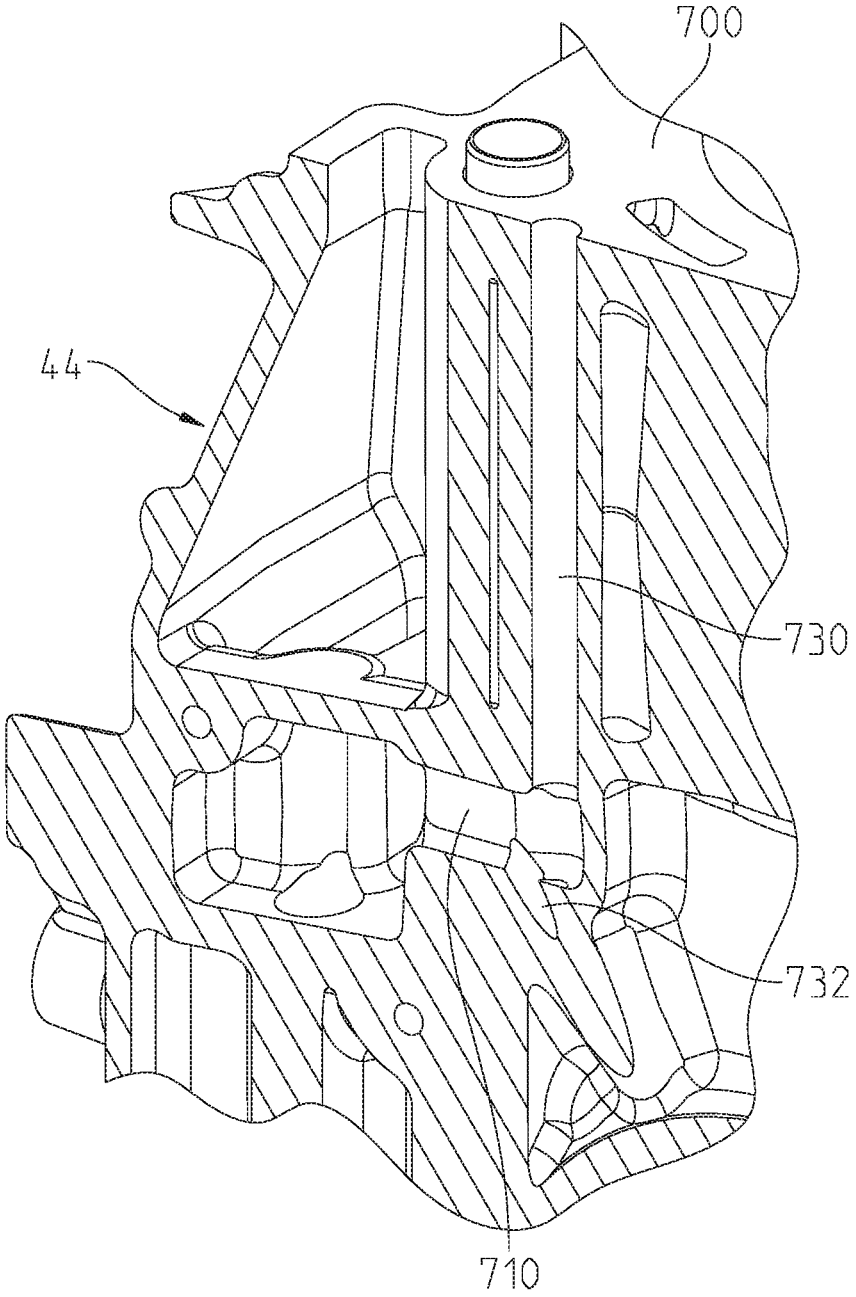
FIG. 54 is a cross-sectional view through lines 54-54 of FIG. 44.

With reference now to FIG. 46, the oil flow upwardly through aperture 682 and 692 extends only part way up to surface 700. Rather, aperture 692 intersects with a channel 702 which extends rearward of the pistons 704, which couple to the crankshaft 150 by way of piston pins 706 and connecting rods 708 (FIG. 53). With reference now to FIG. 48, channel 702 is shown intersecting with passageways 710, 712, 714, 716 and 718. Channel 702 also intersects with lower apertures 720, 722, 724 and 726. With reference now to FIG. 54, apertures 710 intersects with passageway 730 which extends upwardly to top surface 700 of crankcase 42. Passageway 710 also intersects with a diagonally extending aperture at 732. With reference now to FIG. 47, apertures 732, 712, 714, 716 and 718 feed oil from channel 702 to main bearings 734, 736, 738, 740 and 742, respectively.

Figure 52:
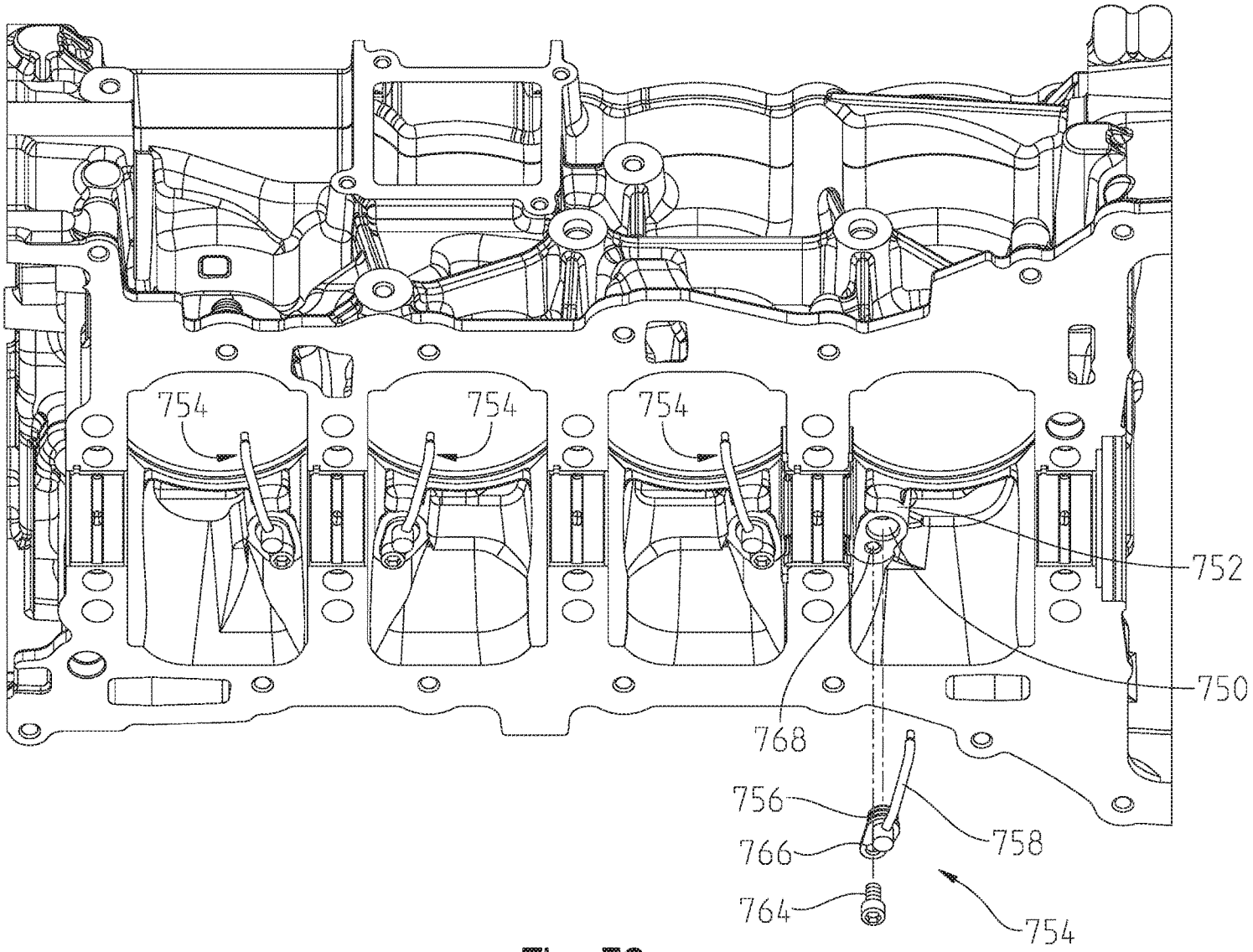
FIG. 52 is an underside perspective view of the crankcase.

With reference again to FIG. 48, apertures 720 extend downwardly and form an opening 750 (FIG. 52) extending from a boss 752 of the crankcase 42. A jet 754 is inserted into the aperture 750 where a fitting 756 is positioned within the aperture 750 and a fastener 764 is positioned through aperture 766 and threadibly applied to aperture 768. It should be appreciated from FIG. 48, that the fastener 764 and aperture 768 is also shown positioned rearward of the channel 702. It should also be appreciated that the jets 754 include an upwardly extending spray nozzle 758 which projects oil upwardly to contact moving parts of the engine such as piston 704, piston pin 706 and connecting rod 708 (FIG. 53).

Figure 45:
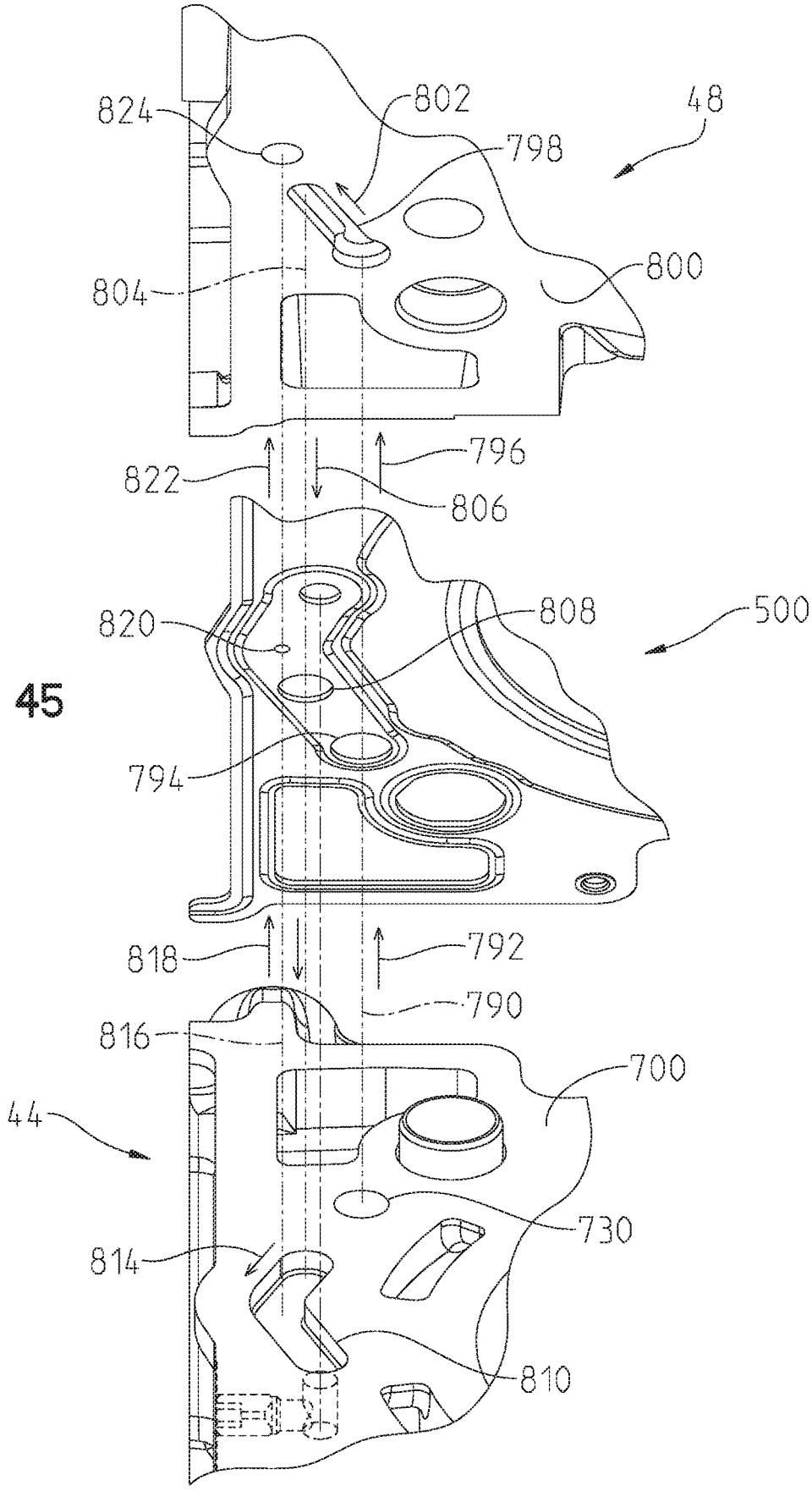
FIG. 45 is a diagrammatical view of the top of the engine crankcase, gasket, and cylinder head.
Figure 49:
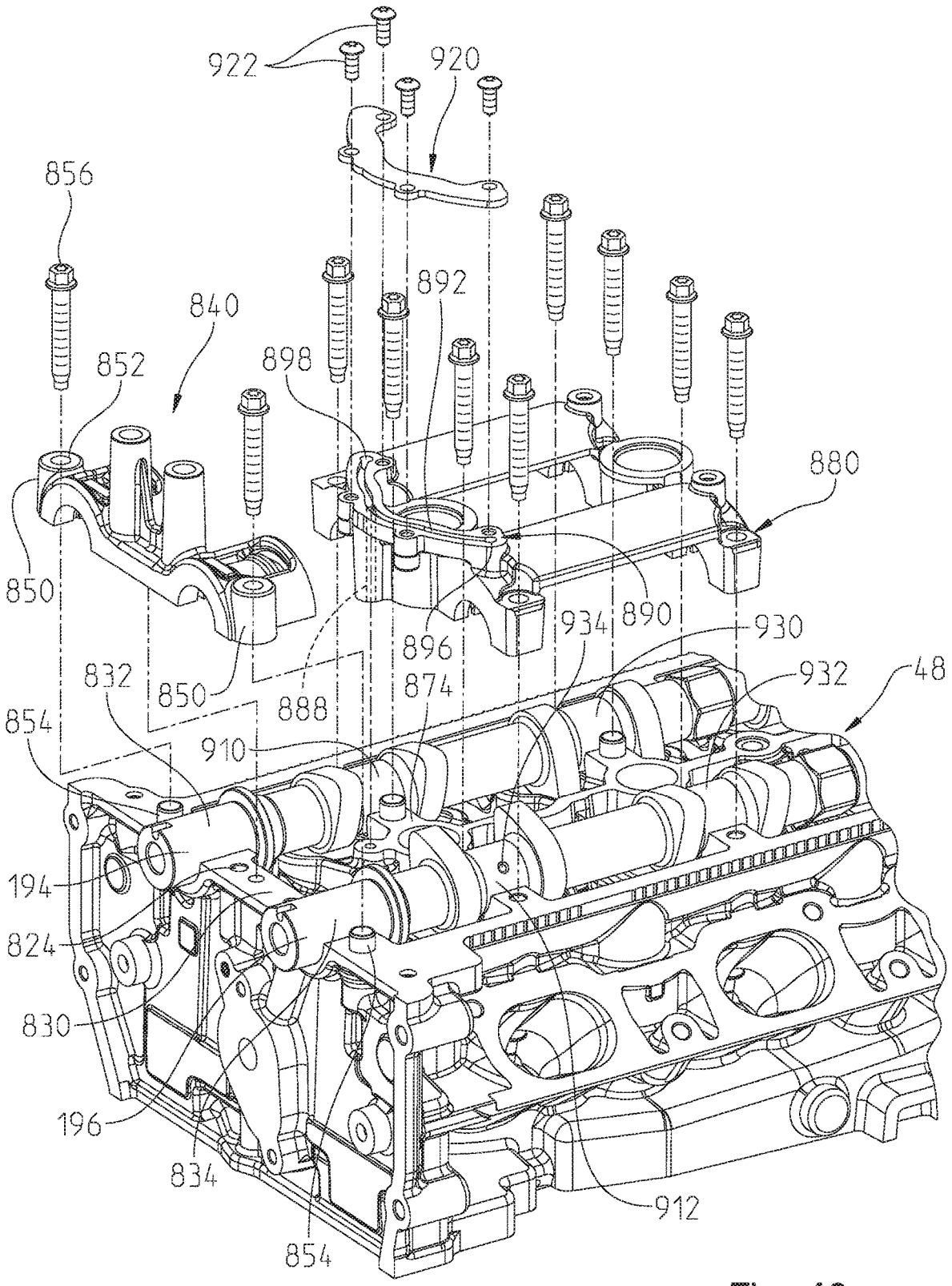
FIG. 49 is a partially exploded view of the engine head showing the camshaft retainers exploded away from the camshafts.
Figure 51:
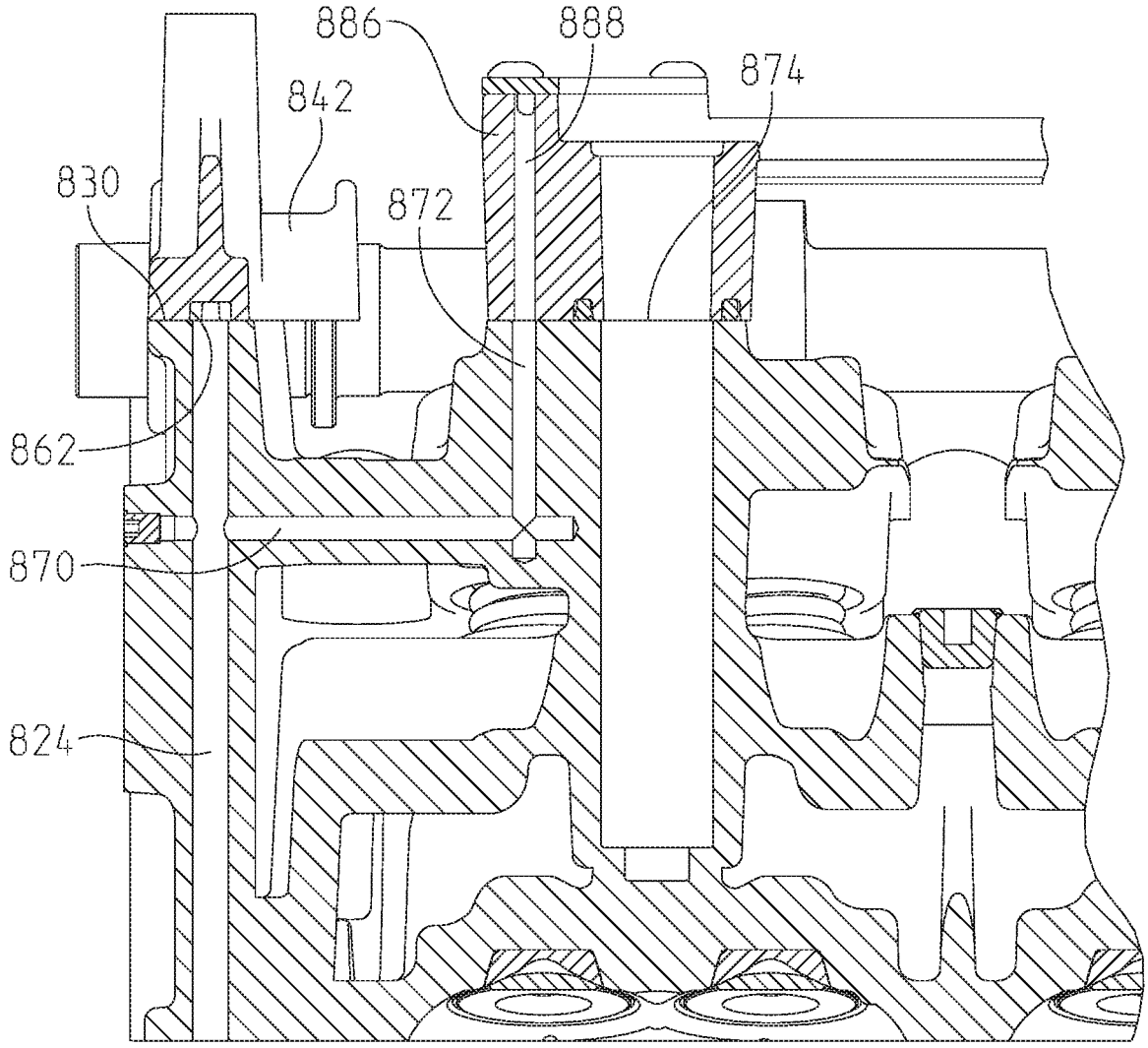
FIG. 51 is a cross-sectional view through lines 51-51 of FIG. 30.

Reference is now made to FIG. 45 which shows the oil flow path moving upwardly from aperture 730 beyond surface 700 of crankcase 42 and moving into the head 48. As shown, oil moves upwardly from aperture 730 along the path 790 in the direction of arrow 792 and flows through aperture 794 of gasket 500. Oil continues to flow in the direction of arrow 796 and into surface channel 798 of head 48. Oil then moves in the direction of arrow 802 and is directed downwardly along the path of 804 in the direction of 806 through aperture 808 of gasket 500. Oil then flows into the V-shaped surface channel 810 and moves in the direction of arrow 814 to a mid-position of the V-shaped channel and is then directed upwardly along path 816 in the direction of arrow 818 through aperture 820 of gasket 500 continuing along the direction of arrow 822 through aperture 824. With reference now to FIGS. 49 and 51, the oil flow through aperture 824 will be described.

Figure 50:
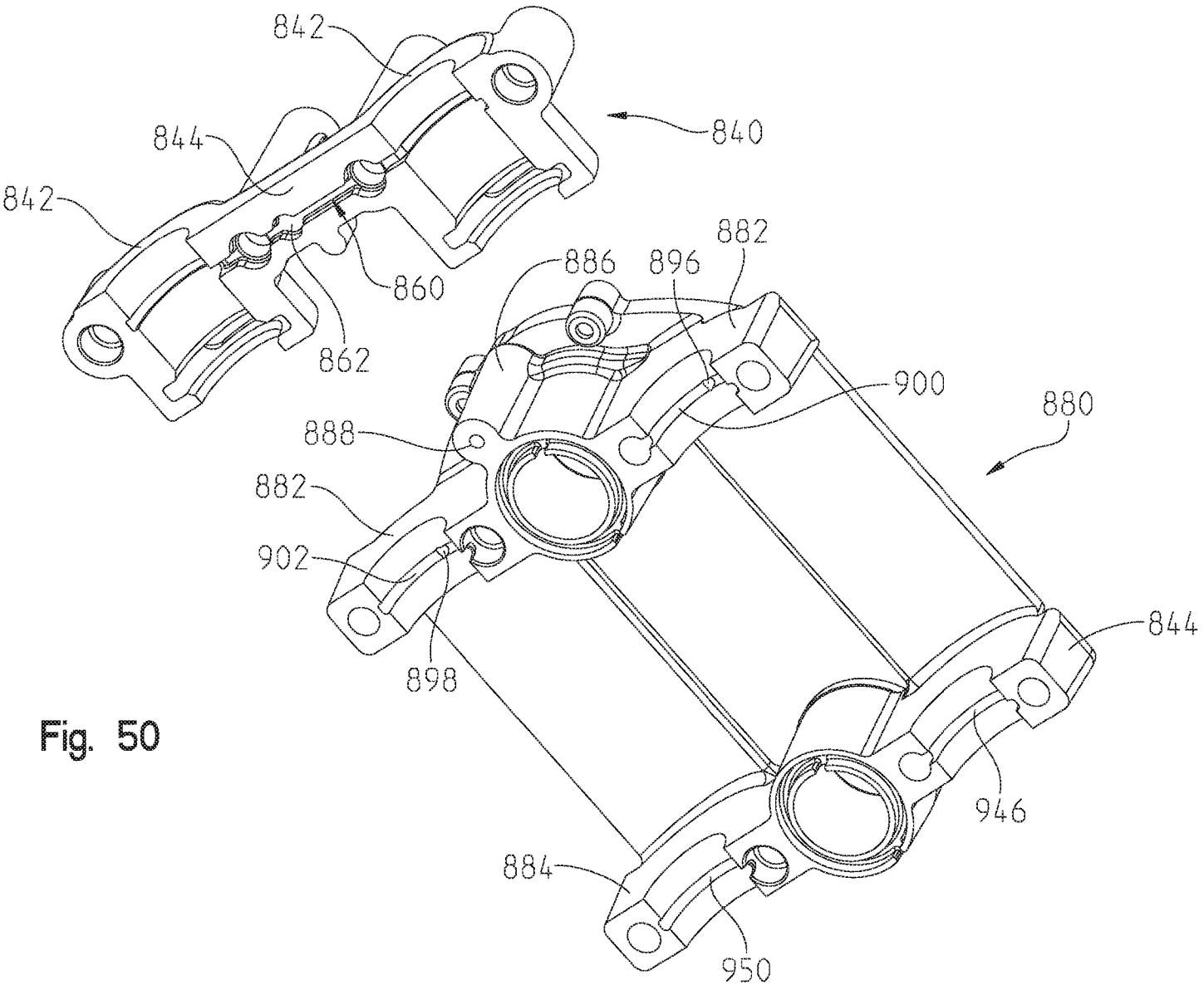
FIG. 50 is an underside perspective view of the camshaft retainers.

As shown best in FIG. 49, oil flows through aperture 824 up to surface 830 of the head 48. As shown in FIGS. 49 and 50, a cam retainer 840 is provided having caps 842 and a center section 844. As shown in FIG. 49, retainer 840 has bosses 850 at the end including apertures 852 which receive fasteners 856 to couple the retainer 840 to the head 48. As shown in FIG. 50, the underside of retainer 840 includes a channel 860 including an opening at 862 which is receivable over aperture 824. Thus, flow of oil upwardly through aperture 824 fills the opening 862 and moves along groove 860 into caps 842 to lubricate the cam shaft portions 832 and 834. Cap 840 is receivable such that apertures 852 overlie alignment pins 854 in head 48.

With reference now to FIG. 51, aperture 824 is cross-drilled at 870 and 872 such that oil is delivered to the top surface 874. With reference to FIG. 50, a second retainer 880 is shown having retaining caps 882 and 884. A boss is provided at 886 having an aperture at 888. Aperture 888 aligns with aperture 872 as best shown in FIG. 51. As shown best in FIG. 49, aperture 888 extends upwardly to an arcuate channel 890 having a groove at 892 and apertures at 896 and 898. Apertures 896 and 898 are also shown in FIG. 50 opening onto grooves 900, 902. Retainers 882 are positioned over cam portions 910, 912 as best shown in FIG. 49. A cover 920 is positioned over arcuate channel 890 and includes fasteners 922 to couple the arcuate cover to channel 890. Thus, oil is delivered to cam portions 910 and 912 through apertures 896 and 898.

As shown best in FIG. 49, cam shaft portion 912 includes an aperture at 934 which extends inwardly towards a center of cam shaft 196. Thus, oil flows into aperture 934 and rearwardly (to the right as shown in FIG. 49) as the camshaft is bored. Camshafts 194, 196 also include bearing portions 930 and 932 where bearing portion 932 includes an aperture similar to 934. More particularly, and with reference to FIG. 28, aperture 940 is shown extending at position 932 extending downwardly yet intersecting with bore 942 of camshaft 196. In a similar manner, cam shaft 194 includes an aperture at 948 which extends into the center of camshaft 194. Thus, aperture 940 cooperates with groove 946 (FIG. 50) and aperture 948 corresponds with groove 950. The oil flows radially out of apertures 940 and 942 and into grooves 948 and 950 cooperate to lubricate sections 930 and 932 of camshafts 194 and 196.

Figure 56:
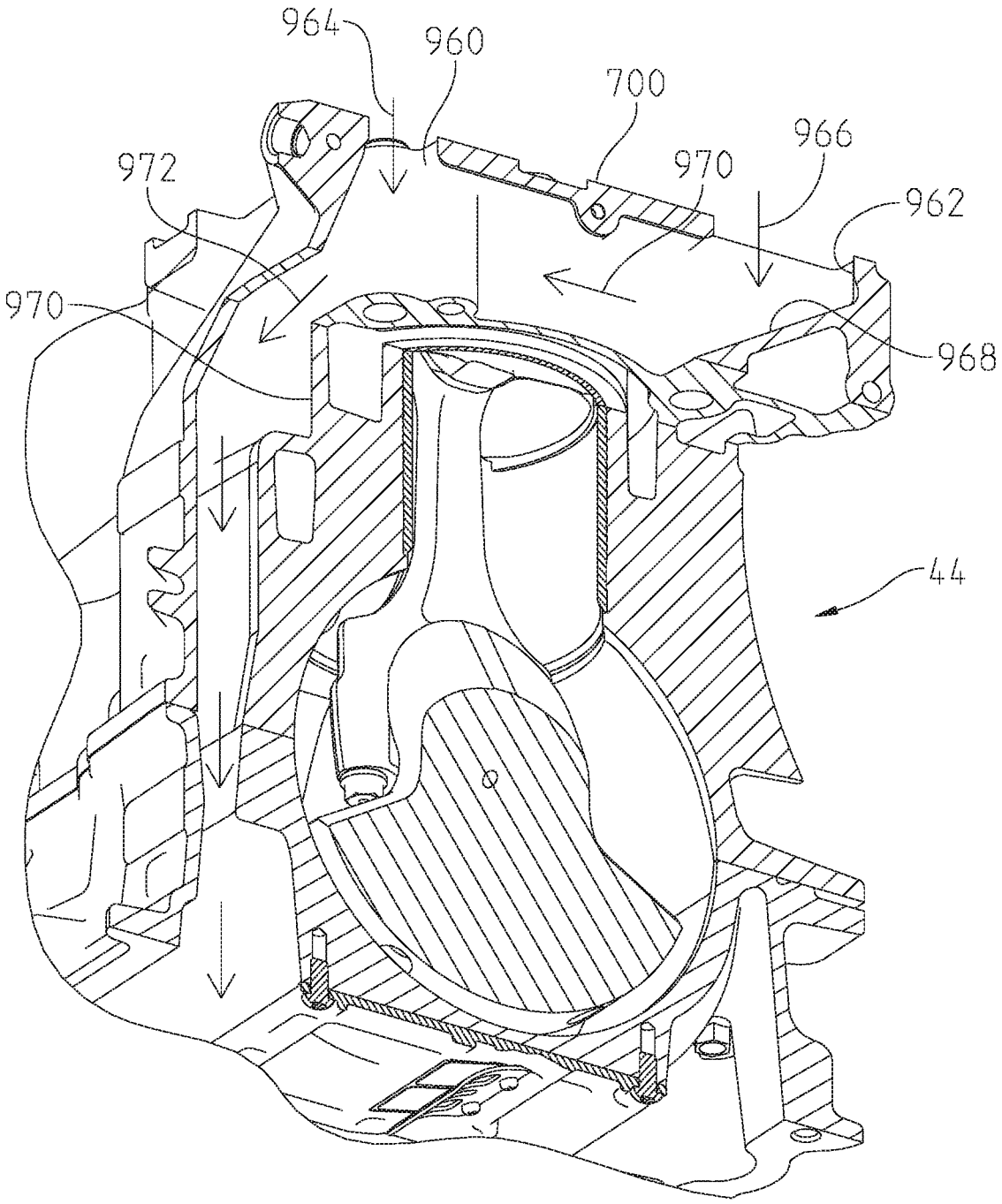
FIG. 56 is a cross-sectional view through lines 56-56 of FIG. 26.

With the lubrication to the crankcase 42 and the head 48 described, the drain back of oil will now be described. With reference first to FIG. 31B, the head includes apertures 951 and 952 at a front end thereof and aperture 954 at a rear thereof. It should be understood from viewing FIG. 31B that oil pools in pockets 956*a*-956*f* and needs to be drained back to the oil pan 40. With reference now to FIG. 56, drain apertures 960 and 962 align with apertures 951 and 952 of head 48, respectively. Oil flow through aperture 960 progresses downwardly in a direction of arrow 964 and oil through aperture 962 progresses along the direction of arrow 966 and is then turned by surface 968 to progress in the direction of arrow 970. The oil through apertures 960 and 962 are mixed and flow along the path at 970 through aperture 970 and downwardly into the oil pan 40.

Figure 55:
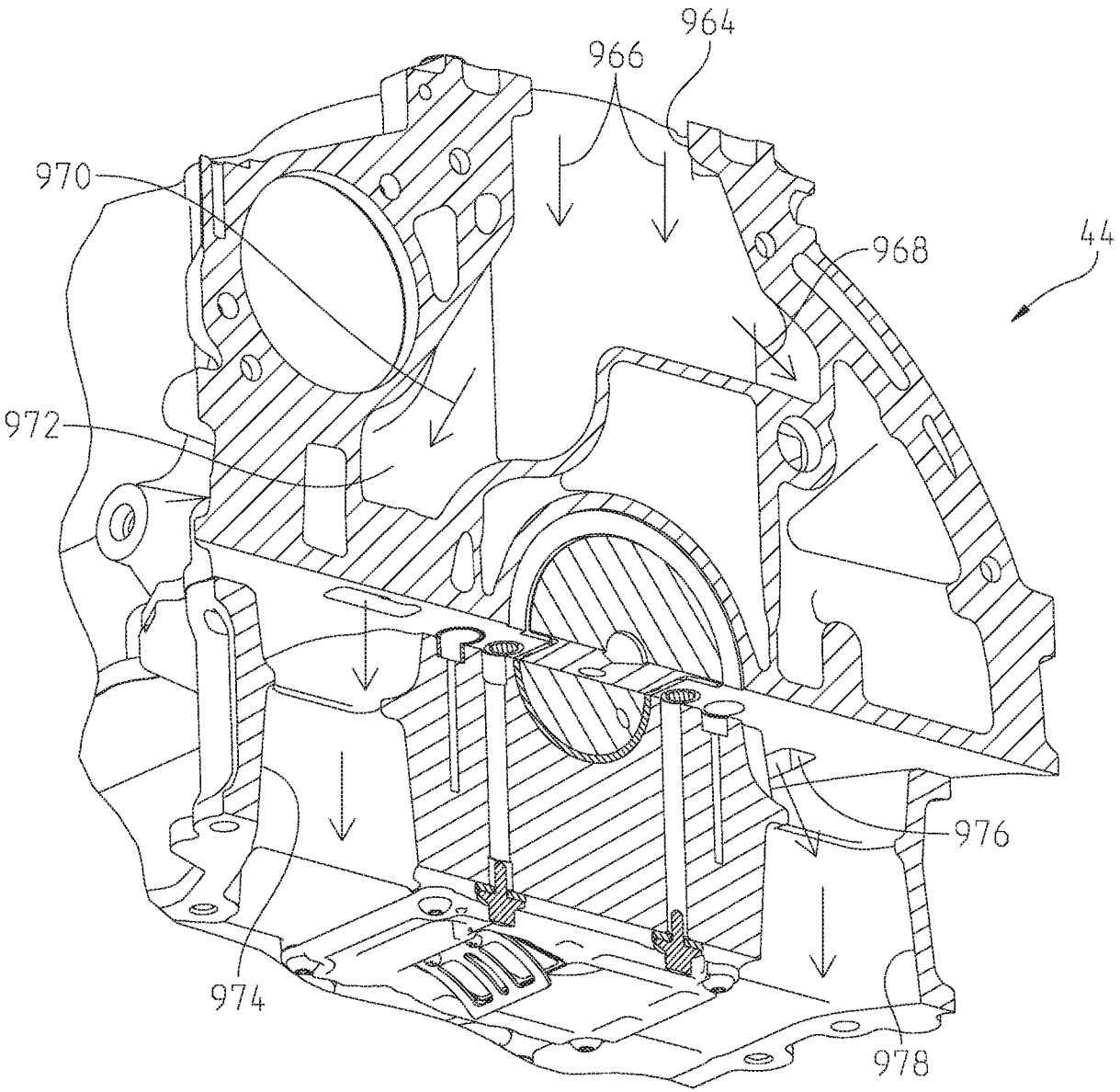
FIG. 55 is a staggered cross-sectional view through lines 55-55 of FIG. 26.

With reference now to FIG. 55, aperture 954 is aligned with aperture 964 and progresses downwardly in the direction of arrows 966. The flow is split and a portion extends in the direction of arrow 968 and the remaining portion progresses in the direction of arrow 970 through aperture 972 through enlarged opening 974 and into the oil pan 40. The oil progressing in the direction of arrow 968 progresses downwardly through aperture 976 through enlarged opening 978 and into the oil pan 40.

Figure 57:
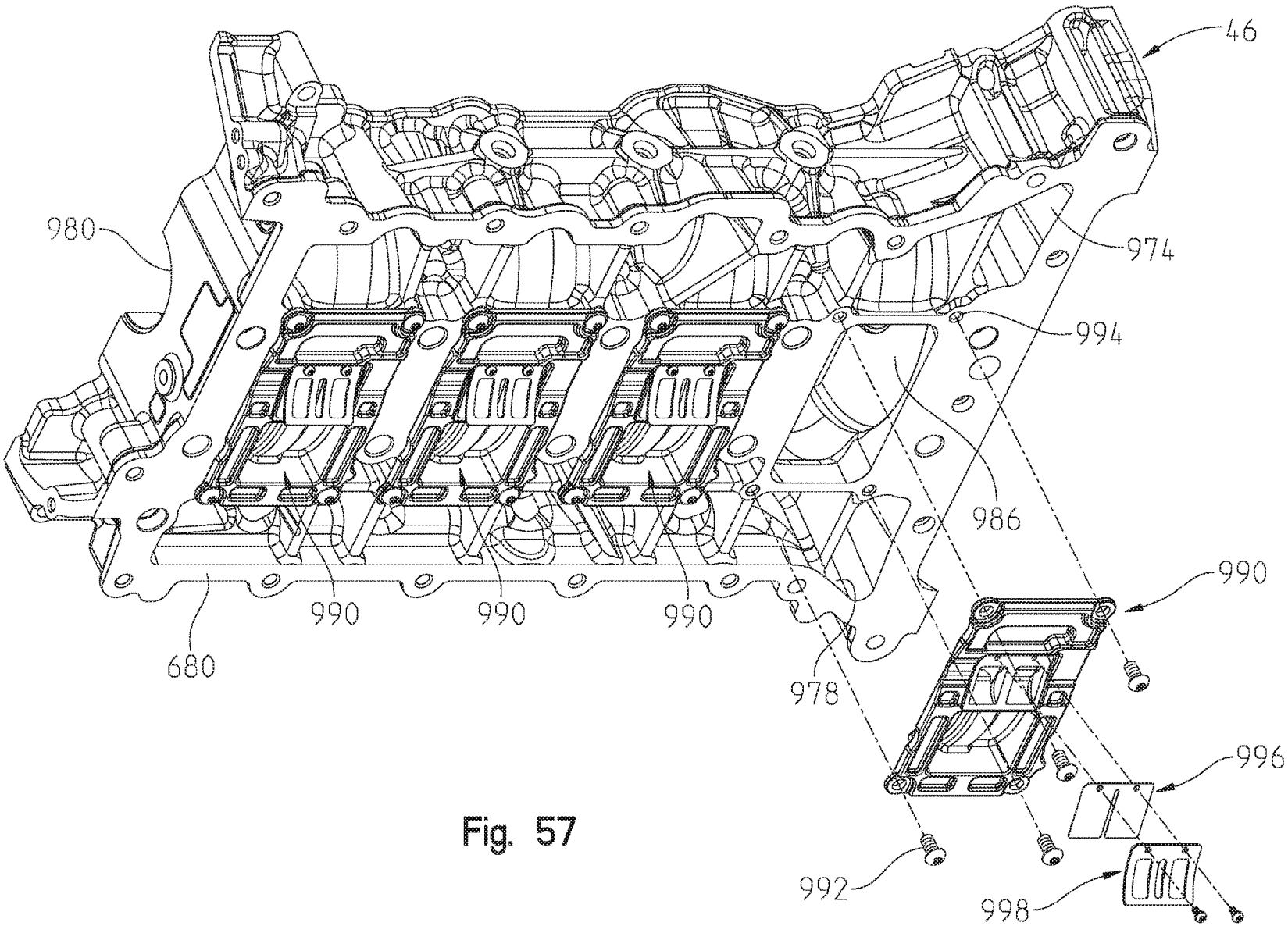
FIG. 57 is an exploded view of the reed valve assembly.

As mentioned above, the crankcase 42 is defined by the block 44 and the bed plate 46. As shown in FIG. 57, the bed plate 46 forms the lower half of the crankshaft support where the bed plate 46 includes semi-circular openings at 980. As shown best in FIGS. 25 and 42, the block 44 includes semi-circular openings at 982 which cooperate with semi-circular openings 980 to encompass the crankshaft 150. With reference again to FIG. 42, crankshaft 150 is shown coupled to connecting rods 694, such that portions of the connecting rods 694 and crankshaft 150 extend below surface 690 at various positions through the four cycles of combustion. For this purpose bed plate 46 includes individual chambers 986 which position over the crankshaft portions and connecting rod portions extending below surface 690.

With reference again to FIG. 57, bed plate 46 is shown from an underside thereof, where plural reed valve assemblies 990 are coupled to the lower surface 680 by way of fasteners 992 received in apertures 994. The reed valves 990 substantially cover the chambers 986, such that the blow-by gases and oil from the various cylinders do not mix with each other costing the loss of horsepower. Rather the reed valves 990 include reeds 996 and covers 998, such that during reciprocation of the individual pistons 704, the reeds 996 open downwardly to expel the blow-by gases and oil into the oil pan 40, and when the piston 704 reaches BDC, the reeds 996 close.

With reference again to FIG. 27, the bed plate 46 is coupled to the block 44 to define the crankcase 42. As shown, the bed plate 46 includes fasteners 1000 positioned through apertures 1002 (FIGS. 27 and 42) in bed plate 46 and into threaded apertures 1004 (FIGS. 27 and 42) to retain bedplate 46 and block 44 together. In addition, head bolts 1006 extend through clearance holes 1008 (FIGS. 27 and 33) in head 48; through clearance holes 1010 (FIGS. 27 and 42) in block 44 and into threaded engagement with threaded apertures 1012 (FIGS. 27 and 42) by way of threaded portions 1014. In addition, the oil pan 40 is coupled to the bed plate 46 by way of fasteners 1020 (FIG. 5) extending through apertures 1022 (FIG. 34) and into threaded engagement with threaded apertures 1024 (FIG. 41) into bed plate 46.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

The invention claimed is:

1. An engine comprising a crankcase having at least two cylinders; a crankshaft supported by the crankcase; at least two pistons coupled to the crankshaft and each reciprocating within one of the cylinders; a head positioned over the cylinders; at least two camshafts supported by the head, each camshaft extending along a longitudinal axis; at least four valves supported by the head and having a pair of two valves positioned over each cylinder and operatively connected to the camshafts, each pair of valves extending at a transverse axis relative to the longitudinal axis of the camshafts, and each pair of valves comprising an exhaust valve and an intake valve; a water pump for cooling the engine head; a first water cooling core extending through the head and extending longitudinally through the head on a first side of the exhaust valves; a first set of apertures extending upward through the head and communicating with the first water cooling core, the first set of apertures being positioned proximate each other and proximate a center of the head; a second water cooling core extending through the head and extending longitudinally through the head on a second side of the exhaust valves, the second side being opposite the first side; a second set of apertures extending upward through the head and communicating with the second water core; and a water discharge port for discharging the water from the first and second water cooling cores.

2. The engine of claim 1, wherein the water pump forces cooling water through the first set of apertures into the first cooling core, and the cooling water traverses in the first water cooling core in opposite longitudinal directions.

3. The engine of claim 1, wherein the second set of apertures includes an aperture for each cylinder.

4. The engine of claim 3, wherein each second aperture is proximate to a longitudinal center of each cylinder.

5. The engine of claim 1, wherein the second set of apertures is positioned proximate each first and second cylinders.

6. The engine of claim 1, further comprising a connecting path joining the first and second water cooling cores.

7. The engine of claim 2, wherein each aperture of the first set of apertures is positioned adjacent a center of the head.

8. The engine of claim 4, wherein a longitudinal center of each aperture of the second set of apertures also defines the longitudinal center of each cylinder it is positioned proximate to.

9. The engine of claim 1, wherein the first set of apertures is positioned on the same side of the exhaust valves as the second set of apertures.

10. The engine of claim 1, wherein the crankshaft comprises a plurality of bearings, a plurality of rods, and a plurality of counterweights, and the plurality of rods is equal to the plurality of counterweights.

11. The engine of claim 1, further comprising a starter motor positioned within an opening of the engine and above the crankshaft.

12. The engine of claim 11, wherein a portion of the starter motor is positioned above at least a portion of a flywheel within the engine.

13. The engine of claim 12, wherein the flywheel comprises a plurality of ridges and a substantially concave shape including a concavity, and the concavity is configured to face the crankshaft.

* * * * *